US012778319B2

(12) United States Patent
Nagel et al.

(10) Patent No.: US 12,778,319 B2
(45) **Date of Patent: *Nov. 3, 2026**

(54) RETAIL MERCHANDISE TRAY

(71) Applicant: Fasteners for Retail, Inc., Twinsburg, OH (US)

(72) Inventors: Thomas O. Nagel, Rockford, IL (US); Kelly Ann Pickett, Rockford, IL (US); Francesc Xavier Badia Rotger, Saltsjobaden (SE)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/006,691

(22) Filed: Dec. 31, 2024

(65) Prior Publication Data

US 2025/0134279 A1 May 1, 2025

Related U.S. Application Data

(63) Continuation of application No. 18/612,338, filed on Mar. 21, 2024, now Pat. No. 12,213,603, which is a continuation of application No. 18/101,459, filed on Jan. 25, 2023, now Pat. No. 11,963,625, which is a continuation of application No. 17/686,191, filed on Mar. 3, 2022, now Pat. No. 11,583,107, which is a continuation-in-part of application No. 17/502,845, filed on Oct. 15, 2021, now Pat. No. 11,583,106, which is a continuation of application No.
(Continued)

(51) Int. Cl.

| | |
|---|---|
| ***A47F 1/12*** | (2006.01) |
| ***A47F 5/01*** | (2006.01) |
| ***A47F 5/13*** | (2006.01) |

(52) U.S. Cl.
CPC ..... *A47F 1/126* (2013.01); *A47F 1/121* (2013.01); *A47F 5/01* (2013.01); *A47F 5/132* (2013.01); *A47F 1/12* (2013.01)

(58) Field of Classification Search
CPC .. A47F 1/126; A47F 5/132; A47F 5/01; A47F 1/121; A47F 1/12; A47F 1/125; A47F 5/0025; A47F 5/005; A47B 57/58
See application file for complete search history.

(56) References Cited

U.S. PATENT DOCUMENTS

| | | | |
|---|---|---|---|
| 1,395,621 | A | 11/1921 | Wheatley |
| 1,396,910 | A | 11/1921 | Annable |
| 1,676,908 | A | 7/1928 | Levene |

(Continued)

FOREIGN PATENT DOCUMENTS

| | | | |
|---|---|---|---|
| CN | 113738211 | A | 12/2021 |

*Primary Examiner* — Devin K Barnett
(74) *Attorney, Agent, or Firm* — Reinhart Boerner Van Deuren P.C.

(57) ABSTRACT

A retail merchandise tray assembly is provided. The tray assembly may have an adjustable divider. The tray assembly may have a sign adaptor for mounting a sign to the divider. The tray assembly may have an accessory clip. The tray assembly may have a pivotable front stop. The tray assembly may have sign holders mounted to a front stop. The tray assembly may include signs mounted within a sign holder that is mounted to the front stop. The divider may be powder coated while the divider mounts may be free of painting. Methods are also provided.

21 Claims, 38 Drawing Sheets

Related U.S. Application Data

17/154,299, filed on Jan. 21, 2021, now Pat. No. 11,166,571.

(60) Provisional application No. 62/964,476, filed on Jan. 22, 2020.

(56) References Cited

U.S. PATENT DOCUMENTS 1,902,451 A 3/1933 Johnson
2,371,917 A 3/1945 Rosenberg
2,522,896 A * 9/1950 Rifkin ..... A47F 1/126 221/241
2,779,114 A * 1/1957 Orthwine ..... G09F 3/20 40/658
2,934,212 A * 4/1960 Jacobson ..... A47F 1/126 211/59.3
3,625,371 A 12/1971 Dill
4,282,977 A 8/1981 Di Lorenzo
4,395,955 A * 8/1983 Pfeifer ..... A47F 5/005 211/184
4,471,512 A 9/1984 Thalenfeld
4,621,878 A 11/1986 Johnson et al.
D290,201 S 6/1987 Wilder
4,730,741 A * 3/1988 Jackle, III ..... A47F 1/126 211/59.3
4,773,348 A 9/1988 Rowley
4,911,309 A 3/1990 Stefan
5,012,936 A * 5/1991 Crum ..... A47F 1/126 206/556
5,069,349 A * 12/1991 Wear ..... A47F 1/126 211/59.3
5,133,463 A * 7/1992 Merl ..... A47F 5/13 211/175
5,190,186 A 3/1993 Yablans et al.
5,205,524 A * 4/1993 Cohen ..... F16B 7/14 248/222.51
5,240,125 A * 8/1993 Kunz ..... A47F 1/126 211/74
5,255,802 A 10/1993 Krinke et al.
5,341,945 A 8/1994 Gibson
5,366,099 A * 11/1994 Schmid ..... A47F 1/126 211/59.3
5,390,802 A * 2/1995 Pappagallo ..... A47F 1/125 211/59.3
5,456,435 A * 10/1995 Sweeney ..... A47F 5/08 211/90.01
5,458,248 A * 10/1995 Alain ..... A47B 96/021 211/175
5,484,068 A * 1/1996 Huang ..... A47B 57/045 248/245
5,634,564 A * 6/1997 Spamer ..... A47F 1/126 211/59.3
5,642,557 A 7/1997 Clews
5,665,304 A * 9/1997 Heinen ..... A47F 1/126 211/59.3
5,673,801 A * 10/1997 Markson ..... A47F 1/126 211/59.3
5,855,283 A * 1/1999 Johnson ..... A47F 1/126 211/59.3
5,865,324 A * 2/1999 Jay ..... A47F 7/28 211/74
5,873,489 A 2/1999 Ide et al.
6,047,647 A * 4/2000 Laraia, Jr. ..... A47B 57/58 211/184
D428,277 S 7/2000 White
6,082,558 A * 7/2000 Battaglia ..... A47F 1/126 211/59.3
D431,954 S 10/2000 White
6,142,317 A * 11/2000 Merl ..... A47F 1/125 211/59.3
6,164,462 A * 12/2000 Mumford ..... A47F 5/0093 211/90.03
6,179,136 B1 * 1/2001 Kluge ..... A47B 57/30 211/187
6,293,405 B1 9/2001 Burch, Jr.
D450,199 S 11/2001 White
6,321,918 B1 11/2001 Rollins
6,364,136 B1 * 4/2002 Weshler ..... A47F 5/103 211/175
6,390,310 B1 5/2002 Insalaco
6,719,152 B1 * 4/2004 Nagel ..... A47F 1/126 211/59.3
6,745,906 B1 * 6/2004 Nagel ..... A47F 1/126 211/59.3
6,866,155 B2 * 3/2005 Nagel ..... A47F 1/126 211/59.3
6,866,156 B2 * 3/2005 Nagel ..... A47F 1/126 211/59.3
6,886,700 B2 * 5/2005 Nagel ..... A47F 1/126 211/59.3
6,889,855 B2 * 5/2005 Nagel ..... A47F 1/126 211/59.3
7,032,761 B2 * 4/2006 Nagel ..... G09F 3/204 211/59.3
7,089,695 B2 8/2006 Fast et al.
7,419,062 B2 * 9/2008 Mason ..... A47F 1/126 211/59.3
7,424,957 B1 * 9/2008 Luberto ..... A47F 1/126 312/61
7,458,473 B1 * 12/2008 Mason ..... A47F 1/126 211/59.3
7,681,744 B2 * 3/2010 Johnson ..... A47F 1/126 211/59.3
7,690,519 B2 * 4/2010 Kahl ..... A47F 1/12 211/74
7,784,745 B2 8/2010 Dodge
7,836,621 B2 11/2010 Mueller et al.
7,850,015 B1 * 12/2010 Mason ..... A47F 1/087 211/175
7,854,334 B2 * 12/2010 Nagel ..... A47F 1/126 211/59.3
7,918,353 B1 * 4/2011 Luberto ..... A47F 1/126 312/61
7,931,156 B2 * 4/2011 Hardy ..... A47F 1/126 211/59.3
8,210,365 B2 * 7/2012 Van Wyk ..... A47B 81/00 211/85.3
8,210,367 B2 * 7/2012 Nagel ..... A47F 3/14 211/59.3
D689,948 S * 9/2013 Valls ..... D20/43
D689,949 S * 9/2013 Valls ..... D20/43
D694,554 S 12/2013 Yiannaki et al.
D697,974 S * 1/2014 Valls ..... D20/19
8,657,126 B1 2/2014 Loftin et al.
8,720,702 B2 * 5/2014 Nagel ..... A47F 1/04 211/59.3
9,138,075 B2 9/2015 Hardy et al.
9,138,076 B2 9/2015 Hardy
9,241,583 B2 * 1/2016 Nagel ..... A47F 3/147
9,254,049 B2 * 2/2016 Nagel ..... A47F 3/0486
9,629,479 B2 * 4/2017 Sosso ..... A47F 5/0018
9,713,394 B1 * 7/2017 Bruegmann ..... A47F 5/0025
9,801,466 B2 * 10/2017 Hardy ..... A47F 5/005
9,986,852 B2 * 6/2018 Chenoweth ..... F21V 21/08
10,034,557 B1 7/2018 Nagel
10,206,520 B2 * 2/2019 Hardy ..... A47B 87/0269
10,251,494 B1 * 4/2019 Nagel ..... A47F 5/005
10,334,949 B2 7/2019 Leinonen et al.
10,912,398 B2 2/2021 Wills et al.
11,963,625 B2 * 4/2024 Nagel ..... A47F 1/126
2002/0175132 A1 11/2002 Shea
2003/0000956 A1 * 1/2003 Maldonado ..... G07F 11/42 221/120
2003/0057167 A1 * 3/2003 Johnson ..... A47F 1/126 211/59.3
2003/0217980 A1 * 11/2003 Johnson ..... A47F 1/126 211/59.3
2004/0000528 A1 * 1/2004 Nagel ..... A47F 1/126 211/59.3

(56) References Cited

U.S. PATENT DOCUMENTS

2004/0050812 A1* 3/2004 Rojas ..... A47F 5/0068 40/649
2004/0079715 A1* 4/2004 Richter ..... A47F 1/126 211/59.3
2004/0168996 A1* 9/2004 Jones ..... A47F 5/02 211/163
2005/0077260 A1* 4/2005 Mueller ..... A47F 1/126 211/59.3
2005/0092702 A1* 5/2005 Nagel ..... G09F 3/204 211/59.3
2005/0127014 A1* 6/2005 Richter ..... A47F 1/126 211/184
2005/0166806 A1* 8/2005 Hardy ..... A47F 1/126 108/61
2006/0186064 A1* 8/2006 Merit ..... A47F 5/005 211/59.3
2006/0186065 A1* 8/2006 Ciesick ..... A47F 1/04 211/59.3
2006/0186281 A1 8/2006 Thiessen
2006/0273053 A1* 12/2006 Roslof ..... A47F 1/126 211/59.3
2007/0074373 A1 4/2007 Herring et al.
2007/0080126 A1 4/2007 Music
2007/0138114 A1* 6/2007 Dumontet ..... A47F 1/126 211/59.3
2007/0170127 A1* 7/2007 Johnson ..... A47F 1/126 211/59.3
2007/0175839 A1* 8/2007 Schneider ..... A47F 1/126 211/59.3
2008/0142458 A1 6/2008 Medcalf
2009/0145918 A1 6/2009 Colelli et al.
2009/0200906 A1* 8/2009 Dao ..... F24C 15/16 312/410
2009/0212184 A1 8/2009 Bourgeois et al.
2009/0223916 A1* 9/2009 Kahl ..... A47F 1/12 211/85.4
2010/0025346 A1* 2/2010 Crawbuck ..... A47F 1/12 211/59.3
2010/0032391 A1 2/2010 Schneider et al.
2010/0107670 A1* 5/2010 Kottke ..... A47F 5/0838 62/250
2010/0108624 A1* 5/2010 Sparkowski ..... A47F 1/126 211/59.3
2010/0140197 A1 6/2010 Schneider et al.
2010/0176075 A1* 7/2010 Nagel ..... A47F 1/126 211/59.3
2010/0176077 A1* 7/2010 Nagel ..... A47F 1/125 211/126.16
2010/0307992 A1 12/2010 Robertson et al.
2011/0017684 A1* 1/2011 Nagel ..... A47F 1/126 211/59.3
2011/0174750 A1* 7/2011 Poulokefalos ..... A47F 1/126 211/59.3
2011/0210086 A1* 9/2011 Ciesick ..... A47F 1/04 211/59.3
2011/0215060 A1* 9/2011 Niederhuefner ..... A47F 1/125 211/59.3
2011/0290749 A1* 12/2011 Neumann ..... A47F 5/0838 248/241
2012/0031865 A1 2/2012 Paeth
2012/0048817 A1* 3/2012 Green ..... A47F 5/0068 211/59.3
2012/0091079 A1* 4/2012 Schwester ..... A47F 1/125 211/59.3
2012/0103922 A1* 5/2012 Bird ..... A47F 1/126 211/59.3
2012/0211450 A1* 8/2012 Kologe ..... A47F 5/0025 211/59.3
2012/0255924 A1* 10/2012 Kologe ..... A47F 5/0025 211/183
2012/0279934 A1* 11/2012 Thomas ..... A47F 1/126 211/59.3
2013/0020270 A1 1/2013 Valiulis et al.
2013/0112634 A1* 5/2013 Nagel ..... A47F 5/08 211/59.3
2013/0193095 A1* 8/2013 Nagel ..... A47F 5/0861 211/59.3
2013/0199066 A1 8/2013 Clark et al.
2014/0054310 A1* 2/2014 Loftin ..... A47F 1/087 414/412
2014/0112752 A1* 4/2014 Hardy ..... A47B 57/58 211/49.1
2014/0117179 A1 5/2014 Valls et al.
2014/0124463 A1 5/2014 Goehring
2014/0151313 A1 6/2014 Breslow et al.
2014/0167962 A1* 6/2014 Valiulis ..... G07F 9/026 211/59.3
2014/0190914 A1 7/2014 Nagel
2014/0196807 A1* 7/2014 Ikeda ..... B29B 7/582 137/896
2014/0305889 A1* 10/2014 Vogler ..... A47F 5/0846 211/59.3
2014/0305890 A1 10/2014 Vogler et al.
2014/0319086 A1* 10/2014 Sosso ..... A47F 5/0018 211/59.3
2015/0021283 A1* 1/2015 Bruegmann ..... A47F 1/12 211/59.2
2015/0068991 A1* 3/2015 Kostka ..... A47F 1/126 211/59.3
2015/0129520 A1* 5/2015 Kologe ..... A47F 1/126 211/59.3
2015/0157142 A1 6/2015 Turner et al.
2015/0164241 A1* 6/2015 Nagel ..... A47F 1/125 211/59.3
2015/0208830 A1* 7/2015 Hardy ..... A47B 57/58 211/59.3
2015/0230628 A1 8/2015 Juric
2015/0257547 A1 9/2015 Nagel
2015/0289680 A1 10/2015 Sosso et al.
2016/0022035 A1 1/2016 Hardy
2016/0150894 A1 6/2016 Howard et al.
2016/0286983 A1 10/2016 Hachmann
2017/0007038 A1* 1/2017 Ewing ..... A47F 1/126
2017/0172314 A1 6/2017 Vogler et al.
2017/0196355 A1 7/2017 Hardy et al.
2017/0202369 A1 7/2017 Mercier et al.
2017/0224131 A1 8/2017 Murphy
2017/0295958 A1 10/2017 Hassell et al.
2017/0318985 A1* 11/2017 Collette ..... A47F 5/005
2018/0020848 A1 1/2018 Mercier et al.
2018/0070743 A1 3/2018 Hardy
2018/0153313 A1 6/2018 Padvoiskis et al.
2018/0310725 A1 11/2018 Pena et al.
2019/0167011 A1* 6/2019 Nagel ..... A47B 57/58
2020/0015602 A1* 1/2020 Nagel ..... A47F 5/005
2020/0093282 A1 3/2020 Bruegmann
2020/0196775 A1 6/2020 Berglund et al.
2021/0219742 A1* 7/2021 Nagel ..... G09F 23/06
2022/0039564 A1 2/2022 Nagel
2022/0183480 A1* 6/2022 Nagel ..... A47F 5/132

* cited by examiner

RETAIL MERCHANDISE TRAY

CROSS-REFERENCE TO RELATED PATENT APPLICATIONS

This patent application is a Continuation application of U.S. patent application Ser. No. 18/612,338, filed Mar. 21, 2024, which is a Continuation application of U.S. patent application Ser. No. 18/101,459, filed Jan. 25, 2023, which is now U.S. Pat. No. 11,963,625, issued Apr. 23, 2024, which is a Continuation application of U.S. patent application Ser. No. 17/686,191, filed Mar. 3, 2022, which is now U.S. Pat. No. 11,583,107, issued Feb. 21, 2023, which is a continuation-in-part of U.S. patent application Ser. No. 17/502,845, filed Oct. 15, 2021, which is now U.S. Pat. No. 11,583,106, issued Feb. 21, 2023, which is a Continuation application of U.S. patent application Ser. No. 17/154,299, filed Jan. 21, 2021, which is now U.S. Pat. No. 11,166,571, issued Nov. 9, 2021, which claims the benefit of U.S. Provisional Patent Application No. 62/964,476, filed Jan. 22, 2020. The entire teachings and disclosure of each application is incorporated herein by reference thereto for all purposes.

FIELD OF THE INVENTION

This invention generally relates to retail merchandise displays and more particularly to retail merchandise tray assemblies for use with retail merchandise displays.

BACKGROUND OF THE INVENTION

Retail merchandise displays are generally known in the art. Once such display is a self-facing pusher system. A conventional pusher system incorporates one or more pusher paddles or pusher bodies that ride along a respective elongated track. A spring is connected between the pusher body and a leading edge of the track. The spring acts to bias the pusher body forward along the track towards the leading edge thereof.

A user can retract the pusher body away from the leading edge of the track and position items of retail merchandise in a linear row on top of the track and between the leading edge of the track and the pusher body. The biasing force provided by the spring and exerted upon the pusher body serves to bias the linear row of retail merchandise forward to ultimately "front face" the merchandise.

That is, when a customer removes the leading most item of merchandise from the linear row of merchandise, the pusher body will be drawn forward by the spring to index the row of merchandise forward so that the next item of merchandise in the row is positioned proximate the leading edge of the track in an aesthetically pleasing manner. Such automatic front facing eliminates the necessity for retail store employees to manually face the merchandise, and thus ultimately reduces the cost of labor of the retailer.

The aforementioned pusher systems have been utilized in various retail display environments. One example is a retail shelf. Typically, a plurality of pusher bodies and their corresponding tracks are arranged in a side by side manner along the shelf. Each pusher body and its corresponding track are separated by dividers to maintain a plurality of generally straight rows of merchandise that run from the front to the back of the shelf. Such a familiar configuration can be found in many retail stores for selling hygiene items such as deodorant, as one example.

In another configuration, the pusher system may be embodied as a stand-alone pusher tray. These trays may include means for mounting the tray as a cantilevered extension from another structure, such as a bar. These trays may also be situated directly on a retail shelf. Further, these trays may include side barriers which are adjustable so as to accommodate merchandise of differing widths. Examples of these trays may be readily seen at U.S. Pat. Nos. 9,254,049, 9,241,583, 8,720,702, each of which is incorporated by reference herein in its entirety.

BRIEF SUMMARY OF THE INVENTION

The invention relates to improvements in the retail merchandise tray assemblies, such as pusher trays. These and other advantages of the invention, as well as additional inventive features, will be apparent from the description of the invention provided herein. It is noted that some of the features will have applicability in retail merchandise tray assemblies that do not include pushers.

In one embodiment, a retail merchandise tray assembly is provided. The tray assembly includes a wire support structure, a front stop hinge, a front stop and a biasing member. The wire support structure includes at least one longitudinal member extending between a first end and a second end along a first longitudinal axis and at least one lateral member attached to and extending generally perpendicular to the at least one longitudinal member and the first longitudinal axis. The first front stop hinge is rotatably mounted on the at least one lateral member for rotation about the at least one lateral member between a first angular position and a second angular position. The front stop is mounted to the front stop hinge for rotation with the front stop hinge about the at least one lateral member between the first and second angular positions. In the first angular position, the front stop is in an upright orientation relative to the wire support structure. In the second angular position, the front stop is in a reclined orientation relative to the wire support structure. The biasing member biases the front stop hinge from the second angular position toward the first angular position.

In one embodiment, the wire support structure defines a substantially planar product support plane. The front stop has a front surface. The front surface of the front stop is more parallel to the planar product support plane when the front stop hinge is in the second angular position than when the front stop hinge is in the first angular position. This allows for improved loading of the tray assembly of product when the front stop hinge is in the second angular position.

In one embodiment, the biasing member is a torsion spring extending angularly about the at least one lateral member.

In one embodiment, the front stop is releasably mounted to the front stop hinge such that the front stop can be removed from the front stop hinge without the front stop hinge being removed from the at least one lateral member of the wire support structure.

In one embodiment, the front stop includes a mounting slot. The front stop hinge includes an axially extending mounting pin slidably received in the mounting slot for releasably mounting the front stop to the front stop hinge.

In one embodiment, the front stop includes a flexible mounting clip extending from a first end attached to the front stop and a free end. The free end of the flexible mounting clip is biased into the at least one lateral member when the mounting pin is received in the mounting slot to secure the front stop to the front stop hinge.

In one embodiment, the flexible mounting clip can be resiliently bent such that the free end is disengaged from the at least one lateral member to remove the front stop from the front stop hinge.

In one embodiment, the tray assembly includes at least one pair of opposed load bearing members. The wire support structure is mounted to the pair of opposed load bearing members. The front stop hinge includes a rotation limiting abutment that engages at least one of the opposed load bearing members or the wire support structure when the front stop hinge is in the first angular position. The biasing member and the engagement of the rotation limiting abutment with at least one of the opposed load bearing members or the wire support structure fixing the front stop hinge in the first angular position. The biasing member biases the front stop hinge into the at least one of the opposed load bearing members or the wire support structure.

In one embodiment, a first end of the torsion spring is engaged with the at least one lateral member such that the first end cannot rotate about the at least one lateral member. A second end of the torsion spring is engaged with front stop hinge such that it rotates with the front stop hinge around the at least one lateral member.

In one embodiment, at least one of the mounting slot and the mounting pin is tapered such increased insertion of the pin into the mounting slot increases frictional engagement between the mounting slot and the mounting pin.

In one embodiment, the tray assembly includes a second front stop hinge rotatably mounted to the wire support structure. The first and second front stop hinges rotating about a common rotational axis. The first and second front stop hinges are laterally spaced apart along the rotational axis. The rotational axis is generally perpendicular to the first longitudinal axis.

In one embodiment, the first front stop hinge is mounted proximate the first end of the at least one longitudinal member. A top of the front stop rotates towards the second end of the at least one longitudinal member when the first front stop hinge rotates from the first angular position to the second angular position.

Additionally, the top rotates towards the wire support structure when the front stop hinge rotates from the first angular position to the second angular position.

In another embodiment, a method of loading a retail merchandise tray assembly is provided. The method includes pivoting a front stop of the retail merchandise tray assembly between a first orientation to a second orientation. The retail merchandise tray assembly includes a wire support structure that includes at least one longitudinal member extending between a first end and a second end along a first longitudinal axis and at least one lateral member attached to and extending generally perpendicular to the at least one longitudinal member and the first longitudinal axis The retail merchandise tray assembly further includes a first front stop hinge rotatably mounted on the at least one lateral member for rotation about the at least one lateral member between a first angular position corresponding to the first orientation of the front stop and a second angular position corresponding to the second orientation of the front stop. The retail merchandise tray assembly further includes a biasing member acting on the first front stop hinge. The front stop is mounted to the front stop hinge for rotation with the front stop hinge about the at least one lateral member between the first and second angular positions. In the first angular position, the front stop extends upward relative to the wire support structure a greater extent than when in the second angular position. The method further including biasing the front stop hinge from the first angular position toward the first angular position such that the front stop is biased towards the first orientation.

In one method, pivoting the front stop transitions the front stop from a substantially perpendicular orientation relative to a top surface defined by the wire support structure to a substantially parallel orientation relative to the top surface defined by the wire support structure.

Substantially parallel and substantially perpendicular shall be less than or equal to plus or minus fifteen degrees.

In an embodiment, a retail merchandise tray assembly including a merchandise support frame, a divider, a longitudinally divider mount and a resilient friction member is provided. The merchandise support frame extends between a first end and a second end and having opposed first and second sides. A longitudinally extending divider mount is slidably mounted to the merchandise support frame for adjusting a position of the divider relative to the first side of the merchandise support frame. The resilient friction member is mounted to the merchandise support frame and engages the divider mount. The diver mount is slidable relative to the resilient friction member when adjusting the position of the divider relative to the first side of the merchandise support frame.

In one embodiment, the resilient friction member is an O-ring and the divider mount includes a longitudinally extending cylindrical rod. An inner diameter of the O-ring is smaller than the outer diameter of the cylindrical rod such that insertion of the cylindrical rod into the O-ring causes stretching of the O-ring to provide frictional engagement between the O-ring and the cylindrical rod.

In one embodiment, the merchandise support frame includes a wire support structure defining a product support surface. The merchandise support frame includes a pair of opposed spaced apart load bearing members. The wire support structure is operably mounted to the load bearing members. A spacer is interposed between the pair of load bearing members. The resilient friction member is mounted to the spacer.

In one embodiment, the divider mount extends through the spacer.

In one embodiment, the resilient friction member is an O-ring. The divider mount includes a longitudinally extending cylindrical rod. The inner diameter of the O-ring is smaller than the outer diameter of the cylindrical rod such that insertion of the cylindrical rod into the O-ring causes stretching of the O-ring to provide frictional engagement between the O-ring and the cylindrical rod.

In one embodiment, the spacer defines a cylindrical tube. The O-ring aligns with the cylindrical tube. The cylindrical rod slides within the cylindrical tube.

In an embodiment, a retail merchandise tray assembly including a merchandise support frame, a divider, a sign adaptor and a sign is provided. The merchandise support frame extends between a first end and a second end and having opposed first and second sides. The divider adjustably mounts to the merchandise support frame for adjusting a position of the divider relative to the first side of the merchandise support frame. The sign adaptor mounts to the divider and moves with the divider when the position of the divider relative to the first side of the merchandise support frame is adjusted. The sign is attached to the sign adaptor.

In one embodiment, the sign adaptor is attached to the divider in at least two attachment locations to prevent rotation of the sign adaptor relative to the divider.

In one embodiment, a divider mount adjustably attaches the divider to the merchandise support frame. The sign adaptor is attached to the divider mount providing one of the at least two attachment locations.

In one embodiment, the sign adaptor includes a c-shaped snap connector that snap engages the merchandise support frame.

In one embodiment, the sign adaptor is attached to the divider with a resilient push pin extending into an aperture in the divider providing a second one of the at least two attachment locations.

In one embodiment, the tray assembly includes a second divider adjustably mounted to the merchandise support frame. The second divider is adjustably positionable relative to the second side of the merchandise support frame. The merchandise support frame being interposed between the first and second dividers. A second divider mount extends between opposed first end and second ends. The second divider mount adjustably attaches the second divider to the merchandise support frame. The second divider being attached to a first end of the second divider mount. The sign adaptor includes a cavity that receives the second end of the second divider mount when the second divider is positioned at a closest most position relative to the second side.

In one embodiment, the sign adaptor includes a sign attachment arrangement including spaced apart first and second sidewall defining a channel therebetween. The first and second sidewalls are attached to one another proximate adjacent sides. The sign is captured, at least in part, within the channel and between the first and second sidewalls.

In one embodiment, the first sidewall includes a nib extending from an inner face thereof towards the second sidewall.

In one embodiment, the first sidewall includes a nib extending from an inner face thereof. The second sidewall includes a cavity in the inner face thereof. The nib extends into the cavity of the second sidewall when the first and second sidewalls are in a relaxed state.

In one embodiment, the sign has a nib receiving region that engages the nib when the sign is positioned within the channel defined by the first and second sidewalls.

In one embodiment, the channel is closed on only a bottom thereof where the first and second sidewalls are attached to one another such that the channel is open on opposite ends thereof as well as open in a side that extends between the open opposite ends.

In an embodiment, a method of mounting a sign in a retail merchandise tray assembly includes providing the retail merchandise tray assembly. The retail merchandise tray assembly includes a merchandise support frame extending between a first end and a second end and having opposed first and second sides. The tray assembly includes a divider adjustably mounted to the merchandise support frame for adjusting a position of the divider relative to the first side of the merchandise support frame. The tray assembly includes a sign adaptor mounted to the divider and being movable with the divider when the position of the divider relative to the first side of the merchandise support frame is adjusted. The method includes attaching the sign to the sign adaptor mount.

In one embodiment, the method includes adjusting a position of the sign relative to the merchandise support frame by adjusting the position of the divider relative to the merchandise support frame.

In one embodiment, a retail merchandise tray assembly includes a merchandise support frame, a divider, and a longitudinally extending divider mount. The merchandise support frame extends between a first end and a second end and has opposed first and second sides. The divider includes a divider body and a mounting socket. The longitudinally extending divider mount press fit engages within the mounting socket of the divider. The divider mount is slidably mounted to the merchandise support frame for adjusting a position of the divider relative to the first side of the merchandise support frame.

In one embodiment, an outer surface of a portion of the divider mount that is press fit within the mounting socket has a knurled outer surface that engages an inner surface of the mounting socket.

In one embodiment, the divider body and mounting socket are formed from a continuous piece of material.

In one embodiment, the divider body and mounting socket are formed from plastic.

In one embodiment, the mounting socket is provided by a press nut that is mounted within an aperture formed in the divider body. The press nut has an enlarged head portion and a cylindrical body defining a central cavity in which the divider mount is press fit. The cylindrical body has a smaller outer dimension than a dimension of the head portion.

In an embodiment, a retail merchandise tray divider assembly including a divider body, a mounting socket and a divider mount is provided. The divider body includes an outer surface and an inner surface. The outer surface is powder coated. The mounting socket is attached to the divider body at least in part adjacent to the inner surface of the divider body. The divider mount has a first end inserted into the mounting socket and having an opposed free second end. The divider mount is unpainted (e.g. not powder coated or otherwise painted).

In one embodiment, the divider mount is zinc plated.

In one embodiment, a divider support defines a receiving cavity receiving the second end within the receiving cavity.

In one embodiment, the divider support includes a friction member frictionally engaging the outer periphery of the divider mount.

In one embodiment, the mounting socket is a press nut extending through an aperture in the divider body.

In an embodiment, a method of assembling a retail merchandise tray divider is provided. The method includes providing a divider body including an outer surface and an inner surface. The method includes painting the outer surface of the divider body. The method includes providing a mounting socket attached to the divider body and being, at least in part, adjacent to the inner surface of the divider body. The method includes inserting a first end of a divider mount into the mounting socket and having an opposed free second end. The divider mount is unpainted.

In one method, providing the mounting socket includes inserting a press nut through an aperture formed in the divider body.

In one method, the step of painting is provided by powder coating. The step of painting occurs after the step of inserting the press nut through the aperture.

In one method, the divider mount is zinc plated.

In one method, the method includes inserting the second free end of the divider mount into a receiving cavity of a divider support.

In one method, the step of inserting the second free end includes engaging an outer periphery of the divider mount with a friction member to provide a sliding frictional engagement therebetween.

In an embodiment, a retail merchandise tray assembly includes a merchandise support frame, a front stop, and a sign holder. The merchandise support frame extends between a first end and a second end. The front stop is mounted to the merchandise support frame proximate the first end. The sign holder is releasably secured to the front stop. The sign holder has a sign mounting channel.

In one embodiment, a sign flag is mounted in the sign holder. The sign flag has a mounting portion and a flag portion extending substantially orthogonal to the mounting portion. The mounting portion is removably mounted in the sign holder. The flag portion is external to the sign holder and generally orthogonal to a front face of the front stop.

In one embodiment, the sign flag is slidably mounted within the sign mounting channel in a lateral direction generally parallel to a front face of the front stop.

In one embodiment, the flag portion and mounting portion are formed as a continuous component having a fold connecting the flag portion to the mounting portion.

In one embodiment, the sign holder includes a front panel, a rear panel and a channel formed therebetween. A mounting channel is formed behind the rear panel. The mounting portion of the sign flag is received in the mounting channel with the rear panel of the sign holder interposed between the mounting portion of the sign flag and the front panel of the sign holder.

In one embodiment, a framing sign is provided. The framing sign has a mounting portion and a framing portion that surrounds the mounting portion. The mounting portion and framing portion are substantially coplanar when mounted to the sign holder. The framing portion surrounds the sign holder when the framing sign is mounted to the sign holder.

In one embodiment, the mounting portion could be formed by a U-shaped slit formed into the material forming the framing sign.

In one embodiment, the front stop has a front surface that is generally planar. The framing portion is generally parallel to the front surface, when mounted.

In one embodiment, the front stop has a front surface that is generally planar, the framing portion being generally covering the front surface, when mounted.

In an embodiment, a retail merchandise tray assembly including a merchandise support frame, a divider support, a front stop, at least one divider and an accessory attachment clip is provided. The merchandise support frame extends between a first end and a second end. The front stop is mounted proximate the first end of the merchandise support frame. The at least one divider is slidably mounted to the divider support for adjustment of a position of the divider relative to the merchandise support frame. The accessory attachment clip is releasably clipped to a bottom side of the divider support. The accessory attachment clip has an accessory mount positioned forward of the divider support and lower than a bottom edge of the front stop.

In one embodiment, the accessory mount defines a channel for holding an accessary. The channel has a downward directed mouth.

In one embodiment, a light strip is mounted within the channel. Light generated by the light strip extends through the mount of the channel.

In one embodiment, a light strip or an electronic label is mounted to the accessory attachment clip.

In one embodiment, the accessory attachment clip includes a main body with a pair of spaced attachment legs extending upward from a top side thereof. The attachment legs snap attaching the accessory attachment clip to the divider support with the main body being positioned below the divider support.

In another embodiment, a retail merchandise tray assembly including a product support frame and a first front stop hinge is provided. The product support frame extends longitudinally between a first frame end and a second frame end parallel to a first longitudinal axis. The product support frame defines a product support surface. The product support frame includes a first load bearing member and a first lateral member. The first load bearing member extends longitudinally between a first end and a second end parallel to the first longitudinal axis. The first load bearing member has a first end portion proximate the first frame end. A top of the first end portion is more proximate the product support surface than a bottom of the first end portion. The top of the first end portion is spaced away from the product support surface. The first lateral member is operably attached to the load bearing member. The first lateral member extends perpendicular to the first longitudinal axis along a second longitudinal axis. The first lateral member is proximate the first frame end and is positioned offset from the top of the first end portion toward the product support surface with the first lateral member being positioned between the top of the first end portion and the product support surface. The first front stop hinge is rotatably mounted on the first lateral member for rotation about the first lateral member between a first angular position and a second angular position. The first front stop hinge is axially slidable along the first lateral member parallel to the second axis to remove and to mount the first front stop hinge relative to the first lateral member.

The mounting of the first fronts top hinge can be done without manipulating a positioning of the first load bearing member relative to the lateral member.

The load bearing member prevents removal of the front stop hinge when the first front stop hinge is in the first angular position.

Further, when mounted, the first front stop hinge is positioned in board of the first load bearing member.

In one example, the first load bearing member has a first height being orthogonal to the product support surface and measured between a top and a bottom of the first end portion.

In one example, the first lateral member is a first wire of a wire support structure. The wire support structure further including a first longitudinal member in the form of a second wire extending from a first end attached to the first lateral member and a second end proximate the second frame end.

In one example, the first front stop hinge is positioned laterally between the load bearing member and the first longitudinal member when it is mounted to the lateral member.

In one example, the first lateral member is operably attached to the load bearing member in a fixed position.

In one example, the first front stop hinge is removable from and mountable to the first lateral member when the first lateral member is in an operational position relative to the load bearing member. The operational position is when product may be supported on the product support surface. In other words, the user need not move the lateral member relative to the load bearing member to allow for mounting or removing the first front stop hinge.

In one example, a front stop is mounted to the first front stop hinge for rotation with the first front stop hinge about the first lateral member between the first and second angular positions. In the first angular position, the front stop is in an upright orientation relative to the product support surface. In the second angular position, the front stop is in a reclined orientation relative to the product support surface.

In one example, the first front stop hinge is removable from and mountable to the first lateral member when the first front stop hinge is in the second angular position. The first front stop hinge is not removable from or mountable to the first lateral member when the first front stop hinge is in the first angular position.

This is due to interference between the load bearing member and the first front stop hinge when the first front stop hinge is in the first angular position.

In one example, the first load bearing member interferes with the first front stop hinge when the first front stop hinge is in the first angular position to prevent removal from or mounting to the first lateral member by the first front stop hinge.

In one example, the first load bearing member includes an intermediate portion having a second height being orthogonal to the product support surface and measured between a top and a bottom of the intermediate portion. The top of the intermediate portion is more proximate the product support surface than the bottom. The top of the first end portion is spaced farther away from the product support surface than the top of the intermediate portion.

In one example, the first height is less than the second height.

In one example, a portion of the top of the first end portion is tapered such that the height of the first end portion increases when moving from the first end towards the second end.

In one example, the top of the first end portion includes an arcuate region providing a relief through which the first front stop hinge passes when the first front stop hinge is mounted to or removed from the first lateral member. The relief is formed between the first end portion and the lateral member.

In one example, the first front stop hinge has a mounting collar and a mounting pin, the mounting collar defines a mounting aperture through which the lateral member extends when the first front stop hinge is mounted and the mounting pin extends axially from the mounting collar.

In one example, the mounting pin extends along a mounting pin axis. The mounting pin axis is offset from and generally orthogonal to a central axis of the mounting collar.

In one example, the first front stop hinge includes an axially extending mounting pin defining a mounting pin axis, in the first angular position the mounting pin axis is generally orthogonal to the product support surface and in the second angular position the mounting pin axis is closer to parallel to the product support surface than in the first angular position.

In one example, rotation of the first front stop hinge from the first angular position to the second angular position is greater than 90 degrees.

In one example, the first front stop hinge includes an axially extending mounting pin having a tip. In the first angular position, the tip of the first front stop hinge is on a first side of the product support surface. In the second angular position, the tip of the first front stop hinge is on a second side of the product support surface, opposite the first side. The first lateral member is on the second side of the product support surface.

In one example, the first front stop hinge includes an axially extending mounting pin. In the first angular position, the mounting pin extends generally orthogonal to the product support surface. In the second angular position, the mounting pin extends in a non-perpendicular orientation relative to the product support surface and extends towards the second frame end.

In one example, the longitudinal member includes an end portion that is attached to the first lateral member, an intermediate portion position closer to the second end than the end portion, and a transition portion that connects the end portion to the intermediate portion. The transition portion extends non-parallel to the first longitudinal axis such that the end portion is laterally offset from the intermediate portion parallel to the second longitudinal axis.

In one example, the intermediate portion, end portion and transition portion of the longitudinal member being formed by a single continuous piece of material.

In one example, a second front stop hinge is included and is laterally spaced apart from the first front stop hinge. The second front stop hinge is rotatably mountable on the first lateral member for rotation about the first lateral member between a first angular position and a second angular position. The first and second angular positions of the second front stop hinge corresponding to the first and second angular positions of the first front stop hinge. A front stop is attached to the first and second front stop hinges.

In one example, the front stop is removably attached to the first and second front stop hinges.

In one example, at least one first longitudinal member extends from a first end attached to the first lateral member and a second end proximate the second frame end. The first end of the first longitudinal member is positioned between the first and second front stop hinges. The first lateral member extends between first and second ends along the second longitudinal axis. The at least one first longitudinal member is attached between the first and second ends separating the first lateral member into a first portion between the first end and the first longitudinal member and a second portion between the second end and the second longitudinal member. The first front stop hinge mounts to the first portion. Notably, multiple longitudinal members may be located between the first and second portions of the longitudinal members. This configuration shall be included in the situation outlined previously. The second front stop hinge is mounted to the second portion. The first longitudinal member prevents the first front stop hinge from being removed from the first lateral member at the second portion. The first longitudinal member prevents the second front stop hinge from being removed from the first lateral member at the first portion.

In one example, a second load bearing member is laterally spaced from the first load bearing member a first distance measured parallel to the second longitudinal axis. The first lateral member extends between first and second ends a first length parallel to the second longitudinal axis. The first length being greater than the first distance. The first lateral end being positioned proximate the first end portion of the first load bearing member and extending laterally outward beyond an inner surface of the first load bearing member. The second lateral is being positioned proximate a first end portion of the second load bearing member and extends laterally outward beyond an inner surface of the second load bearing member.

In one example, a gap is formed between the first end portion of the first load bearing member and the first lateral member. The first front stop hinge has a main body defining a mounting aperture. The main body has a first portion sized to abut the first lateral member when the first front stop hinge is in the first angular position preventing removal of the first front stop hinge from the first lateral member. The main body has a second portion sized to pass through the gap when the first front stop hinge is in the second angular position permitting removal of the first front stop hinge from the first lateral member.

In one example, the front stop hinge includes a rotation limiting abutment that engages the first load bearing when the first front stop hinge is in the first angular position limiting the angular rotation of the first front stop away from the second angular position.

In one example, the first lateral member does not extend through either the first or second load bearing member.

In another example, a method of assembling a retail merchandise tray as outlined above is provided. With the first lateral member in an operational position relative to the load bearing member, the method includes installing the first front stop hinge on the first lateral member.

In one example, during the step of installing the front stop hinge, the first lateral member is operably attached to the load bearing member in a fixed position.

In one example, the method includes mounting a front stop to the first front stop hinge for rotation with the first front stop hinge about the first lateral member between the first and second angular positions. In the first angular position, the front stop is in an upright orientation relative to the product support surface. In the second angular position, the front stop is in a reclined orientation relative to the product support surface.

In one example, the first front stop hinge is removable from and mountable to the first lateral member when the first front stop hinge is in the second angular position. The first front stop hinge is not removable from or mountable to the first lateral member when the first front stop hinge is in the first angular position.

In one example, the method includes preventing removal of the first front stop hinge with the first load bearing member when the first front stop hinge is in the first angular position.

In one example, the top of the first end portion is tapered such that the height of the first end portion increases when moving from the first end towards the second end.

In one example, installing the first front stop hinge includes passing the first front stop hinge through a relief provided by an arcuate region formed in the top of the first end portion when the first front stop hinge is mounted to the first lateral member.

In one example, the first front stop hinge has a mounting collar and a mounting pin. The mounting collar defines a mounting aperture and the mounting pin extends axially from the mounting collar. The step of installing includes inserting the first lateral member through the mounting aperture while the first lateral member is in an operational position relative to the first load bearing member.

In one example, the first longitudinal member includes an end portion that is attached to the first lateral member, an intermediate portion position closer to the second end than the end portion, and a transition portion that connects the end portion to the intermediate portion, the transition portion extending non-parallel to the first longitudinal axis such that the end portion is laterally offset from the intermediate portion parallel to the second longitudinal axis.

In one example, the intermediate portion, end portion and transition portion of the longitudinal member are formed by a single continuous piece of material.

In one example, the method includes installing a second front stop hinge on the first lateral member in laterally spaced apart relation to the first front stop hinge. The second front stop hinge has a mounting aperture rotatably mounting the second front stop hinge on the first lateral member for rotation about the first lateral member between a first angular position and a second angular position. The first and second angular positions of the second front stop hinge correspond to the first and second angular positions of the first front stop hinge. The second front stop hinge is mounted to the first lateral member from an opposite end of the first lateral member as the first front stop hinge. The method includes attaching a front stop to the first and second front stop hinges.

In one example, the front stop is removably attached to the first and second front stop hinges.

In one example, a second load bearing member is laterally spaced from the first load bearing member a first distance measured parallel to the second longitudinal axis. The first lateral member extends between first and second ends a first length parallel to the second longitudinal axis. The first length is greater than the first distance. The first lateral end is positioned proximate the first end portion of the first load bearing member and extends laterally outward beyond an inner surface of the first load bearing member. The second lateral end is positioned proximate a first end portion of the second load bearing member and extends laterally outward beyond an inner surface of the second load bearing member.

In one example, a gap is formed between the first end portion of the first load bearing member and the first lateral member. The first front stop has a first portion sized to abut the first lateral member when the first front stop hinge is in the first angular position preventing removal of the first front stop hinge from the first lateral member. T first front stop hinge has a second portion sized to pass through the gap when the first front stop hinge is in the second angular position permitting removal of the first front stop hinge from the first lateral member. The step of installing includes orienting the second portion with the gap and then sliding the first front stop hinge onto the first lateral member.

In one example, the front stop hinge includes a rotation limiting abutment that engages the first load bearing when the first front stop hinge is in the first angular position limiting the angular rotation of the first front stop away from the second angular position.

In another example, a retail merchandise tray assembly including a product support frame and a front stop hinge is provided. The product support frame extends longitudinally between a first frame end and a second frame end parallel to a first longitudinal axis. The product support frame defines a product support surface. The product support frame includes a first longitudinal member extending generally parallel to the first longitudinal axis. The first longitudinal member has a first end portion having a top facing the product support surface and being spaced away from the product support surface. The product support frame includes a first lateral member operably attached to the first longitudinal member. The first lateral member extending perpendicular to the first longitudinal axis along a second longitudinal axis. The first lateral member is proximate the first end portion. The first lateral member is offset from the top of the first end portion toward the product support surface with the first lateral member being positioned between the top of the first end portion and the product support surface. The first front stop hinge is rotatably mounted to the first lateral member for rotation about the first lateral member between a first angular position and a second angular position. The first front stop hinge has a blocking portion. When the first front stop hinge is in the first angular position, the blocking portion aligns with the longitudinal member such that the longitudinal member and blocking portion abut when axially moving the first front stop hinge parallel to the second axis preventing removal or mounting of the first front stop hinge relative to the first lateral member. When the first front stop hinge is in the second angular position, the blocking portion does not align with the longitudinal member such that the alignment member and the blocking portion do not abut when axially moving the first front stop hinge parallel to the second axis allowing removal or mounting of the first front stop hinge relative to the first lateral member.

In one example, the longitudinal member and the lateral member form a gap therebetween. The blocking member is sized to extend across the gap when the first front stop hinge is in the first angular position.

In one example, the first front stop hinge has a mounting collar that extends around at least a part of the first lateral member when mounted to the first lateral member. The mounting collar has a portion that aligns with the gap and is sized to pass through the gap when the first front stop hinge is in the second angular position.

In one example, the longitudinal member and the lateral member form a gap therebetween. The first front stop hinge is sized and configured to prevent passage of the first front stop hinge through the gap when in the first angular position to prevent removal of the first front stop hinge from the lateral member. The first front stop hinge is sized and configured to allow passage of the first front stop hinge through the gap when in the second angular position to allow mounting or removing the first front stop hinge from the lateral member.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now FIGS. 1-4, an embodiment of a retail merchandise tray assembly 100 (also referred to as a "tray") is illustrated.

Figure 4:
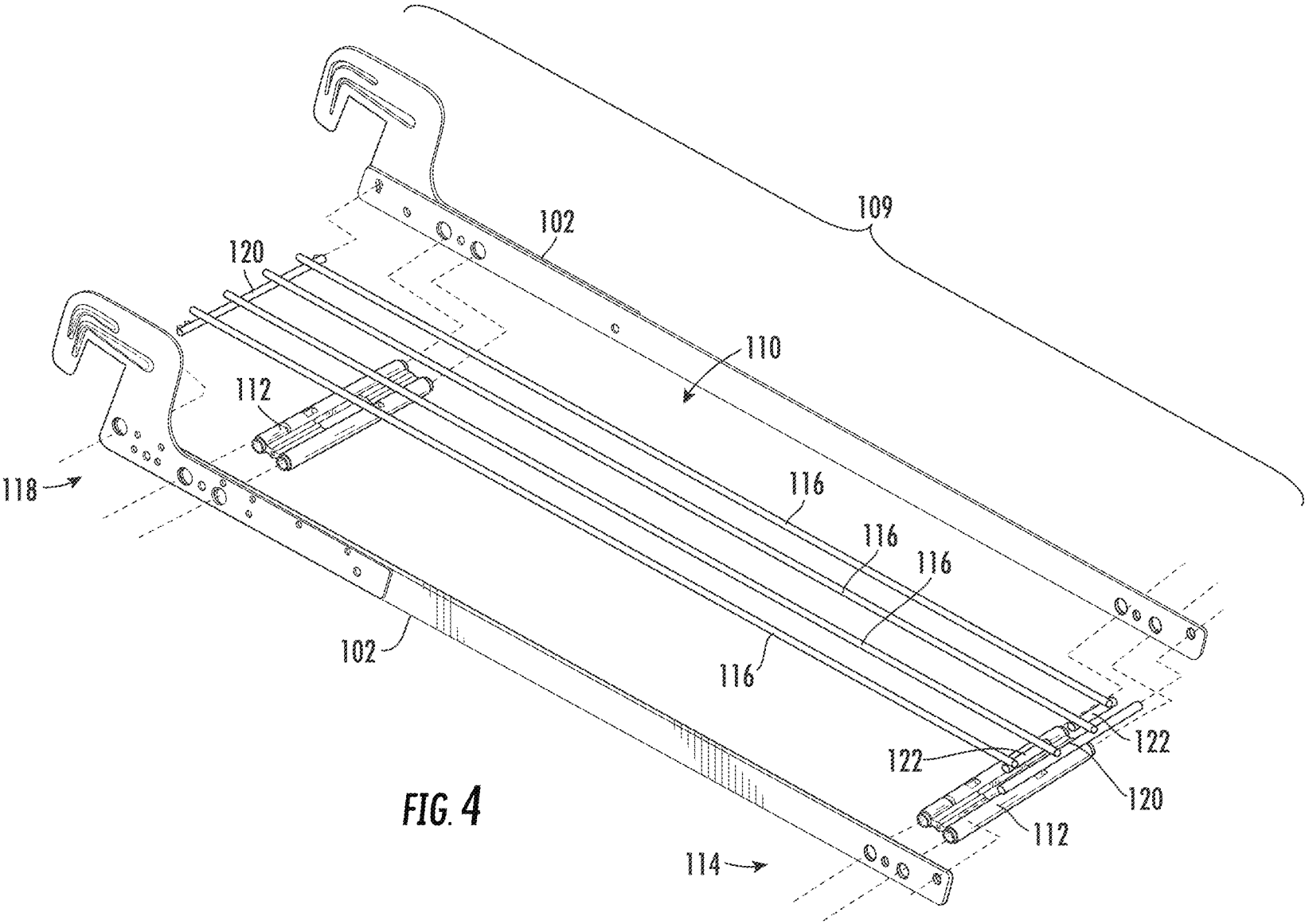
FIG. 4 is an exploded top perspective view of a merchandise support frame of the retail merchandise tray assembly of FIG. 1.

With particular reference to FIG. 4, the tray 100 includes a merchandise support frame 109 that defines a merchandise support surface, which is typically planar, upon which merchandise to be displayed is supported. In the illustrated embodiment, the merchandise support frame 109 includes a pair of load bearing members 102, a wire support structure 110 and spacers 112.

The wire support structure 110 typically defines the merchandise support surface. The wire support structure 110 will typically be removably mounted to the load bearing members 102 and spacers 112 in an orientation such that the merchandise support surface is vertically above the load bearing members 102 and spacers 112.

The wire support structure 110 will typically be formed by one or more, typically a plurality of laterally spaced, longitudinal members 116 extending from a first end 114 to a second end 118 of the tray 100 along a longitudinal axis.

The wire support structure 110 of this embodiment includes a plurality of lateral members 120 and 122. The lateral members 120, 122 interconnect various ones or all of the longitudinal members 116. In the illustrated embodiment, the lateral members 120, 122 extend generally perpendicular to longitudinal members 116. Typically, the lateral members 120, 122 are welded to the longitudinal members 116. However, in other embodiments, a single co-molded structure could provide the longitudinal and lateral members 116, 120, 122. Further, in other examples, the merchandise support frame 109 could be formed from a single continuous piece of material.

The various components of the support frame 109 could be formed from metal or plastic or a suitable combination of metal and plastic.

Lateral members 120 are positioned at opposite ends 114, 118 of the wire support structure 110 and typically extend the entire width of the wire support structure 110. Lateral members 122 are shorter than lateral members 120 and extend less than the entire width of the wire support structure 110 and interconnect less than all of the longitudinal members 116.

The spacers 112 are interposed between and maintain the lateral spacing of the load bearing members 102. The spacers are typically connected to the load bearing members 102 by screws or other fasteners to create a unitary frame structure out of the spacers 112 and load bearing members 102.

The free ends of lateral members 120 extend into cavities in the form of apertures or recesses formed into the load bearing members 102 to removably attach the wire support structure 110 to the load bearing members 102. As used herein, "removably attached" means an attachment which may be readily undone in a non-destructive manner and subsequently repeated in the same manner. Within this meaning "removably attached" does not include welds, comolding, or other permanent forms of attachment which require component destruction or damage to undo.

While typically formed from metal, the wire support structure 110 and load bearing members 102 can be formed from plastic. The spacers 112 are typically formed from plastic.

The tray 100 may be configured to be mounted onto a shelf or in a cantilevered orientation relative to a retail merchandise bar of the type typically found in refrigerated cases or other retail merchandise displays. In this embodiment, the load bearing members 102 include cut-outs 119 sized to receive a retail merchandise bar for the cantilevered mounting configuration.

Figure 1:
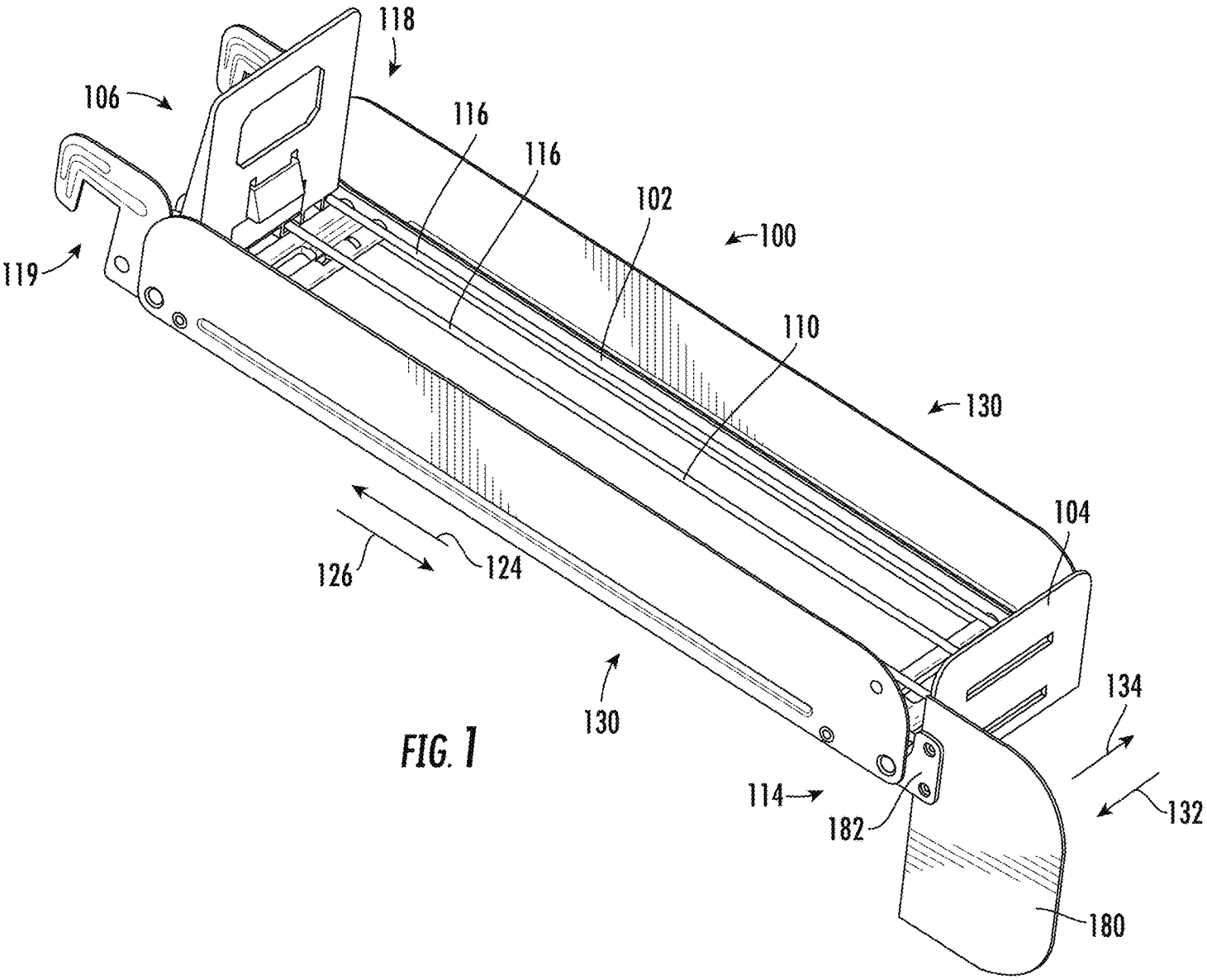
FIGS. 1 and 2 area top perspective views of an embodiment of a retail merchandise tray assembly.
Figure 2:
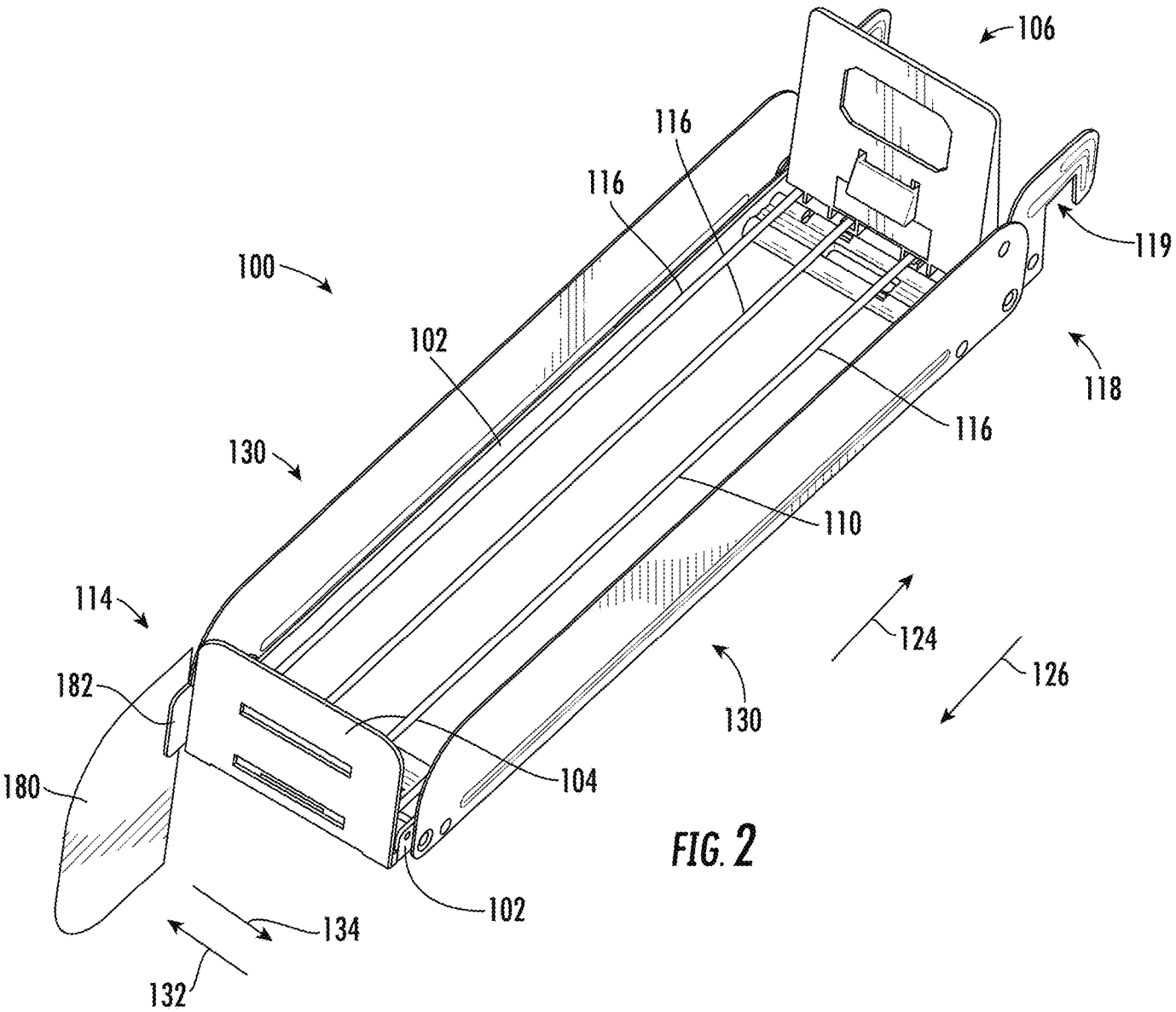
Figure 3:
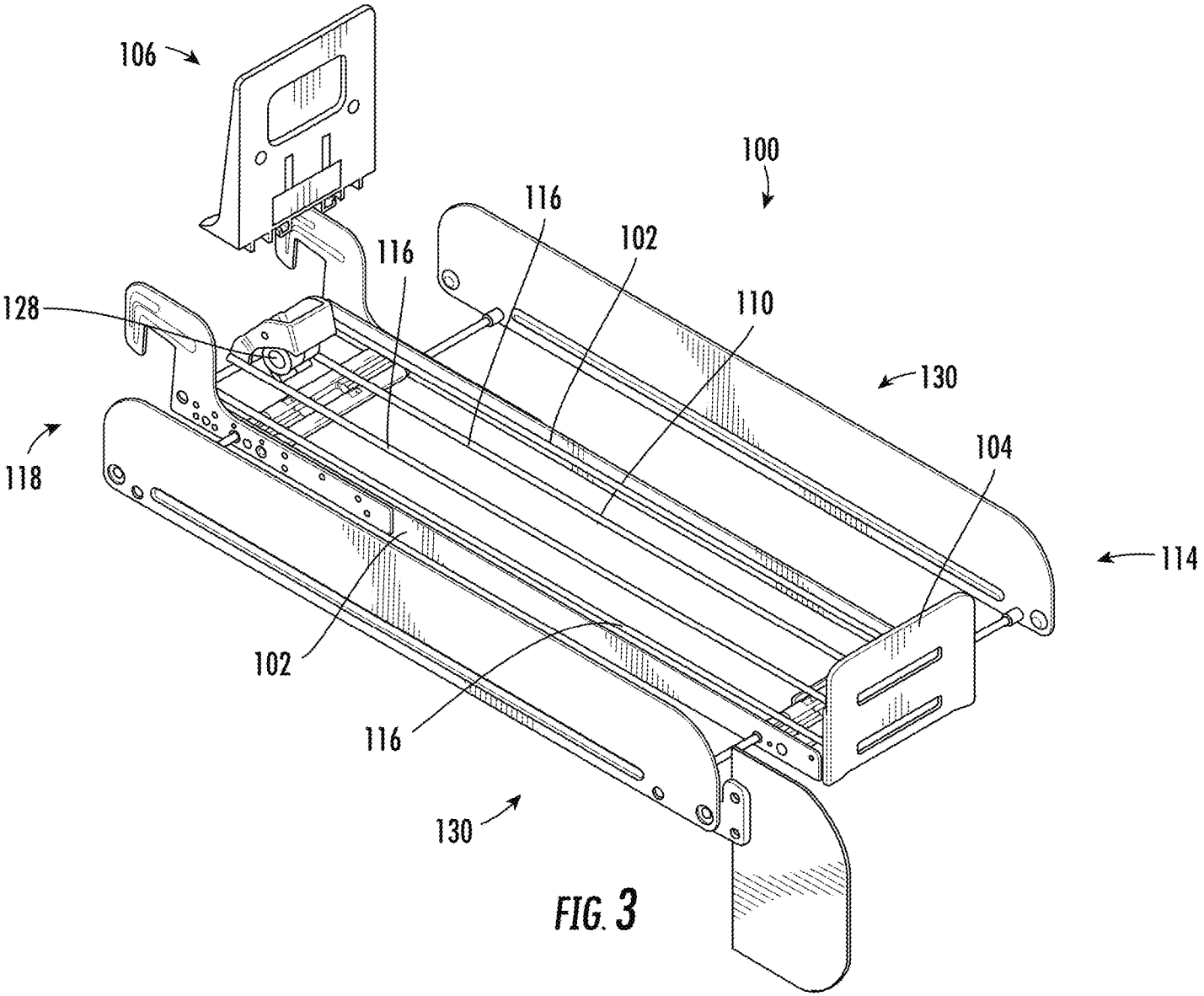
FIG. 3 is a partially exploded top perspective view of the retail merchandise tray assembly of FIG. 1.

With reference to FIG. 1, the tray 100 includes a front stop 104 mounted to the merchandise support frame 109 proximate first end 114 of the tray 100.

A pusher 106 is mounted to the support frame 109 and slideable thereon in directions 124, 126. Pusher 106 is operable to bias a row or rows of retail merchandise situated on top of wire support structure 110 and load bearing members 102 from second end 118 of tray 100 to first end 114 of tray 100. The pusher 106 is biased in the direction of arrow 126 towards the first end 114 of the tray 100 by coil spring 128 or other biasing element as is generally well known.

The front stop 104, when in an upright orientation such as illustrated in FIG. 1, prevents merchandise from being pushed off of the tray by pusher 106.

In some embodiments, the coil spring 128 may be connected to the first end of tray 100 (e.g. the merchandise support frame 109) and increasingly uncoiled the closer the pusher 106 is pushed toward second end 118.

A pair of movable dividers 130 are positioned on either side of tray 100. Divider assemblies 130 are movable in directions 132, 134 to modify a width or distance between the divider assemblies 130. This lateral adjustment allows for accommodating retail merchandise of differing widths.

The dividers extend vertically above the top surface of the wire support structure 110.

The dividers 130 and front stop 104 generally define the storage region in which merchandise is stored and displayed using tray 100. As merchandise is removed from the tray 100, the pusher 106 will push merchandise forward towards front stop 104 and first end 114.

Figure 7:
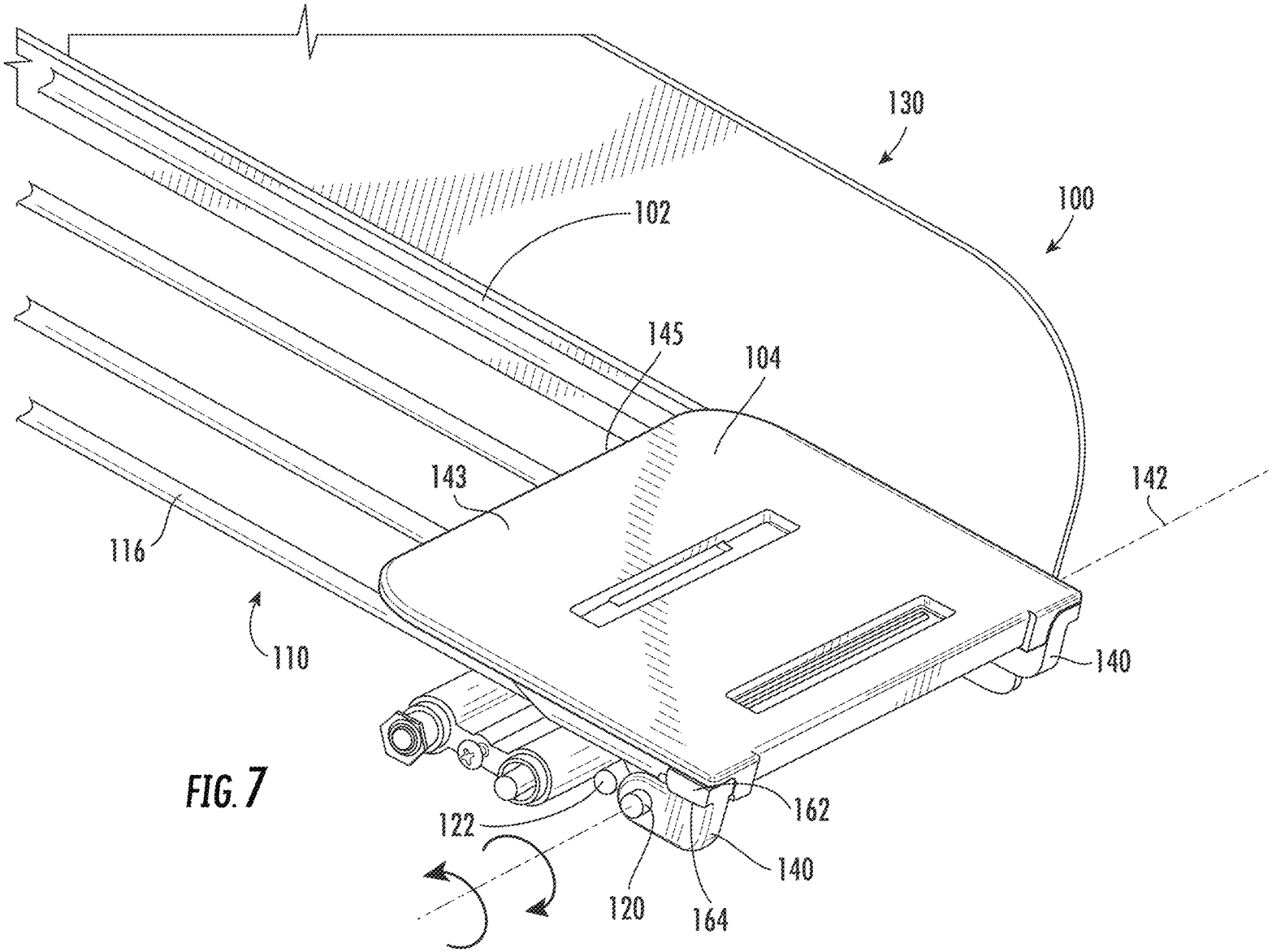
FIG. 7 is a perspective illustration of a front stop of the retail merchandise tray of FIG. 1, with the front stop in a reclined orientation.
Figure 8:
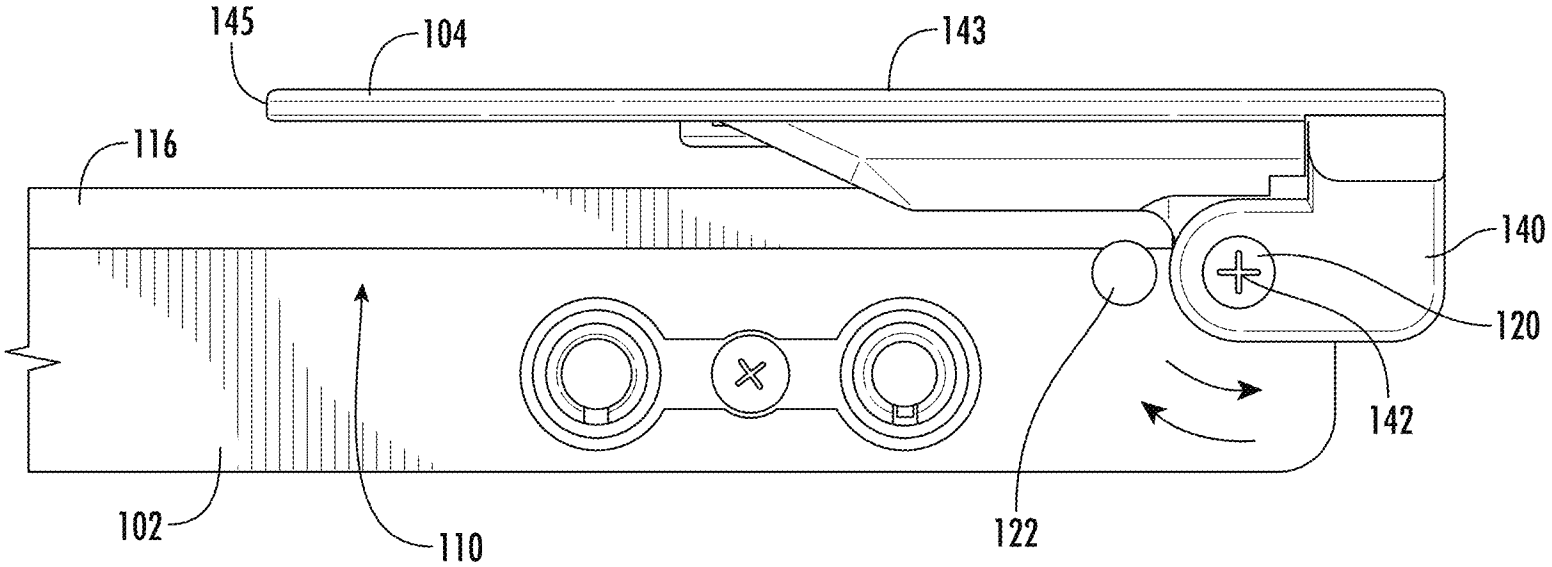
FIG. 8 is a side view of the front stop in the reclined orientation.
Figure 9:
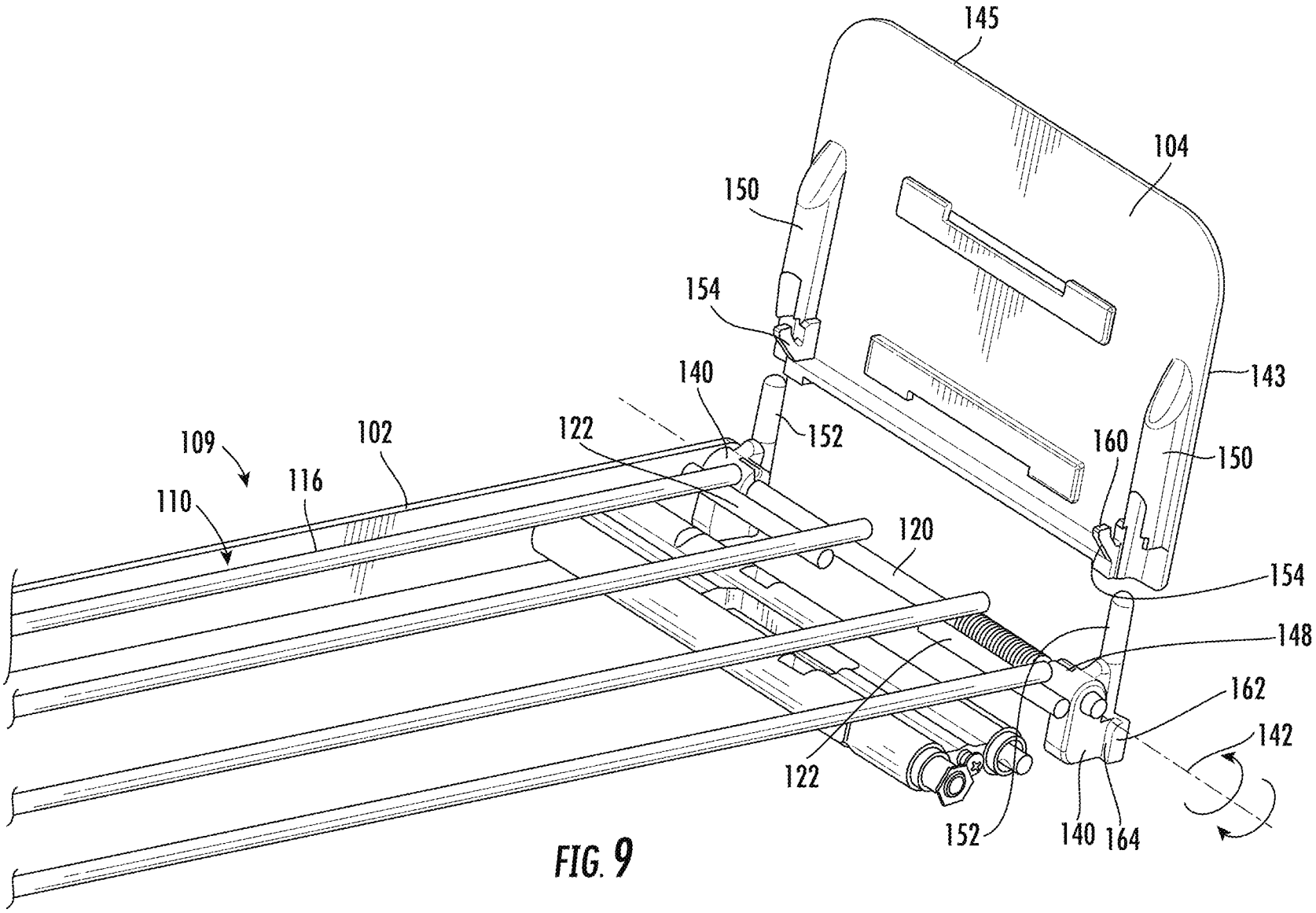
FIGS. 9 and 10 are partial exploded illustrations of the front of the retail merchandise tray assembly of FIG. 1 having the front stop removed from the front stop hinges.

The present embodiment includes a front stop 104 that is operably mounted to allow for pivoting between an upright orientation shown, for example, in FIGS. 1-2 and 5-7 and a reclined orientation shown, for example, in FIGS. 7-8. In the upright orientation, the front stop 104 inhibits removal of merchandise from the tray 100. In the reclined orientation, merchandise may be more easily loaded into the tray 100 from the first end 114 of tray 100.

With reference to FIGS. 5-9, the front stop 104 is mounted to the merchandise support frame 109 and particularly to the wire support structure 110 by a pair of front stop hinges 140. The front stop hinges 140 are mirror images of one another in the illustrated embodiment.

The front stop hinges 140 are mounted to lateral member 120 for rotation about lateral member 120 and particularly axis 142 defined thereby. The front stop hinges 140 rotate between a first angular position that maintains the front stop 104 in the upright orientation and a second angular position that maintains the front stop 104 in the reclined orientation. As such, each front stop 104 rotates about lateral member 120 between the upright and reclined orientations.

The main body of the front stop hinge 140 includes a mounting cavity that receives a free end of lateral member 120. In the illustrated embodiment, the mounting cavity is in the form of a bore that extends entirely through the main body. In other embodiments, the mounting cavity could be a recess.

In the current embodiment, the adjacent bearing member 102 secures the front stop hinge 140 on lateral member 120. In the particular embodiment, the free end of lateral member 120 extends into a correspondence cavity of the bearing member 102. As such, the bearing member 102 is positioned laterally to the side of the front stop hinge 140 such that it cannot be removed from lateral member 120. This locks the front stop hinge 140 to the wire support structure 110 and particularly lateral member 120.

In some embodiments, in the reclined orientation, the front surface 143 of the front stop 104 is substantially parallel to the product support surface defined by wire support structure 110 (e.g. plus or minus 20 degrees). In the upright orientation, the front surface 143 is substantially orthogonal to the product support surface (e.g. plus or minus 20 degrees). At a minimum, when the front stop 104 is rotated rearwards, the top edge 145 of the front stop 104 is closer to the wire support structure 110 than when front stop 104 is in the upright orientation.

When in the upright orientation, the top edge 145 of the front stop 104 extends further above wire support structure than a bottom edge of the front stop 104 extends below the wire support structure. In some embodiments, the front stop need not extend below the wire support structure.

A biasing member 144 illustrated in the form of a torsion spring that extends angularly about lateral member 120 biases the front stop hinge 140 toward the first angular position, e.g. away from the second end 118. Thus, the default angular position is the first angular position such that the front stop 104 is in the upright orientation.

A first end 146 of the biasing member 144 (illustrated in the form of a hook) engages the merchandise support frame 109 and particularly wire support structure 110 and more particularly lateral member 120 to inhibit rotation of that end of the biasing member 144. An opposite end of the biasing member 144 is captured in a slot 146 formed by the front stop hinge 140. This end rotates with the front stop hinge 140 when the front stop hinge 140 is rotated between the first and second angular positions.

When a user goes to load the tray 100, the user can simply push the front stop 104 rearward towards the second end 118 to cause the front stop 104 to recline and allow access to the storage region of the tray 100. Once the merchandise is loaded into the tray 100, the front stop 104 will swing back to the upright orientation to prevent the merchandise from being ejected from the tray 100 by the pusher 104.

The front stop 104 is preferably releasably mounted to the front stop hinges 140 such that the front stop 104 can be removed from the front stop hinges 140 without the front stop hinges 140 needing to be removed from the merchandise support frame 109 and particularly from the wire support structure 110 and more particularly from lateral member 120. This allows for simple replacement in the event of damage, reconfiguration, different front stops 104, etc. without requiring disassembly of the system.

Figure 10:
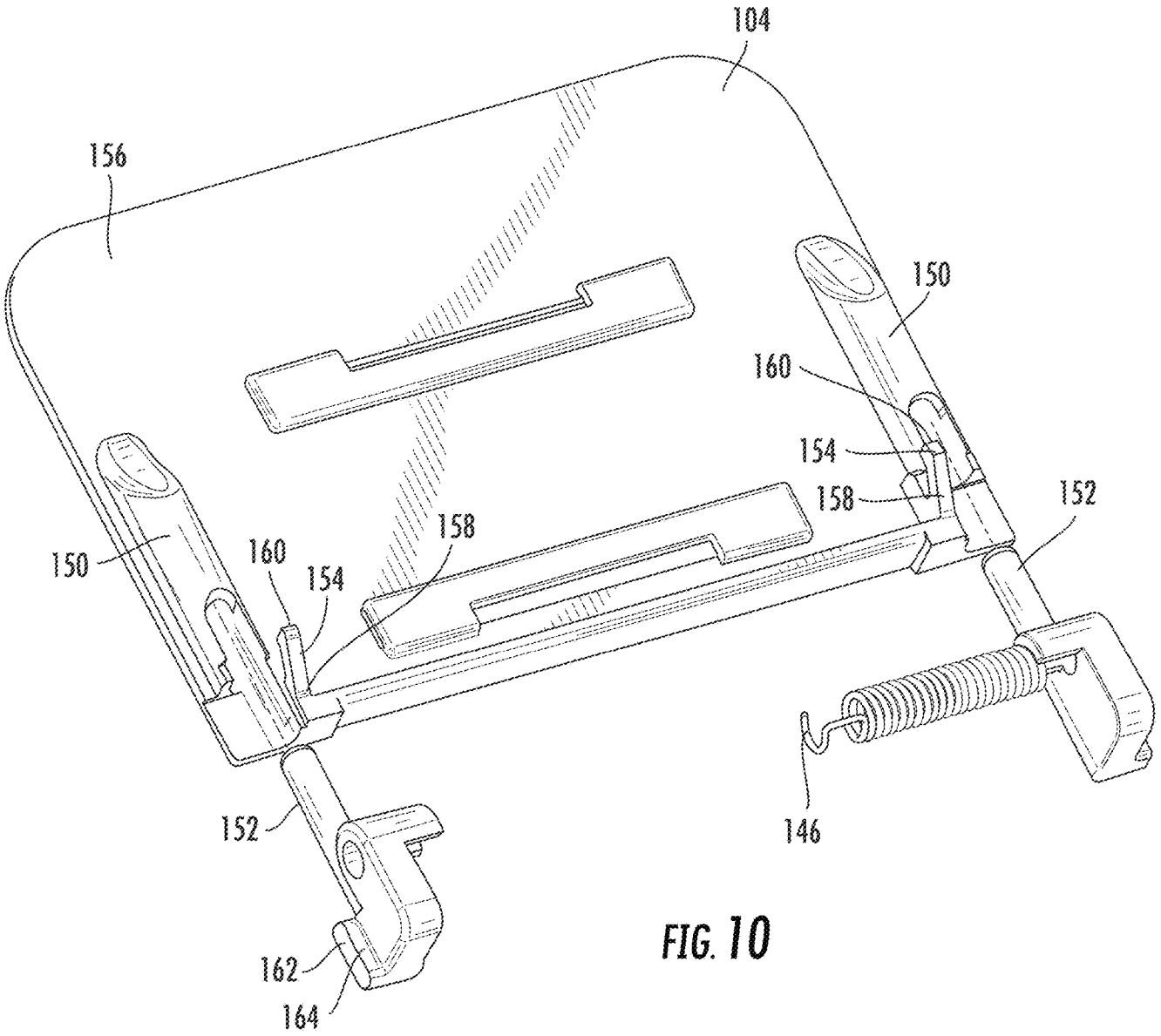

With reference to FIG. 10, the front stop 104 includes a pair of mounting slots 150 that receive a corresponding axially extending mounting pin 152 of the corresponding front stop hinge 140. Preferably, a friction fit is provided between the mounting slots 150 and mounting pins 152. In some embodiments, one or both of the mounting pins 152 or mounting slots 150 have a taper such that increased insertion of the pin 152 into the mounting slot 150 increases frictional engagement between the components.

Figure 11:
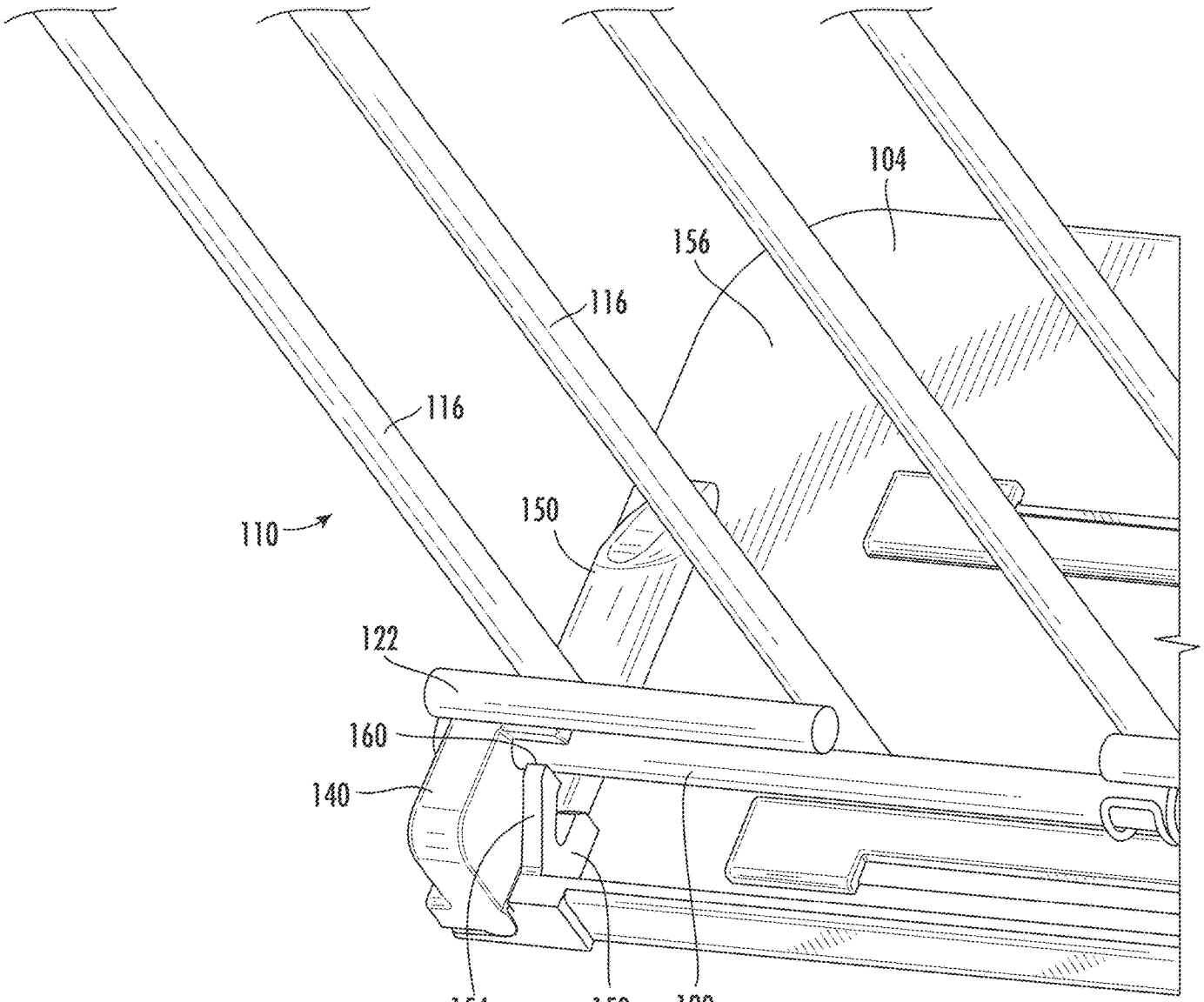
FIG. 11 is a bottom perspective illustration enlarged to show engagement of the front stop with the wire support structure of the retail merchandise tray assembly of FIG. 1.

With reference to FIGS. 10 and 11, the front stop 104 includes a pair of flexible mounting clips 154 extending rearward from a rear side 156 of the front stop 104. The mounting clips 154 help secure the front stop 104 to the front stop hinges 140.

Flexible mounting clips 154 extend from a first end 158 attached to the front stop 104 and a free end 160. The free end 160 is biased against the lateral member 120 when the front stop 104 is mounted to the front stop hinges 104. The free end 160 acts on an opposite side of the lateral member 120 as where the mounting pin 152 is located so that it biases the front stop 104 onto the mounting pin and inhibits removal of the front stop 104 from pins 152. The flexible mounting clip 154 can be biased out of engagement with the lateral member 120 when it is desired to remove the front stop 104.

The flexible mounting clip 154 preferably has a tapered orientation relative to the mounting slots 150 so that when the front stop 104 is being mounted onto pins 152, the flexible mounting clip 154 will slide along lateral member 120 and the tapered orientation will automatically flex the flexible mounting clip as it is being installed. Once sufficiently installed, the free end 160 will travel past the lateral member 120 and spring back to its relaxed state with the free end 160 adjacent the opposite side of lateral member 120.

Figure 5:
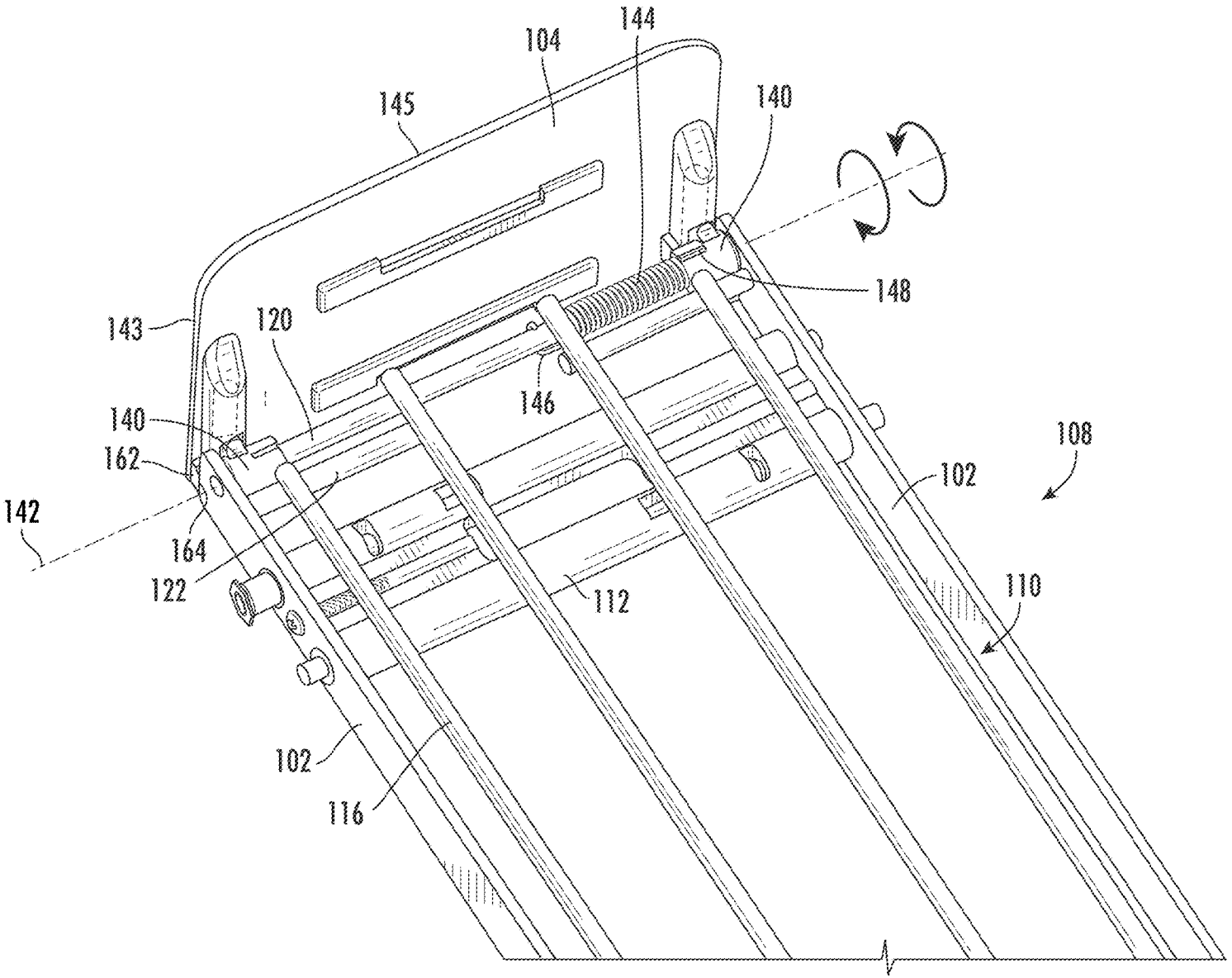
FIG. 5 is a perspective illustration of a front stop of the retail merchandise tray of FIG. 1, with the front stop in an upright orientation.
Figure 6:
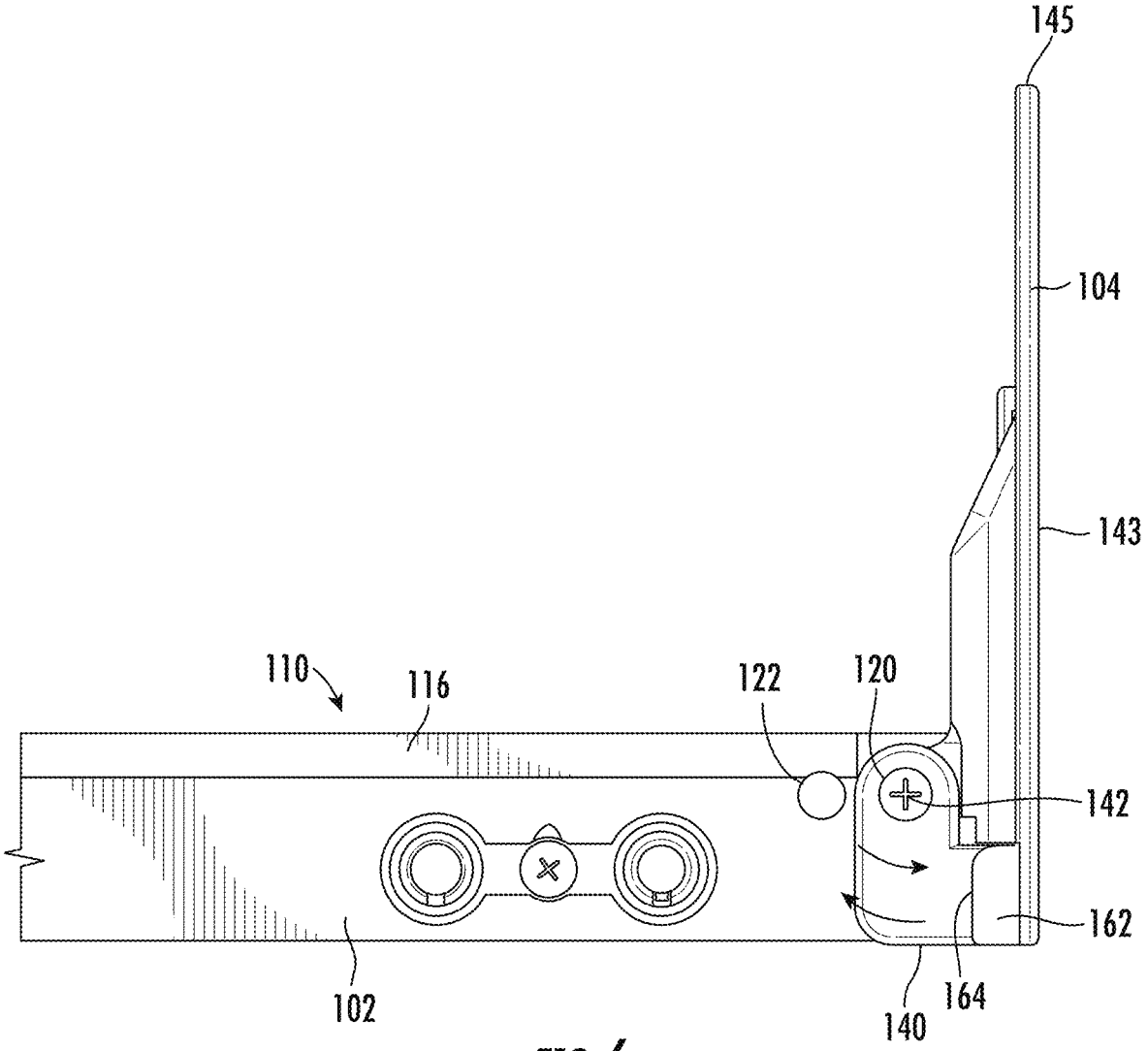
FIG. 6 is a side view of the front stop in the upright orientation.

The front stop hinges 140 include rotation limiting abutments 162 that have an abutment surface 164 that engages the merchandise support frame 109 and particularly one or both of the load bearing members or the wire support structure 110 when the front stop hinge is in the first angular position. This abutment is illustrated in FIG. 5. The biasing member 144 will bias the rotation limiting abutments 162 into engagement with the corresponding structure of the merchandise support frame 109.

This engagement and biasing force provided by the biasing member 144 will maintain the front stop 104 in the upright orientation.

As noted, the position of the dividers 130 relative to the merchandise support frame 109 can be adjusted to accommodate merchandise of different widths.

Figure 12:
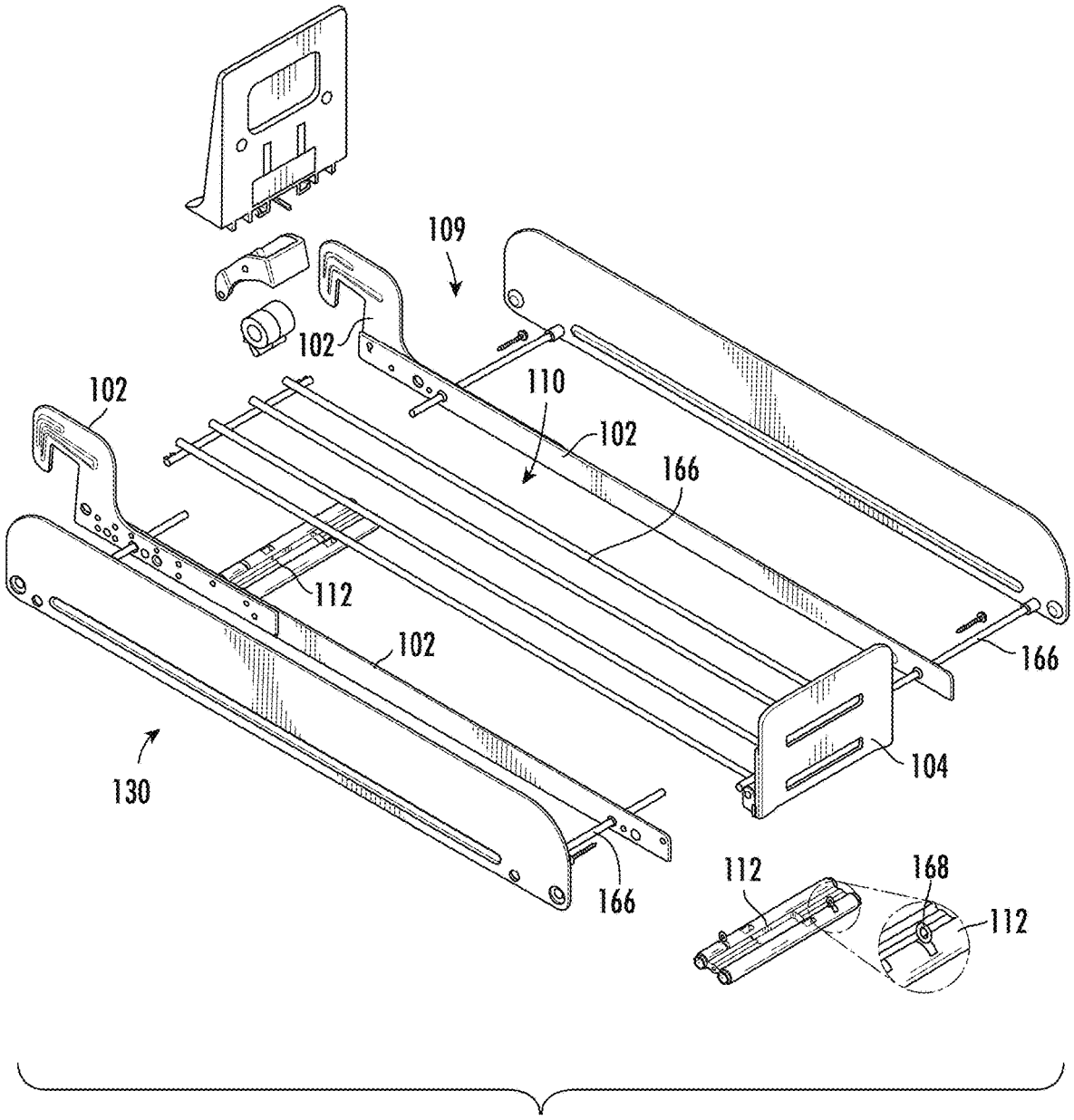
FIG. 12 is an exploded illustration of the retail merchandise tray assembly of FIG. 1.

With reference to FIG. 12, each divider 130 is operably slidably mounted to the merchandise support frame 109 by a longitudinally extending divider mount 166. In the illustrated embodiment, the divider mount 166, is in the form of a cylindrical rod.

In the illustrated embodiment, the divider mount 166 extends through an aperture in the load bearing member 102 to which the corresponding divider 130 is positioned and into a corresponding cylindrical tube portion 167 of an adjacent spacer 112.

The spacer 112 may be considered a divider support as the divider mounts 166 extend into cylindrical tube portions 167.

In a preferred embodiment, a resilient friction member mounted to the merchandise support frame 109 engages the divider mount 166 to provide some resistance to movement of the dividers 130. The divider mount 166 is slidable relative to the resilient friction member when adjusting the position of the divider 130 relative to the merchandise support frame 109.

Figure 13:
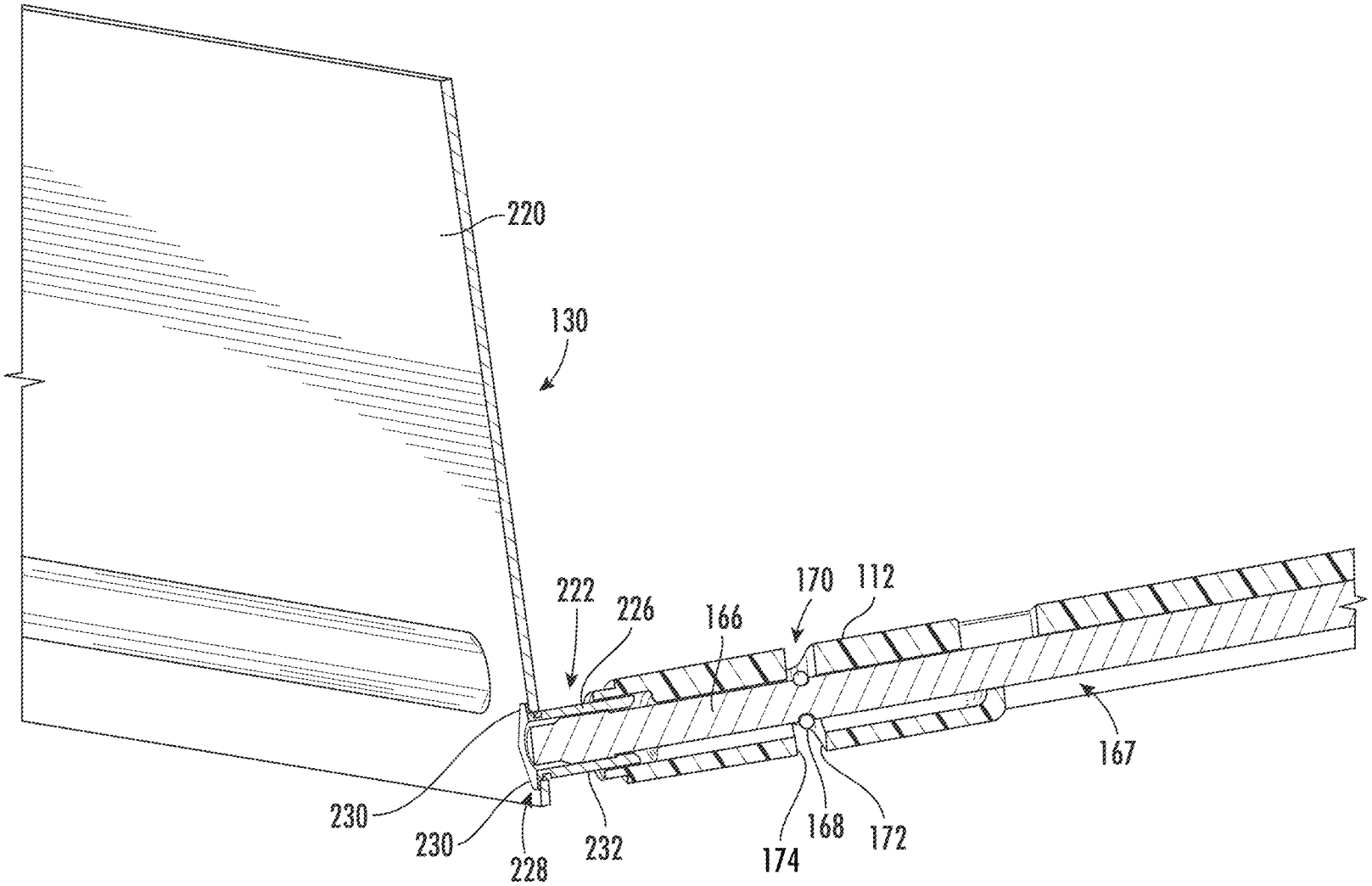
FIG. 13 is a cross-sectional illustration of the divider mount and spacer of the retail merchandise tray assembly of FIG. 1.

With reference to FIG. 13, the resilient friction member is in the form of O-ring 168. The inner diameter of O-ring 168 is smaller than the outer diameter of the divider mount 166. As such, when the divider mount 166 passes through the O-ring the O-ring is stretched providing a desired frictional engagement.

The spacer 112 has slots 170 that are transverse to the cylindrical tube portion 167 for receipt of O-ring 168. When properly aligned, the opening of the O-ring 168 will align with the inner diameter of the cylindrical tube portion 167. The outside diameter of the O-ring 168 is greater than the inside diameter of the cylindrical tube portion 167 so that the O-ring 168 will axially abut the opposed sides 172, 174 of slot 170 depending the direction of adjustment of the position of the divider 130 relative to spacer 112.

It can often be beneficial to mount signs adjacent a tray 100 such as for advertising, coupons, or to otherwise display relevant information. As illustrated in FIG. 1, tray 100 includes a sign 180 operably attached to one of the dividers 130. However, a sign could be operably attached to both dividers 130.

A sign adaptor 182 is used to connect the sign 180 to divider 130. In this embodiment, the sign adaptor 182 extend outward from an end of divider 130 (e.g. outward beyond the first end 114 of the tray 100).

By attaching the sign 180 to the divider, the sign 180 will be adjusted relative to the rest of the tray 100 when the divider 130 position is changed. This prevents the sign 180 from interfering with access to the merchandise stored within tray 100.

Figure 14:
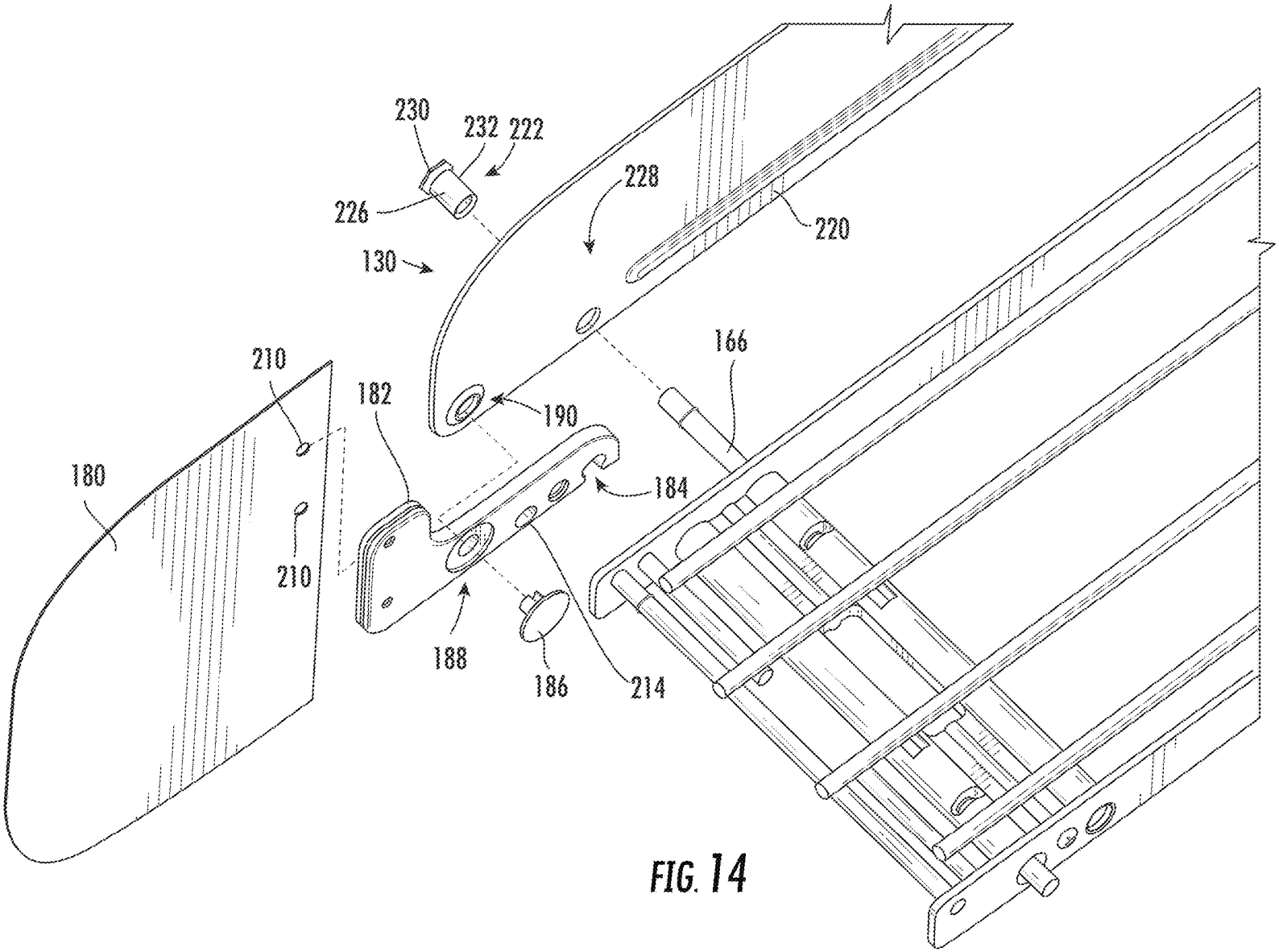
FIG. 14 is a partial exploded illustration of the retail merchandise tray assembly of FIG. 1 illustrating the sign adaptor and corresponding sign that are attached to the divider.
Figure 15:
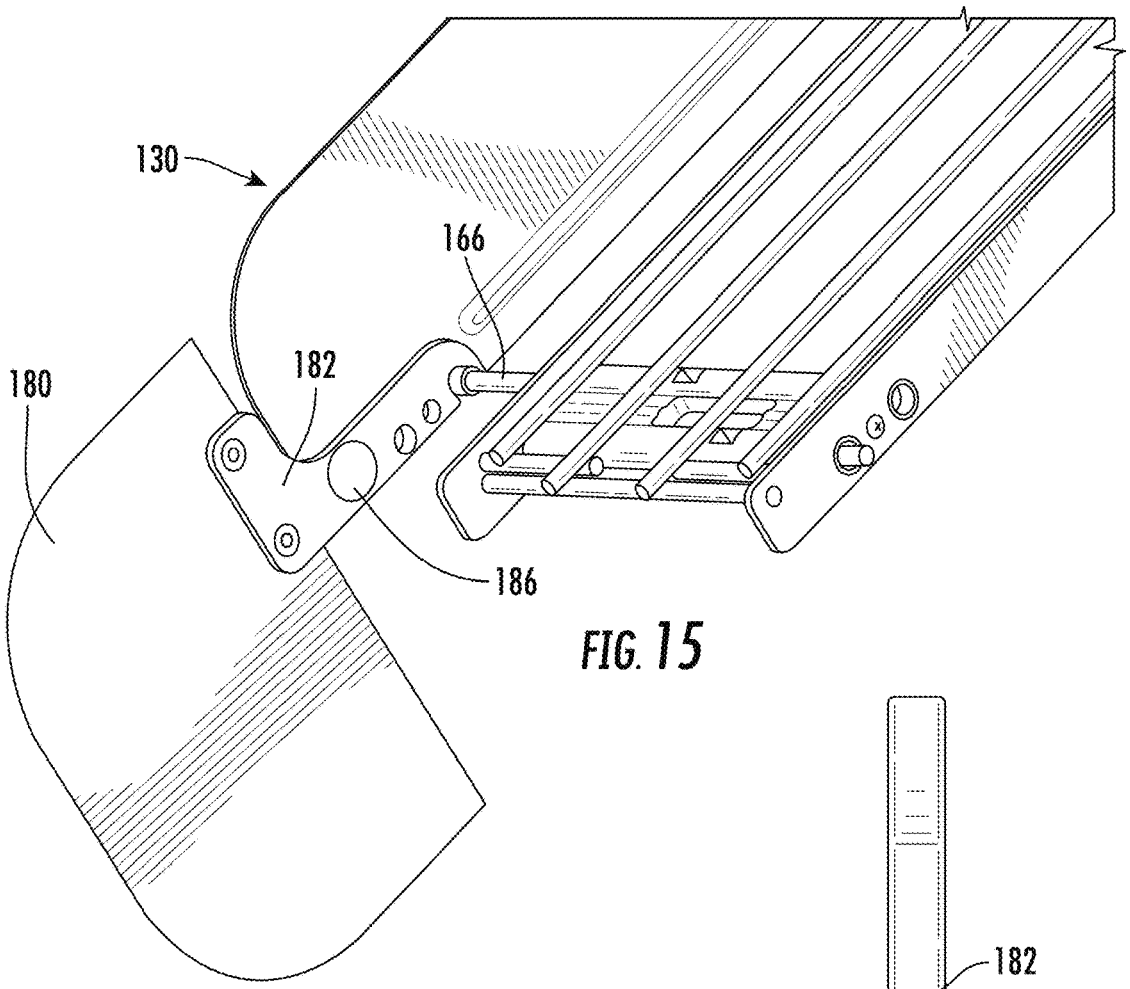
FIG. 15 is a perspective illustration of the sign, sign adaptor and divider of FIG. 14.

The sign adaptor 182 operably attaches to the divider 130 in at least two spaced apart locations to prevent rotation of the sign adaptor 182 relative to divider 130. With reference to FIGS. 14 and 15, the sign adaptor 182 includes a c-shaped snap connector 184 that can snap engage around divider mount 166. This provides a first one of the attachment locations. The mouth of the c-shaped snap connector 184 is smaller than the diameter of the divider mount 166. When mounting, the c-shaped snap connector 184 resiliently flexes and then resilient returns to shape to secure the sign adaptor 182 to the divider mount 166.

Further, a push pin 186 is used as the second attachment location. Here, push pin 186 is resilient pushed through aperture 188 in the sign adaptor 182 and aperture 190 in divider 130. The diameter of aperture 190 is smaller than the outer diameter of the shaft of the push pin 186 to provide proper engagement therebetween.

FIGS. 16-19 illustrate the sign adaptor 182. The sign adaptor 182 includes a sign attachment arrangement. In this embodiment, the sign attachment arrangement is in the form of a pair of spaced apart sidewall portions 192, 194 that define a channel 196 therebetween. When mounted, the sign 180 is captured at least in part within channel 196.

The opposed sidewalls 192, 194 are operably coupled to one another proximate adjacent sides thereof. The connection providing a bottom to the channel 196. The channel 196 is bounded on only a single side such that the sign can be larger in dimension than the channel 196 and extend outward therefrom (see e.g. FIG. 15).

Figure 16:
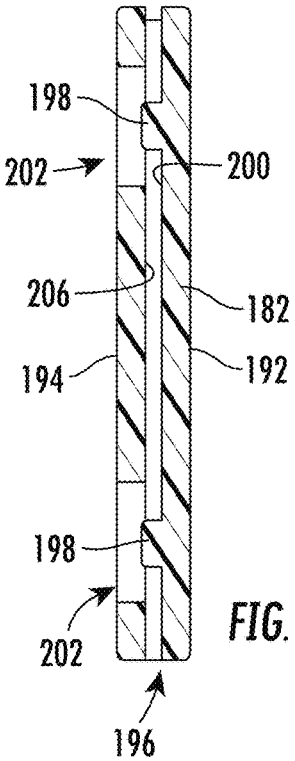
FIGS. 16-19 illustrate the sign adaptor.
Figure 17:
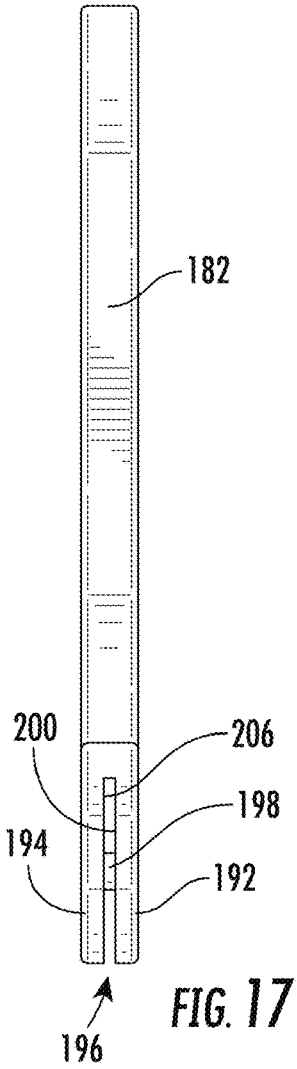
Figure 18:
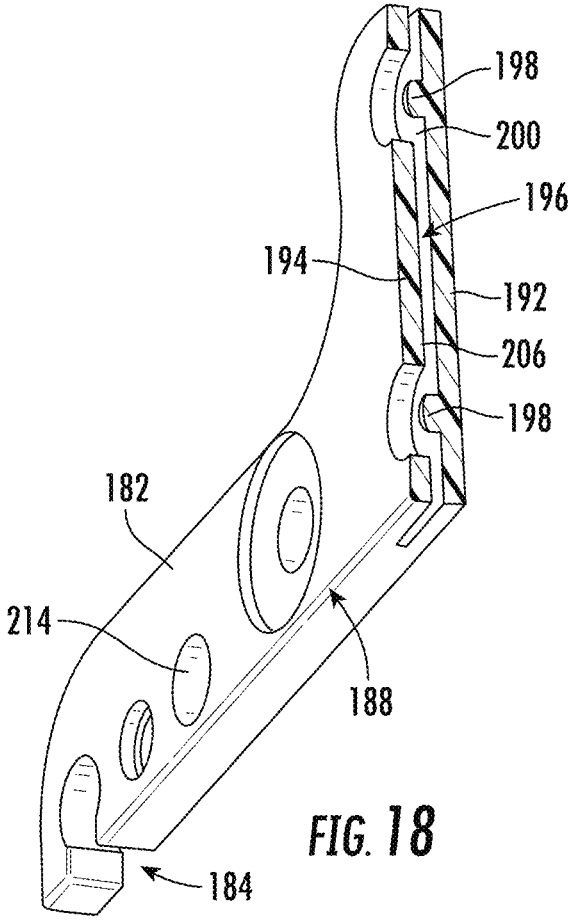

With particular reference to FIG. 16, the sign adaptor 182 includes a pair of nibs 198 that extend from an inner face 200 of sidewall 192 towards sidewall 184194

Preferably, nibs 198 extend outward from surface 200 a greater distance than the spacing between sidewalls 192, 194 such that the nibs 198 extend into cavities in the inner surface 206 of sidewall 194 that could be recesses or apertures. In the illustrated embodiment, the cavities are in the form of apertures 202 in sidewall 194.

The sign 180 has nib receiving regions 210 that align with and cooperate with nibs 198 to secure the sign 180 within channel 196. In this embodiment, the receiving regions 210 are apertures, but dimples or recesses formed within the sign 180 could work as well.

Figure 19:
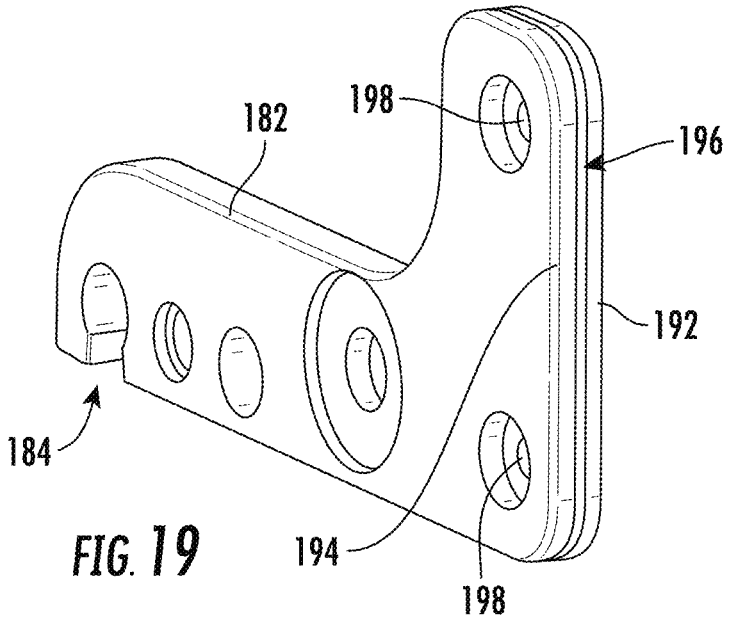

With reference to FIGS. 15 and 19, the sign adaptor 182 includes a further cavity in the form of aperture 214 that receives a free end of divider mount 166 that mounts the divider 130 on the opposed side of tray 100 when the other divider 130 is positioned at a closest most position relative to the merchandise support frame 109. In other embodiments, the cavity could be a recess that does not extend entirely through the sign adaptor. This free end is the end of divider mount 166 that is opposite the end that is connected to the other divider 130.

It is noted that the sign adaptor 182 can be mounted to either the left or right divider 130. Further, the sign adaptor 182 is located on an inner side of the dividers 130 (e.g. on the side of the adjacent divider 130 that faces the opposed divider 130).

With reference to FIGS. 13 and 14, the divider 130 includes a divider body 220 and a mounting socket 222. The divider mount 166 axially press fit into a cavity of the mounting socket 222.

In a preferred embodiment, the outer surface of the portion of the divider mount 166 that is received in the cavity of mounting socket 222 is knurled or has other surface features to improve the engagement between the divider mount 166 and the mounting socket 222.

In some embodiments, such as where the divider body 220 is plastic, the divider body 220 and mounting socket 222 are formed from a continuous piece of material.

In the illustrated embodiment, the divider body 220 and mounting socket 222 are separate components. Here, the mounting socket 222 is provided by press nut 226 that extends through aperture 228 in divider body 220.

The press nut 226 has an enlarged head portion 230 connected to a reduced diameter cylindrical body 232. Here, the press nut 226 would be press mounted to the divider body 220 from an exterior side of the divider body 220.

This arrangement of using a press nut 226 provides for improved aesthetics and is more conducive to a powder coated arrangement.

In some embodiments, the outer surface of the divider body 220 is powder coated while the divider mount 166 is not powder coated. The divider mount 166 may be zinc coated wire.

By foregoing painting/powder coating the divider mount 166, the diameter of the divider mount 166 can be better controlled as it can be difficult to control paint thickness on round or substantially round members. This improves the engagement between the divider mount 166 and the spacers 112. This is particularly true when friction members and particularly resilient friction members are used to provide desired resistance to the adjustment of the divider 130 relative to the merchandise support frame 109.

This finds particularly beneficial implementation where the painting/powder coating of the divider body 220 is done by an automated system rather than by manual painting/powder coating, where a user can better control the application of paint/powder coating to the components.

During assembly when a press nut is used, the press nut 226 will typically be installed to the divider body 220 prior to powder coating. Thereafter, the divider mount 166 can be press fit into the press nut 226.

This is an improvement over prior designs where a wire extends through and mounts to the divider body 220.

To provide for customization of the display of information, the front stop 104 is configured to mount price channel extrusions thereto.

Figure 20:
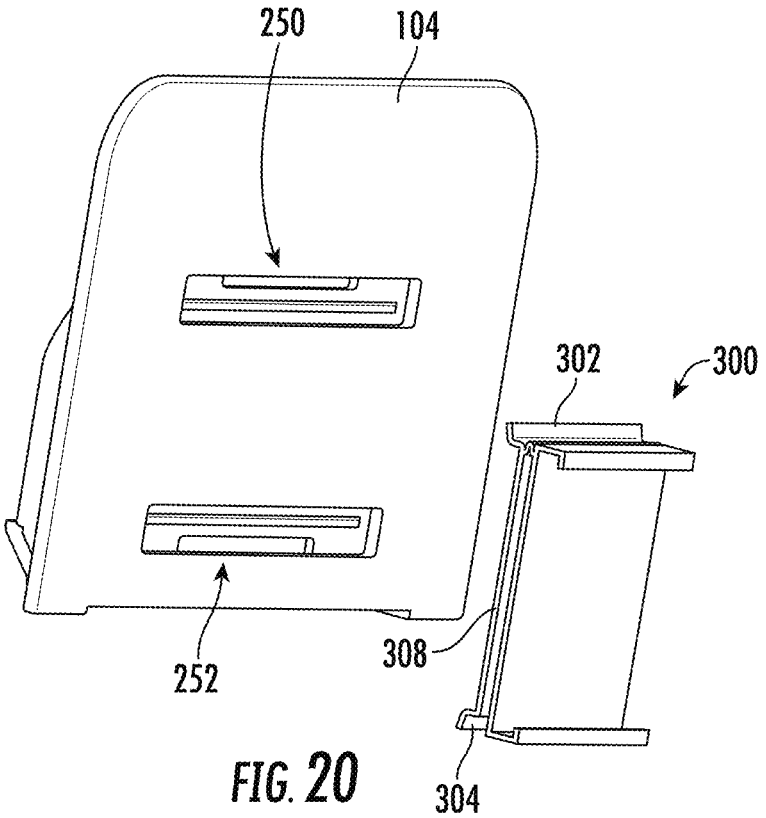
FIG. 20 is an exploded illustration of the front stop and an optional first embodiment of a sign holder that can be releasably secured to the front stop.
Figure 21:
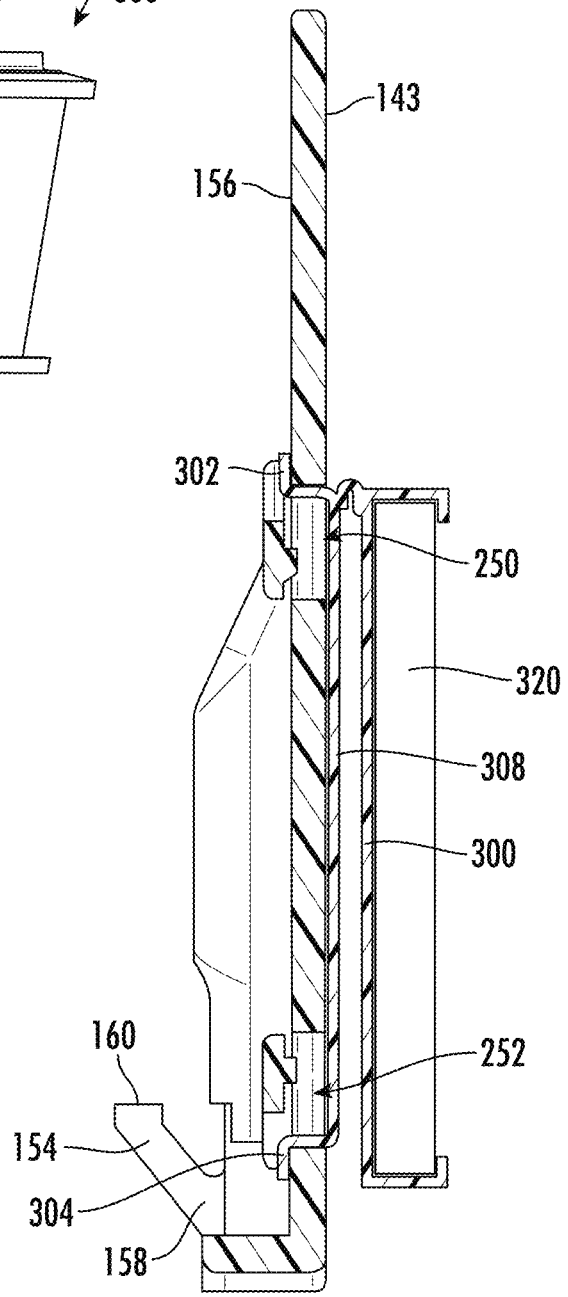
FIG. 21 is a cross-sectional illustration of the arrangement of FIG. 20 with the sign holder mounted to the front stop.

FIGS. 20 and 21 illustrate a first sign holder extrusion 300 that can be removably mounted to front stop 104. The front stop 104 includes a pair of slots 250, 252 formed in the main panel thereof that receive a pair of opposed legs 302, 304 of first extrusion 300.

The pair of opposed legs are bent in opposed directions to allow for engagement with the rear side 156 of the front stop 104 to secure the first extrusion 300 thereto. The extrusion 300 is sufficiently flexible to allow sufficient bending that legs 302, 304 can be biased towards one another and the legs 302, 304 can be inserted through slots 250, 252.

Legs 302, 304 are spaced apart and mounted to support panel 308. Support panel 308 will rest against front surface 143 of front stop 104 when properly mounted.

First extrusion 300 has forward facing legs configured to mount an electronic shelf label 320, however other configurations are contemplated (e.g. see the following extrusions).

Figure 22:
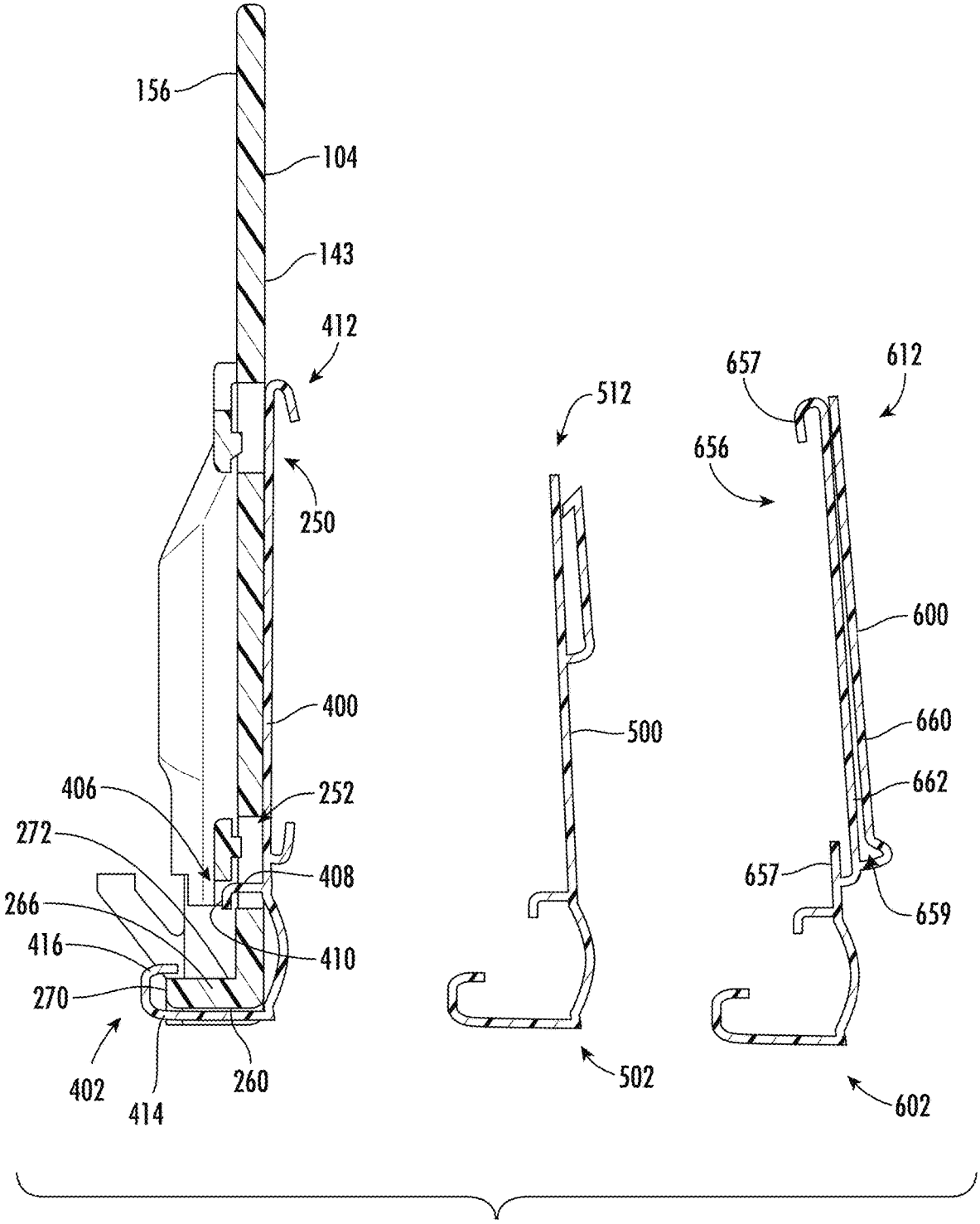
FIGS. 22 and 23 are cross-sectional illustrations of a plurality of alternative sign holder arrangements that can be releasably secured to the front stop.
Figure 23:
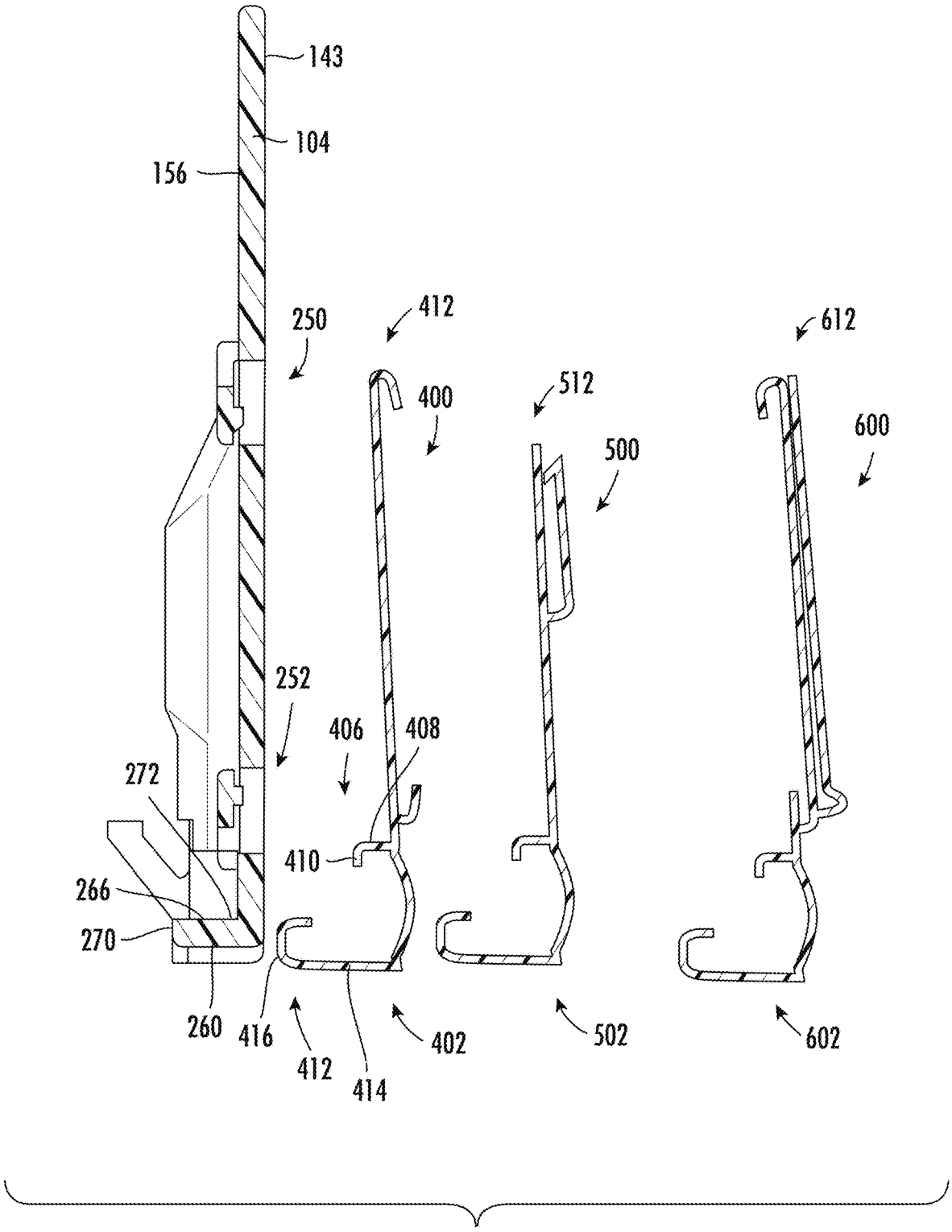
Figure 24:
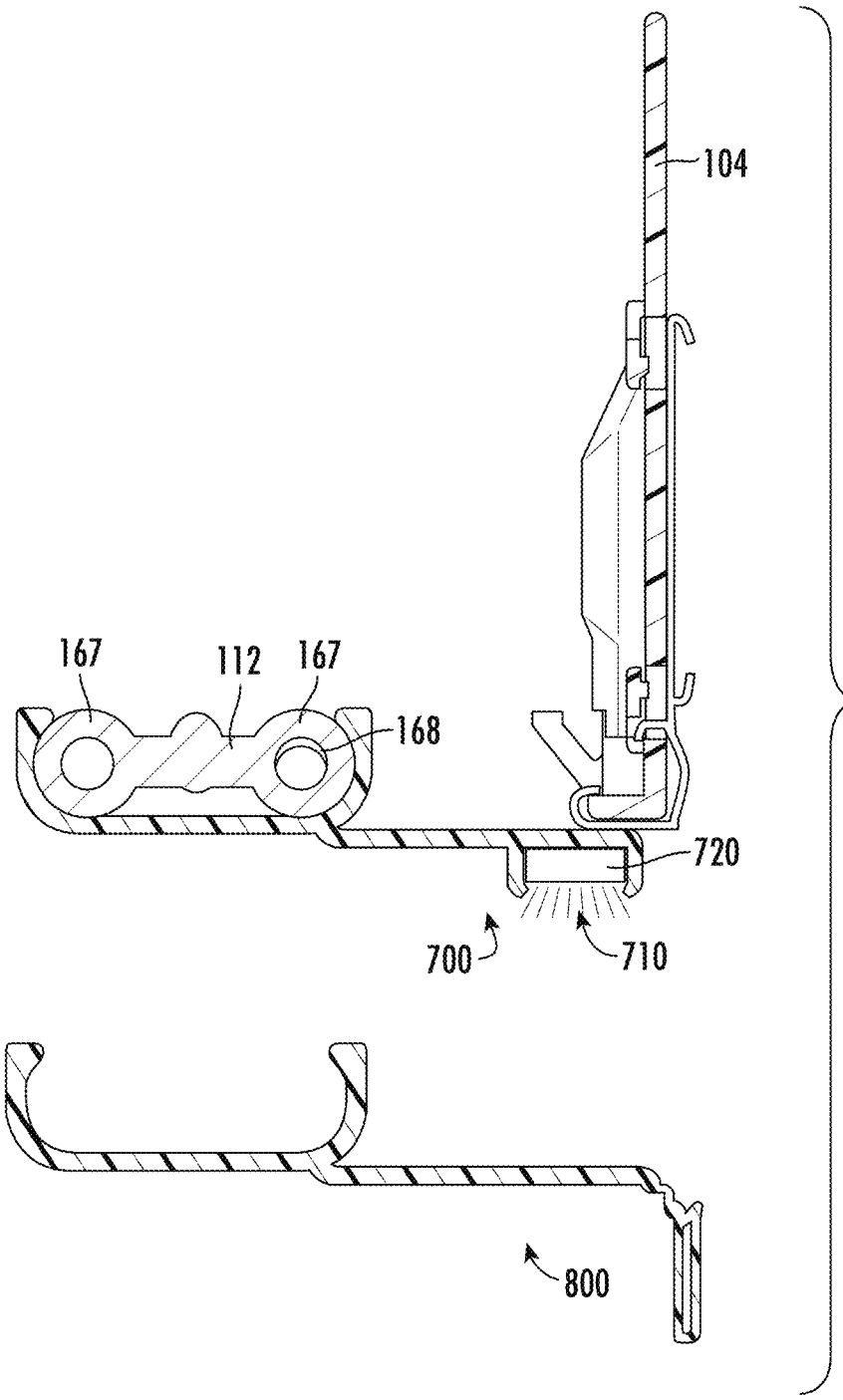
FIGS. 24 and 25 are profile illustrations of attachment clips that be releasably attached to the spacer/divider support of the tray.
Figure 25:
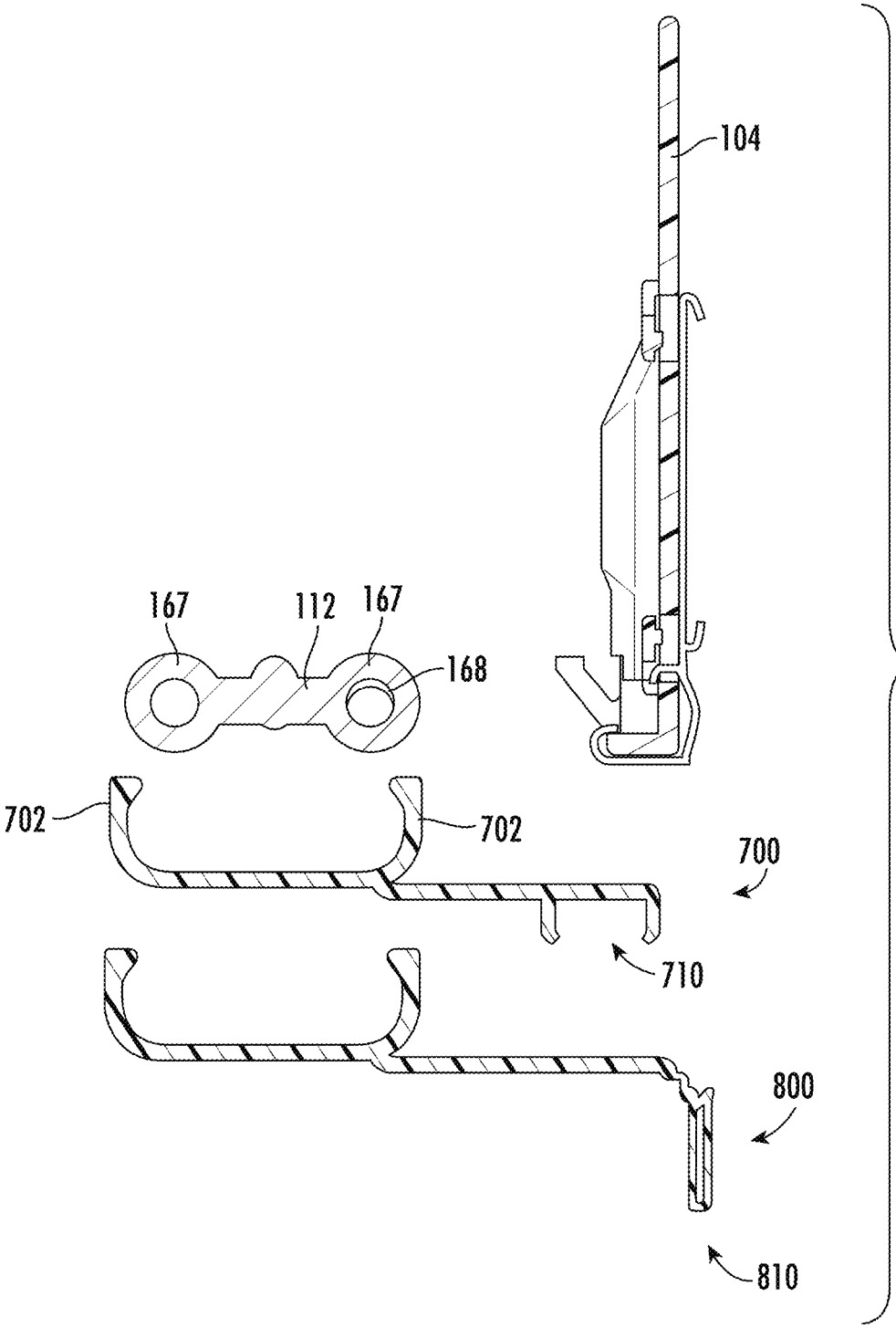

FIGS. 22 and 23 illustrate alternative extrusion arrangements that can be attached to front stop 104 to provide additional information. More particularly, second, third and fourth sign holder extrusions 400, 500, and 600 are illustrated.

Rather than having legs that extend through both slots 250, 252, these extrusions 400, 500, 600 have attachment configurations 402, 502, 602 that use one slot 252 and wrap around and capture a rearward extending bottom flange 266 of the front stop 104. The principle difference between extrusions 400, 500, 600 are the configuration of the sign attachment mechanisms for attaching signs (e.g. price labels, product information, etc.).

The attachment configurations 402, 502, 602 are substantially identical so only attachment configuration 402 will be described.

The attachment configuration includes a top clip portion 406 that is generally L-shaped including a rear leg portion 408 and downward extending foot portion 410. Leg portion 408 extends through slot 252 such that foot portion 410 can engage rear side 156 of front stop 104 when mounted thereto.

The attachment configuration 402 also includes a bottom clip portion 412 that is generally J-shaped. A rearward extend leg portion 414 extends below and sufficiently rearward past bottom 260 of front stop 104 such that a hook portion 416 can wrap around a rear side 270 of bottom flange 266. The hook portion 416 extends around rear side 270 and back over top side 272 of bottom flange 266.

Upper portions 412, 512, 612 of the extrusions 400, 500, 600 can be biased against the front of front stop 104 and placed in a slight state of bending to fix the extrusions 400, 500, 600 and prevent slop between the extrusions 400, 500, 600 and the front stop 104.

The extrusions herein could be formed from a single material or multiple materials such as being formed from two materials being co-extruded with one another. This will allow different portions, for example, to be formed from different materials, different color materials or combinations of both. For example front panels could be transparent while rear panels could be opaque.

In addition to extrusions 300, 400, 500, 600, accessory attachment clips 700 and 800 can be provided. These accessory attachment clips 700, 800 attach to spacer 112 in an identical manner and will be described with reference to accessory attachment clip 700. A pair of opposed flexible legs 702 wrap around front and rear sides of spacer 112 and particularly around the outer periphery of the cylindrical tube portions 167. The legs 702 will flex away from one another during mounting and then resiliently come back together to secure the clip 700 to spacer 112.

Accessory attachment clip 700 is configured for mounting LED light strips 720 in an accessory mount in the form of channel 710.

Accessory attachment clip 800 has an accessory mount 810 to which information can be attached, such as for example an electronic shelf label.

Figure 26:
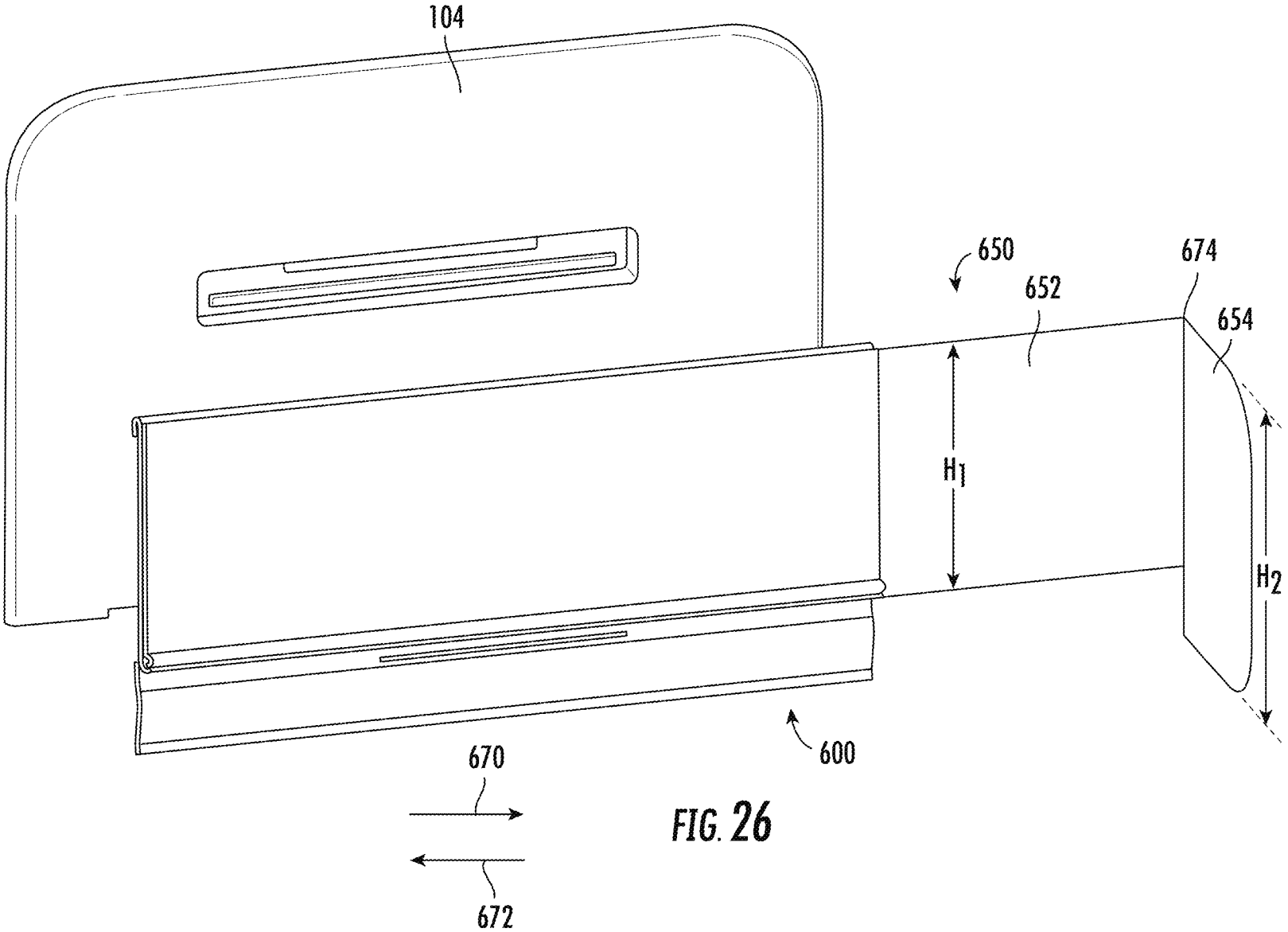
FIGS. 26 and 27 are perspective illustrations illustrating sign flags that can be attached to the front stop by way of a sign holder.
Figure 27:
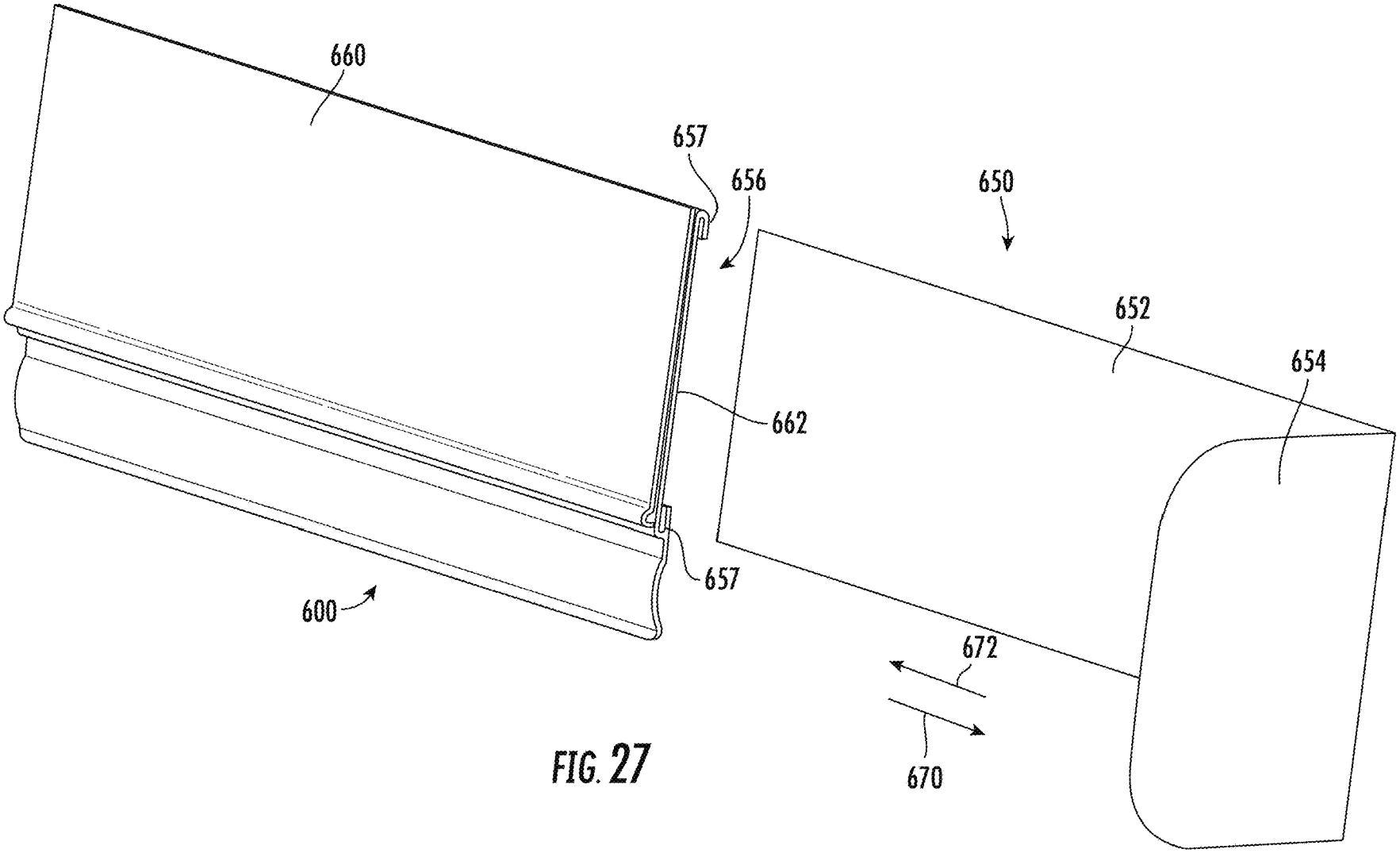

FIGS. 26 and 27 illustrate a further arrangement. In this arrangement, extrusion 600 is used. In addition, an adjustable sign flag 650 is used with extrusion 600 and front stop 104.

The sign flag 650 includes a mounting portion 652 and a flag portion 654. The mounting portion 652 is generally planar and the flag portion 654 is generally planar but generally orthogonal to mounting portion 652. The flag portion 654 preferably extends forward of the mounting portion 652. Mounting portion 652 is configured and sized to be received in extrusion 600.

In a preferred embodiment, the mounting portion 652 and flag portion 654 are formed by a single continuous piece of material, e.g. molded plastic, folded plastic, folded paper/card stock, etc. The intersection 674 between mounting portion 652 and flag portion 654 may be scored or creased to help maintain the substantially orthogonal orientation (e.g. plus or minus 15 degrees) between the components.

In some embodiments, the vertical heights H1 and H2 of the mounting portion 652 and flag portion 654 may be the same or different. Typically, height H2 of the flag portion 654 will be greater than the height H1 of the mounting portion 652.

With additional reference to FIG. 22, mounting portion 652 could be received in different sign flag mounting channels of the extrusion 600. For example, mounting portion 652 could be received in the channel 659 formed between front and rear panels 660, 662 where pricing information would typically be stored. Alternatively, with regard to this extrusion 600, the mounting portion 652 could be mounted in a rear mounting channel 656 formed between opposed hook portions 657 (e.g. flanges) and panel 662.

The front and rear panels 660, 662 may be translucent in some embodiments.

The sign flag 650 is slidably mounted to extrusion 600 such that the lateral position of the sing flag 650 can be adjusted, such as represented by arrows 670, 672.

Both mounting portion 652 and flag portion 654 may include information the retailer would like to display relative to the rest of tray 100.

While a single sign flag 650 is illustrated in conjunction with extrusion 600, in other arrangements multiple (e.g. two) sign flags 650 may be used. Typically, they would extend out of opposed ends of the common extrusion.

Further, while the sign flag 650 is disclosed as being used with extrusion 600, the sign flag could be used with other ones of the extrusions.

Figure 28:
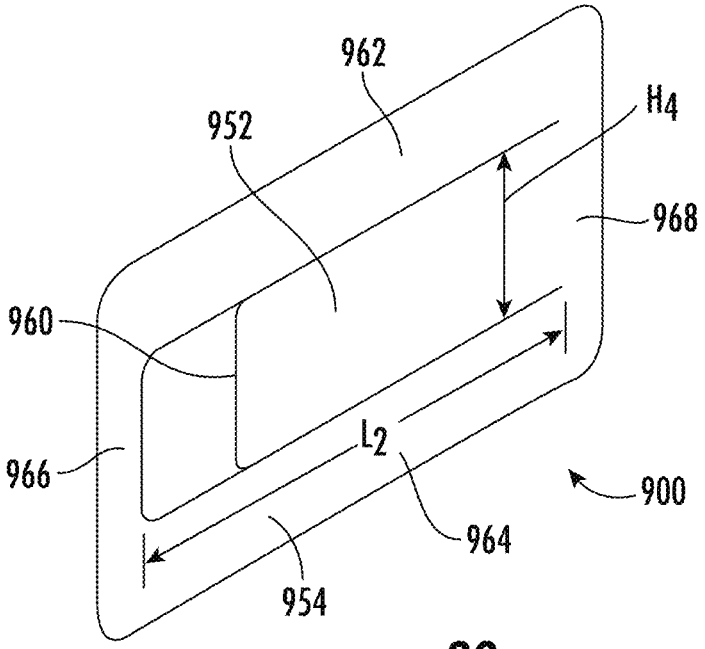
FIGS. 28 and 29 illustrate a further sign arrangement.
Figure 29:
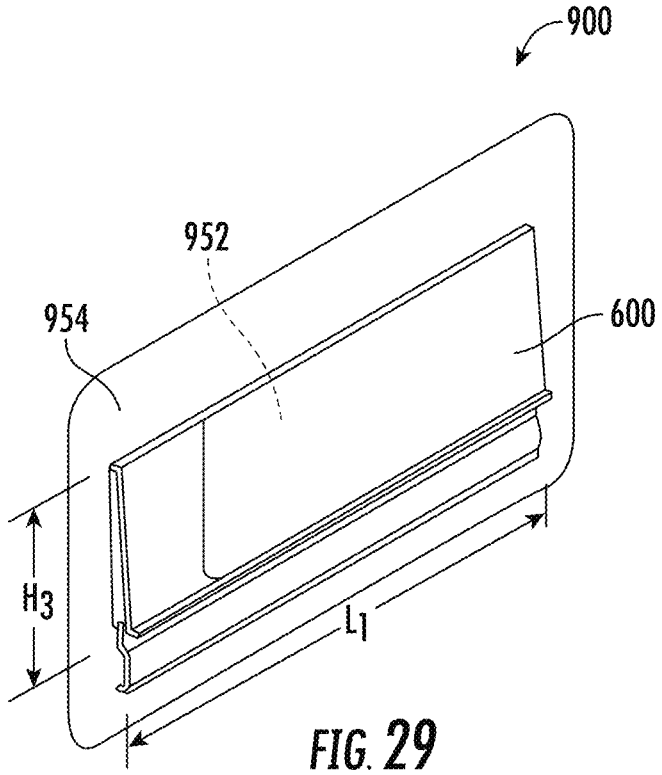

FIGS. 28 and 29 illustrate a further arrangement. This arrangement mounts to sign holder similar to sign flag 650, but does not include a flag.

This arrangement includes a framing sign 900. Framing sign 900 includes a mounting portion 952 that functions in the same manner as mounting portion 652 discussed above. However, rather than having an outward extending flag portion 654, this framing sign 900 includes a framing portion 954 that circumscribes the mounting portion 652.

As illustrated in FIG. 29, when the mounting portion 952 is inserted into the sign holder 600, the framing portion 954 surrounds or otherwise frames the sign holder 600.

In some embodiments, the mounting portion 952 and framing portion 954 are generally coplanar when mounted to sign holder 600 (e.g. plus or minus 15 degrees).

The mounting portion 952 is a laterally extending portion that has a free end 960 that would be slid into a mounting channel of the sign holder 600.

The framing portion 954 includes a pair of spaced apart leg portions 962, 964 that have the mounting portion 952 positioned therebetween. The leg portions 962, 964 are connected by and extend laterally between end portions 966, 968. The leg portions 962, 964 and end portions 966, 968 define a central area in which the mounting portion 952 is positioned and in which the sign holder 600 generally fits when the framing sign 900 is mounted to the sign holder 600.

The length L2 of the central area defined by leg portions 962 is substantially equal to the length L1 of the width of the sign holder 600.

Similarly, the height H4 of the central area defined by end portions 966, 968 is substantially equal to the height H3 of the portion of the sign holder positioned within the central area when the framing sign 900 is mounted.

Mounting portion 952 extends laterally from end portion 968 towards end portion 966.

The framing portion 954 may be generally parallel to the front surface of a front stop 104 when mounted. Additionally, the framing portion 954 may be sized to fully or only partially cover the front surface 143.

FIGS. 30-34 illustrate a further example of a tray 1000 according to the present disclosure. The tray 1000 is similar to the prior trays in many aspects. Those features not expressly discussed below but discussed above can be incorporated into tray 1000 unless contrary to the operation of the present example. For example, the divider assemblies and associated features, signs, sign holders, label holders, and accessory attachment clips can all be incorporated into the tray 1000. While front stop 1004 is not illustrated to include upper opening 250 in front stop 104, this feature could be incorporated, for example.

Figure 30:
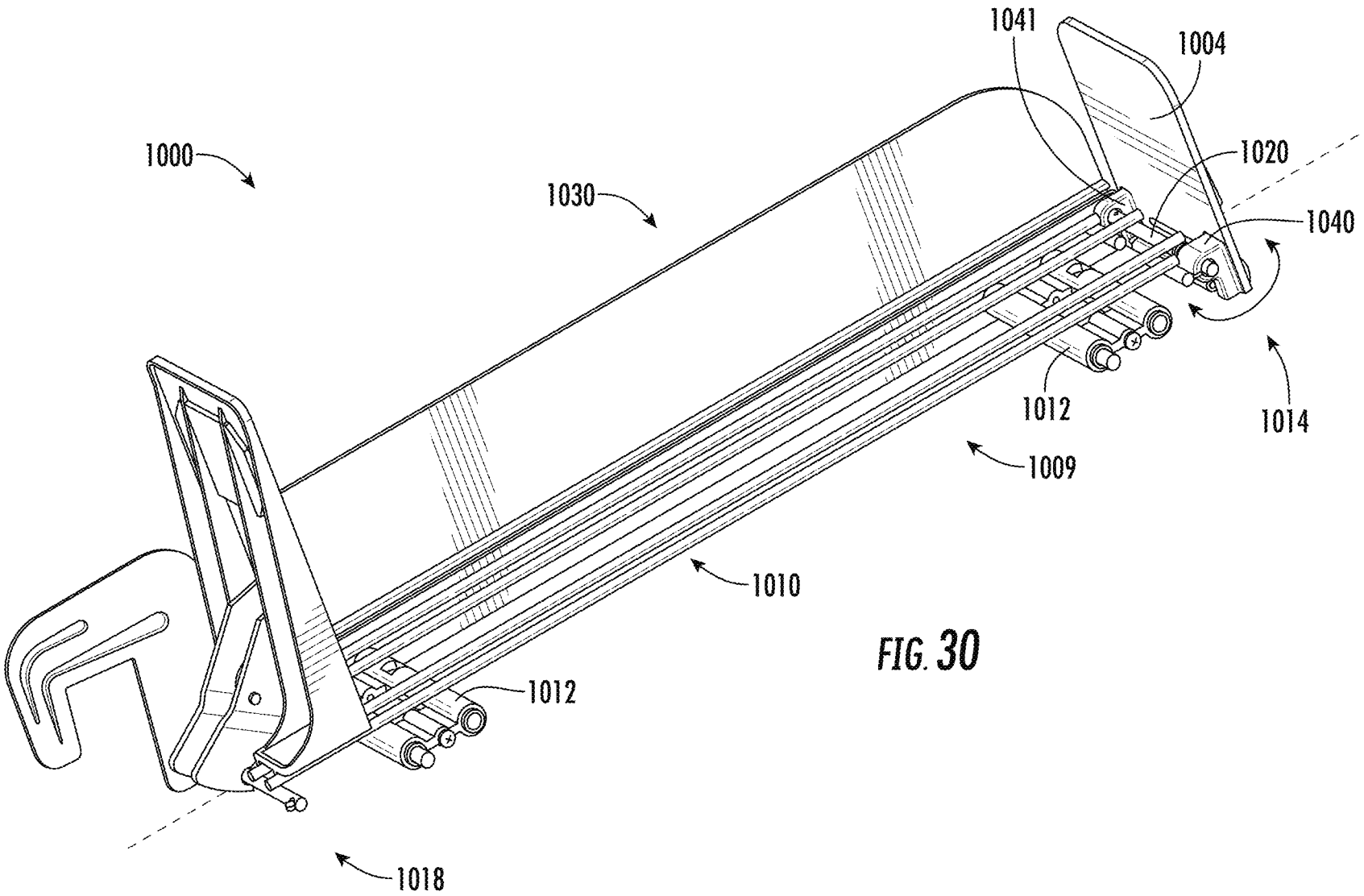
FIG. 30 illustrates a partial perspective illustration of another tray having a divider and a portion of the merchandise support frame removed.
Figure 31:
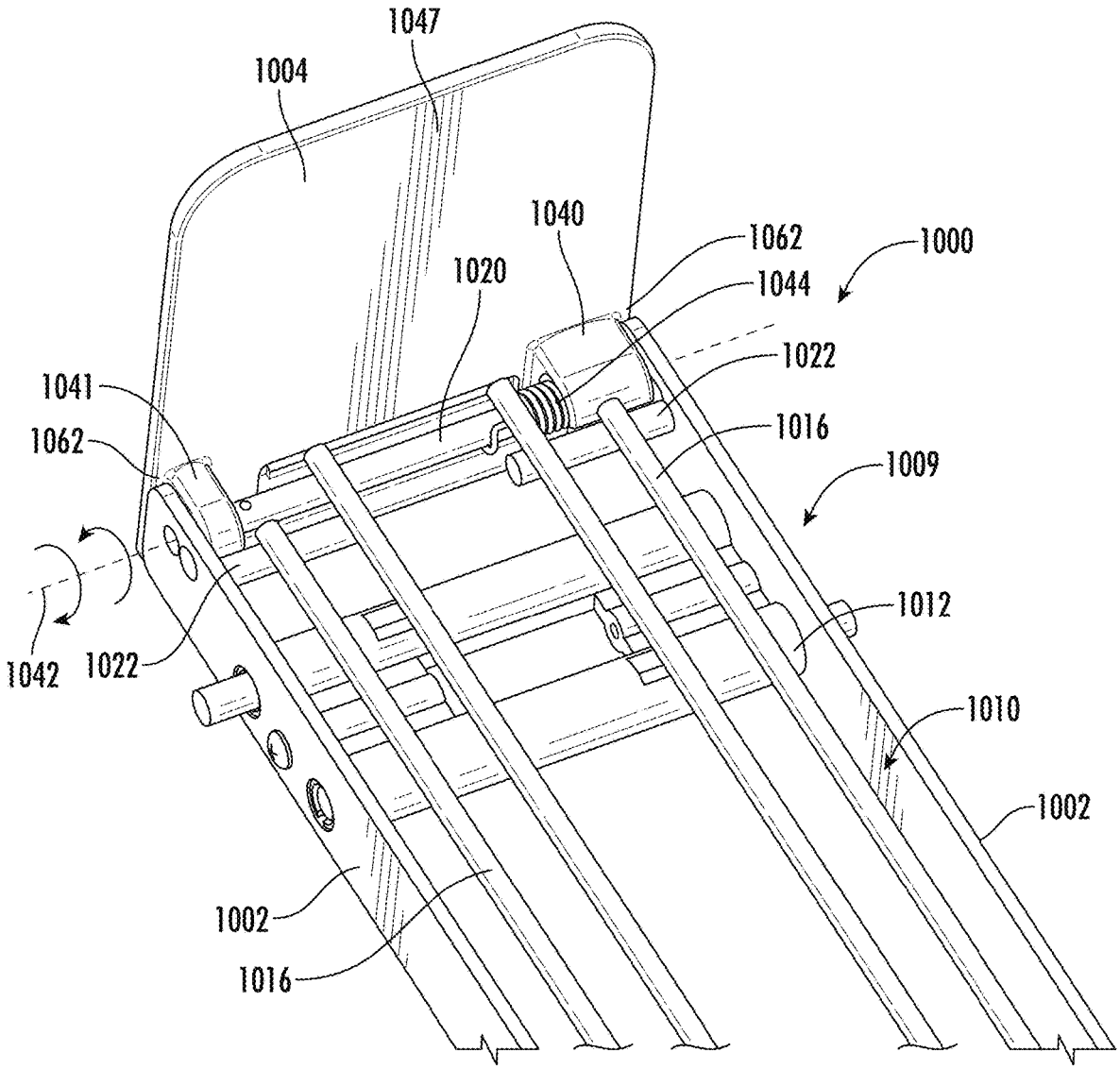
FIG. 31 is a partial perspective illustration of one end of the tray of FIG. 30.

With reference to FIGS. 30 and 31, the tray 1000 generally includes a merchandise support frame 1009 (best illustrated in part in FIG. 31) that defines a merchandise support surface upon which merchandise to be displayed is supported. Similar to prior trays, the tray 1000 includes a pair of load bearing members 1002, a wire support structure 1010 and spacers 1012.

The wire support structure 1010 is operably removably mounted to the load bearing members 1002. The wire support structure 1010 includes, typically, a plurality of laterally spaced, longitudinal members 1016 extending from a first end 1014 of the tray 1000 to a second end 1018 of the tray 1000 along a longitudinal axis.

A front stop 1004 is mounted to the merchandise support frame 109 proximate the first end 1014 of the tray 1000. The front stop 1004 that is operably mounted to allow for pivoting between an upright orientation shown in FIGS. 30 and 31 and a reclined orientation (not shown, but shown for tray 100 in FIGS. 7-8). In the upright orientation, the front stop 1004 inhibits removal of merchandise from the tray 1000. In the reclined orientation, merchandise may be more easily loaded into the tray 1000 from the first end 1014 of tray 1000.

Front stop hinges 1040, 1041 mount the front stop 1004 to the merchandise support frame 1009 and particularly to the wire support structure 1010. The front stop hinges 1040, 1041 are mounted to lateral member 1020 for rotation about lateral member 1020 and particularly axis 1042 defined thereby. The front stop hinges 1040, 1041 allow the front stop 1004 to rotate between the upright and reclined orientations.

In this example, the front stop hinges 1040, 1041 and the main panel 1047 are formed as a continuous piece and are permanently attached to one another. Thus, separate components from the main panel 1047 such as front stop hinges 140 are not required. In this example, the front stop hinges 1040, 1041 project rearward from a rear face of the main panel 1047.

The front stop hinges 1040, 1041 are spaced apart and the diameters of the apertures 1053 therethrough are sufficiently sized to allow for one end of lateral member 1020 to be inserted into one of the front stop hinges 1040, 1041 at an angle and then sufficiently rotated so that the other end can bypass the other one of the front stop hinges 1041, 1040 and then inserted into the aperture 1053 thereof.

In alternative examples, the apertures 1053 need not be complete circles and could be provided by C-shaped clips that allow for snapping the front stop 1004 to the lateral member 1020.

Figure 32:
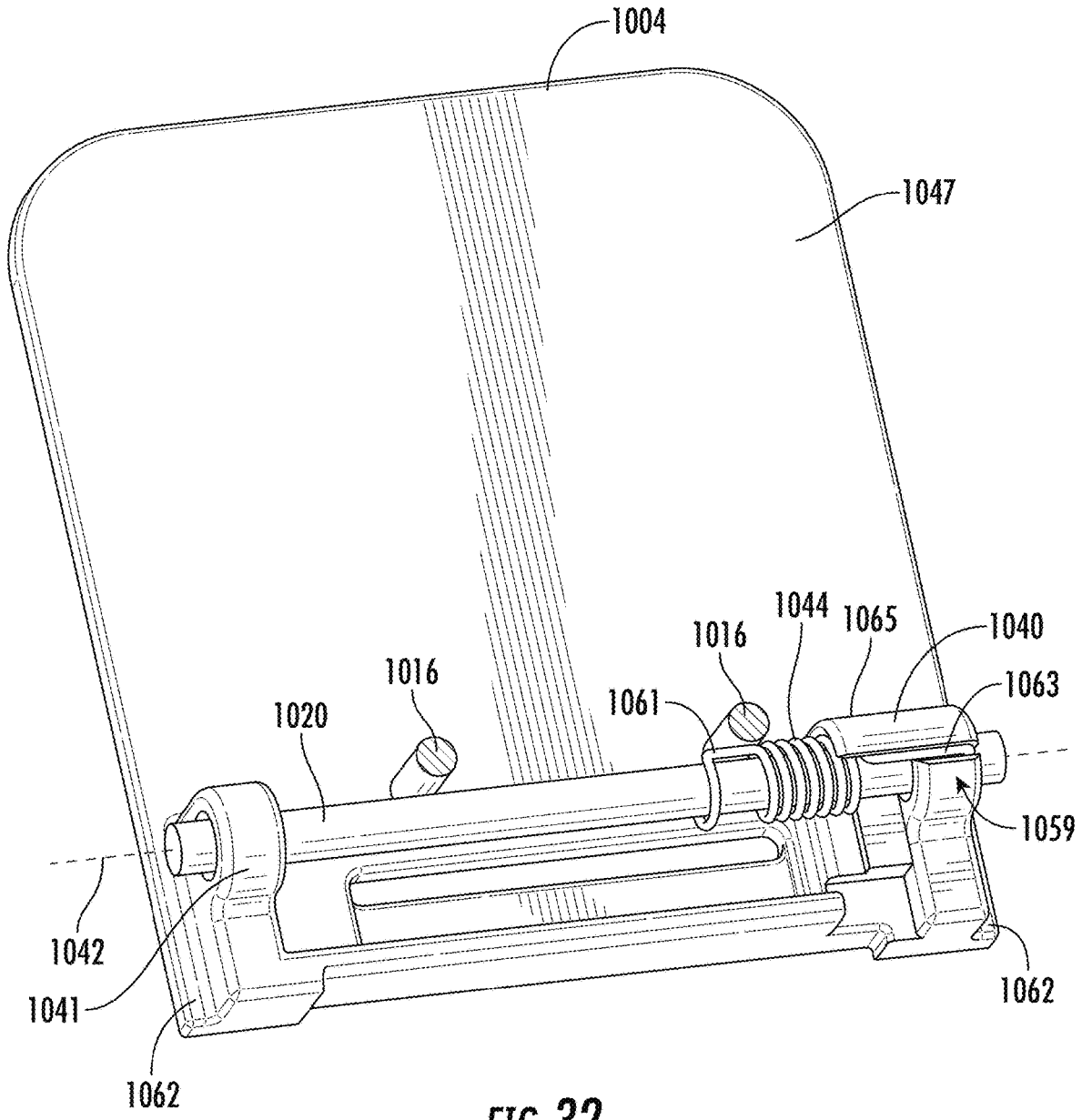
FIG. 32 is an illustration of the front stop of the tray of FIG. 30 mounted to the merchandise support frame.
Figure 33:
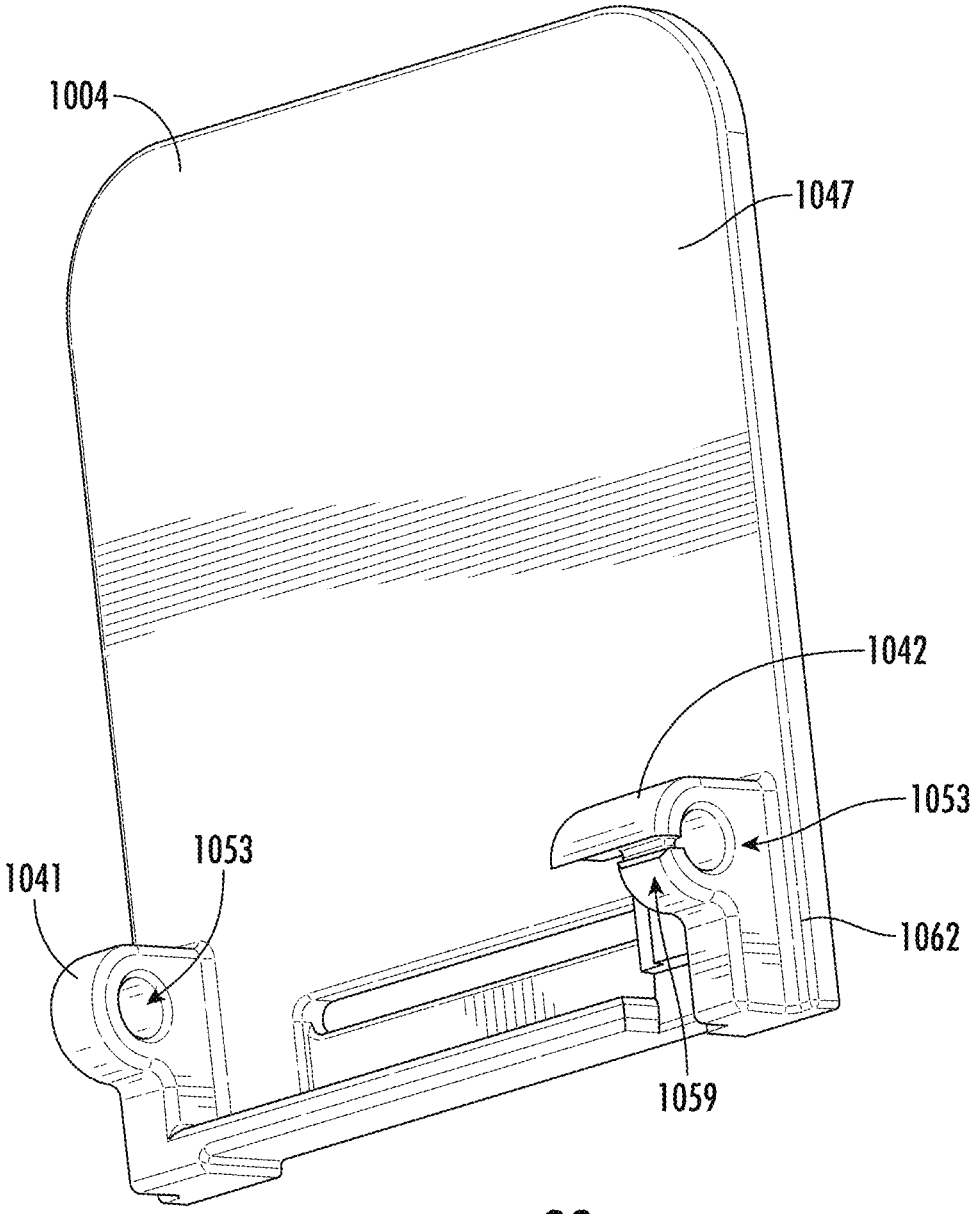
FIG. 33 is a perspective illustration of the front stop of the tray of FIG. 31.
Figure 34:
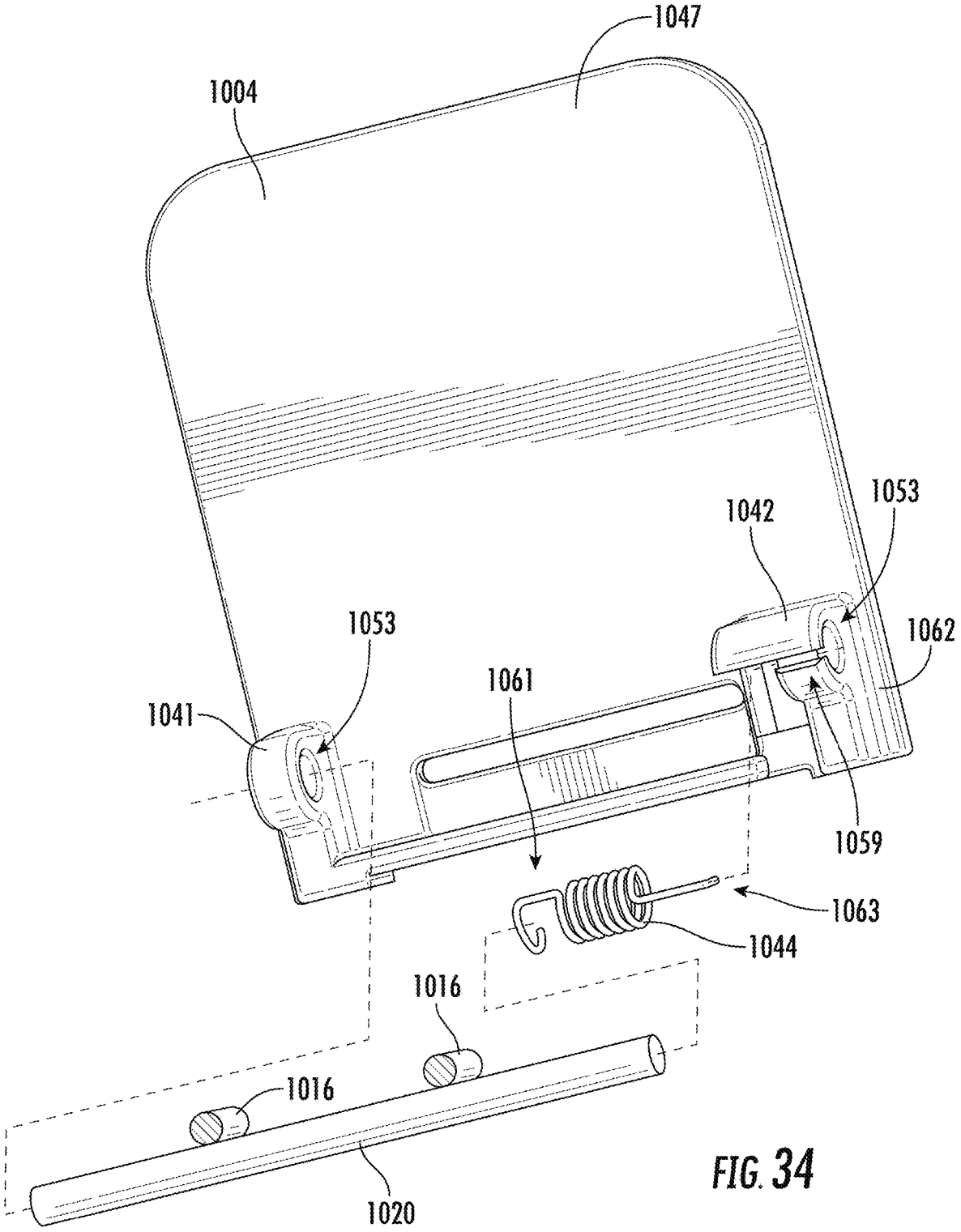
FIG. 34 is an exploded illustration of FIG. 32.

With reference to FIG. 32, biasing member 1044 engages front stop hinge 1040 and the wire support structure 1010 to bias the front stop 1004 toward the upright orientation. In this example, the biasing member 1044 is a coil spring that extends around lateral member 1020. Other resilient biasing members are contemplated.

One end 1061 of the biasing member 1044 engages longitudinal member 1016 while the other end 1063 of the biasing member engages the front stop hinge 1040.

Front stop hinge 1040 includes a slot 1059 that receives end 1063.

Front stop hinge 1040 includes a cover region 1065 that covers a portion of the biasing member 1044 and particularly a portion of the coils of the coil spring.

While a single biasing member is illustrated, multiple biasing members could be employed.

The rear face of the main panel 1047 provides rotation limiting abutments 1062 that abut corresponding structure of the merchandise support frame 1009 (see FIG. 32). In this example, the rotation limiting abutments 1062 abut ends of the load bearing members 1002 when in the upright orientation (see FIG. 31).

Figure 35:
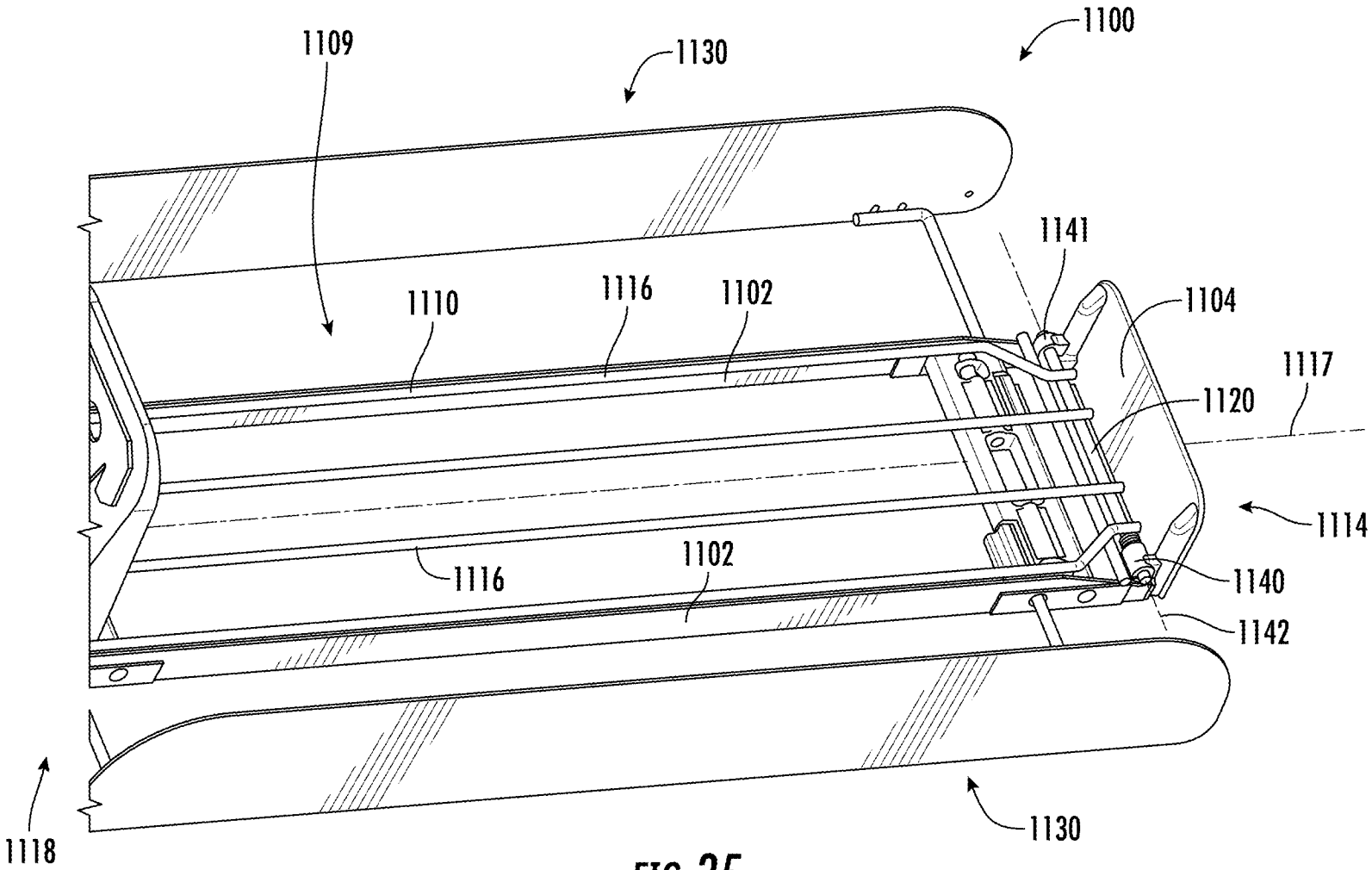
FIG. 35 is a further example of a retail merchandise tray assembly.

FIG. 35 illustrates a further example of a retail merchandise tray assembly 1100 also referred to as tray 1100. This tray 1100 is similar in many aspects to prior trays such as tray 100 or tray 1000. The principle distinctions of tray 1100 will be described. Any feature of the prior trays or structures that is not directly inconsistent with the features of tray 1100 described below can be incorporated into and used with the features of tray 1100.

In FIG. 35, the tray 1100 generally includes a product support frame 1109 that is used to support retail merchandise. The frame 1109 includes a pair of longitudinal members in the form of opposed spaced apart load bearing members 1102 that extend between first and second ends (front and rear ends) 1114, 1118 of the tray 1100. The load bearing members 102 extend longitudinally.

The load bearing members 1102 operably support a wire support structure 1110 of frame 1109. The frame 1109, and particularly the wire support structure 1110 in this example, defines a product support surface upon which product is supported.

In one example, the wire support structure 1110 and its longitudinally extending members 1116 and lateral members 1120, 1122 are formed into a unitary component. More particularly, the members 1116, 1120, 1122 are operably welded together. In one example, the members 1116, 1120, 1122 are formed by wires.

The wire support structure 1110 can be formed from metal or plastic.

The wire support structure 1110 is operably attached to the load bearing members such that the members 1116, 1120, 1122 are operably attached to the load bearing members 1102. However, each member 1116, 1120, 1122 need not be directly attached to the load bearing members 1102.

Figure 36:
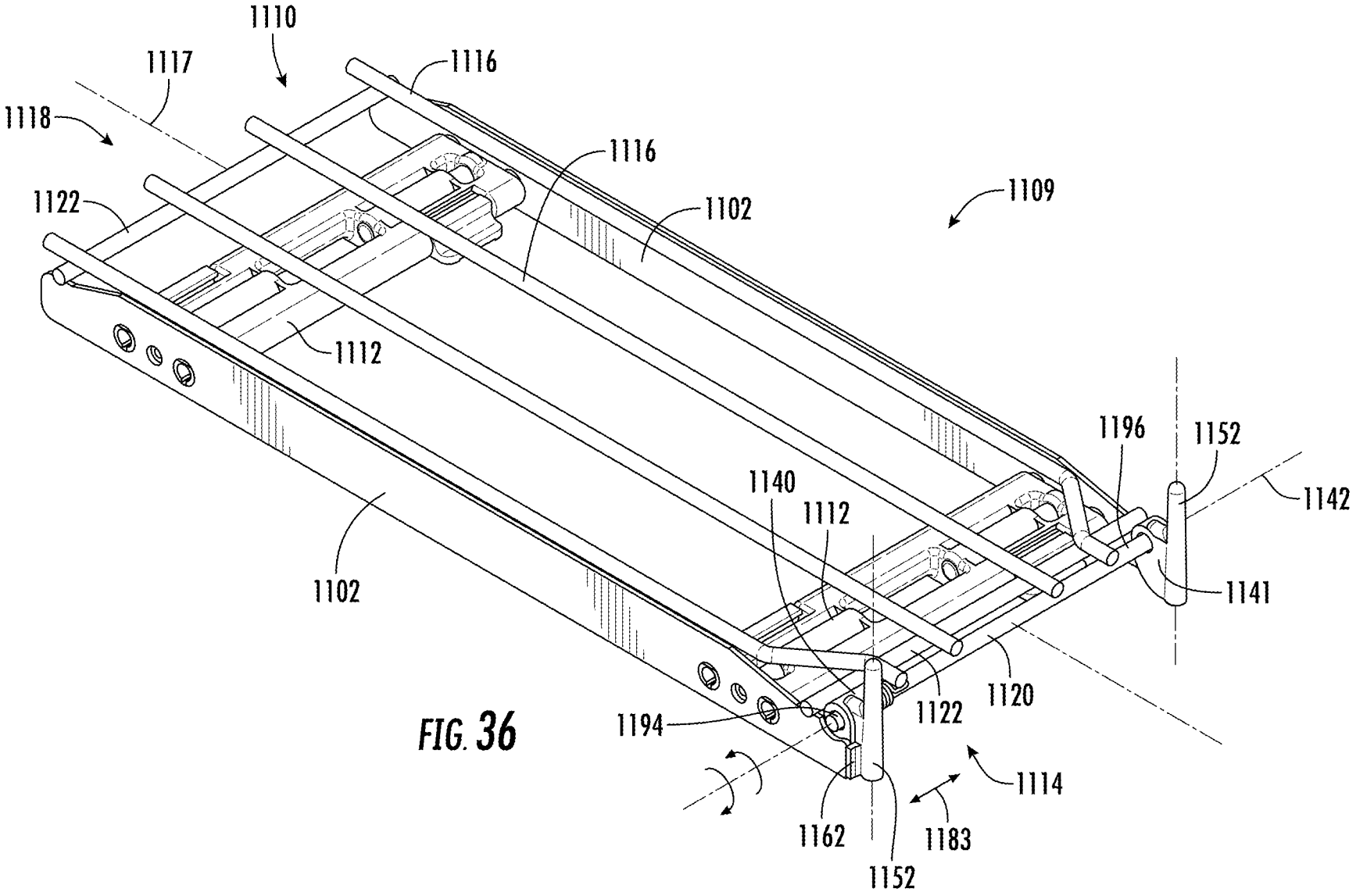
FIG. 36 illustrates the frame of the retail merchandise tray of FIG. 35.

FIG. 36 illustrates the wire support structure 1110 in an operational position relative to the load bearing members 1102 such that the frame 1109 can be used to support retail merchandise. The front stop hinges 1140, 1141 are operably removeable from the lateral member 1120 when the wire support structure 1110, and specifically lateral member 1120, is in this position relative to the load bearing members 1102.

In one example, the wire support structure 1110 is permanently attached to the load bearing members 1102. As such, the members 1116, 1120, 1122 are in a generally fixed position relative to the load bearing members 1102. Notably, some limited flexibility allows for some limited relative motion. The permanent attachment can be done by way of welding various ones of the lateral members, such as lateral members 1122 to the load bearing members 1102. Adhesives or other mechanical means of attachment (e.g. deformation of one of the lateral members) could also be used.

In other examples, the wire support structure 1110 can be removably attached to the load bearing members 1102. This can be done similar to trays 100 and 1000. For example ends of one or more of the lateral members 1122, other than lateral members 1120, can be axially inserted into apertures within the load bearing members 1102.

The tray 1100 includes a pusher that is mounted to the frame 1109, and particularly, longitudinally extending members 1116 for pushing product towards first end 1114 and towards a front stop 1104. The tray 1100 and particularly the product support frame 1109 defines a first longitudinal axis 1117 that extends between the first and second ends 1114, 1118.

In the illustrated example, front stop 1104 is a removable front stop but a front stop similar to front stop 1004 of tray 1000 could be incorporated in other examples.

Figure 37:
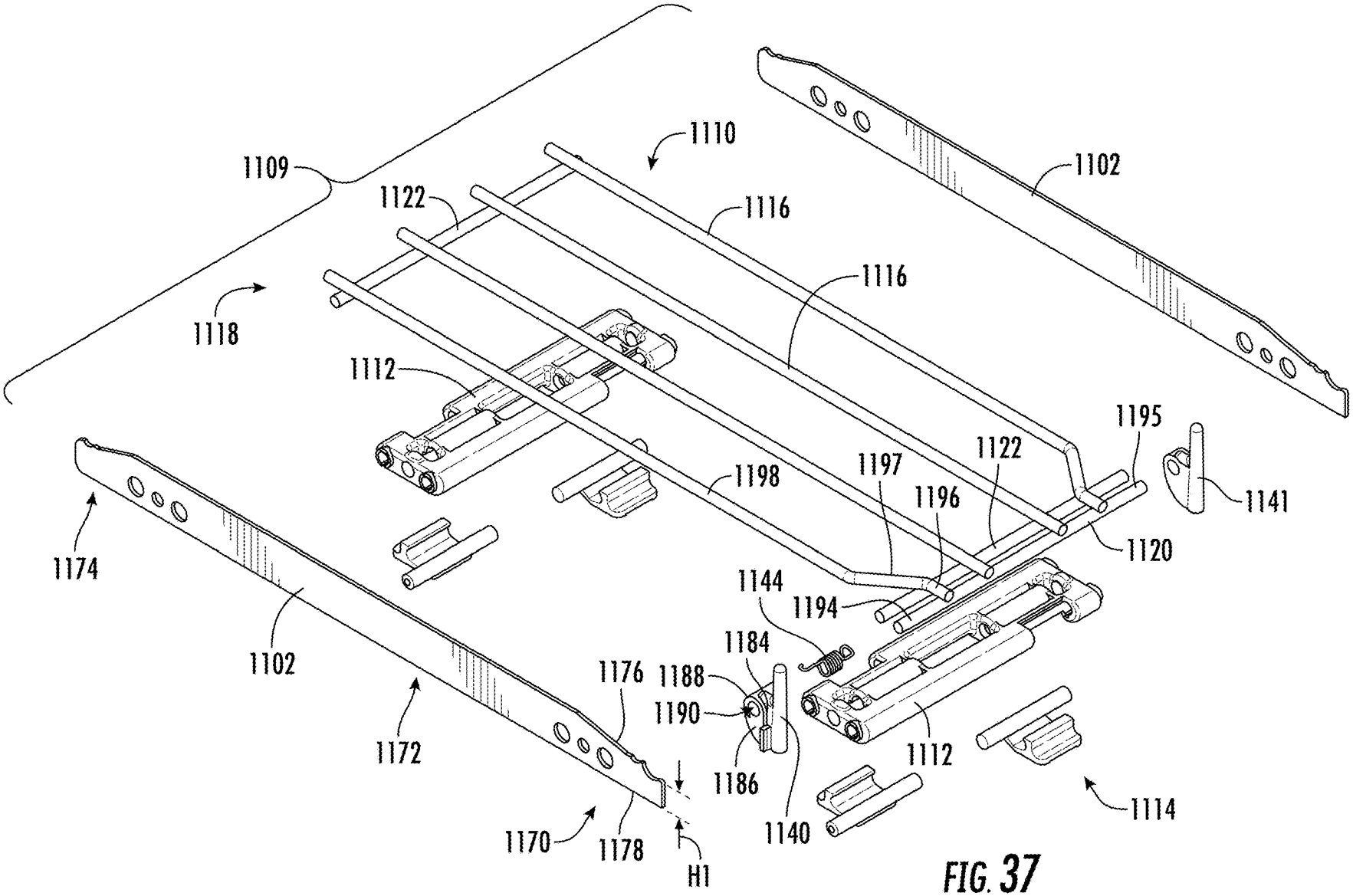
FIG. 37 is an exploded illustration of the frame of FIG. 36.

With additional reference to FIGS. 36 and 37, the wire support structure 1110 also includes lateral members 1120, 1122.

To mount the front stop 1104, a pair of front stop hinges 1140, 1141 are mounted to the frame 1109 for pivoting motion between first and second angular positions. In particular, the front stop hinges 1140, 1141 can rotate about longitudinal axis 1142 that is generally perpendicular to longitudinal axis 1117. As described previously, this allows a front stop 1104 to be transitioned from an upright orientation, similar to FIG. 6 and a reclined orientation, similar to FIG. 8).

In this example, the front stop hinges 1140, 1141 are mounted to wire support structure 1110 and particularly to lateral member 1120. In this example, axis 1142 is defined by lateral member 1120.

In this tray 1100, the front stop hinges 1140, 1141 can be mounted to and removed from the frame 1109 without disassembling the frame 1109. In prior examples, the wire support structure was required to be disconnected from one or both of the load bearing members.

In this example, the load bearing members 1102 need not be disconnected from the wire support structure 1110. In particular, the lateral member need not be moved relative to the load bearing members 1102 to mount or remove the front stop hinges 1140, 1141 relative to lateral member 1120.

This is particularly beneficial when retrofitting the tray 1100 when installed in a retail environment. Further, it allows for the fronts top hinges 1140, 1141 or an alternative front stop 1104 to be mounted after fully assembling the frame 1109 or rest of tray 1100.

In this example, the load bearing members 1102 extend longitudinally between first and second ends parallel to longitudinal axis 1117 (FIG. 36). The load bearing members 1102 are generally identical but mirror images of one another. Thus, the description of one load bearing member is applicable to the other load bearing member 1102.

With reference to FIGS. 36 and 37, load bearing member 1102 includes a first end portion 1170, an intermediate portion 1172, and a second end portion 1174. When assembled, the first end portion 1170 is located proximate first end 1114 while the second end portion 1174 is located proximate second end 1118. The intermediate portion 1172 is located axially between the first and second end portions 1170, 1172.

Figure 38:
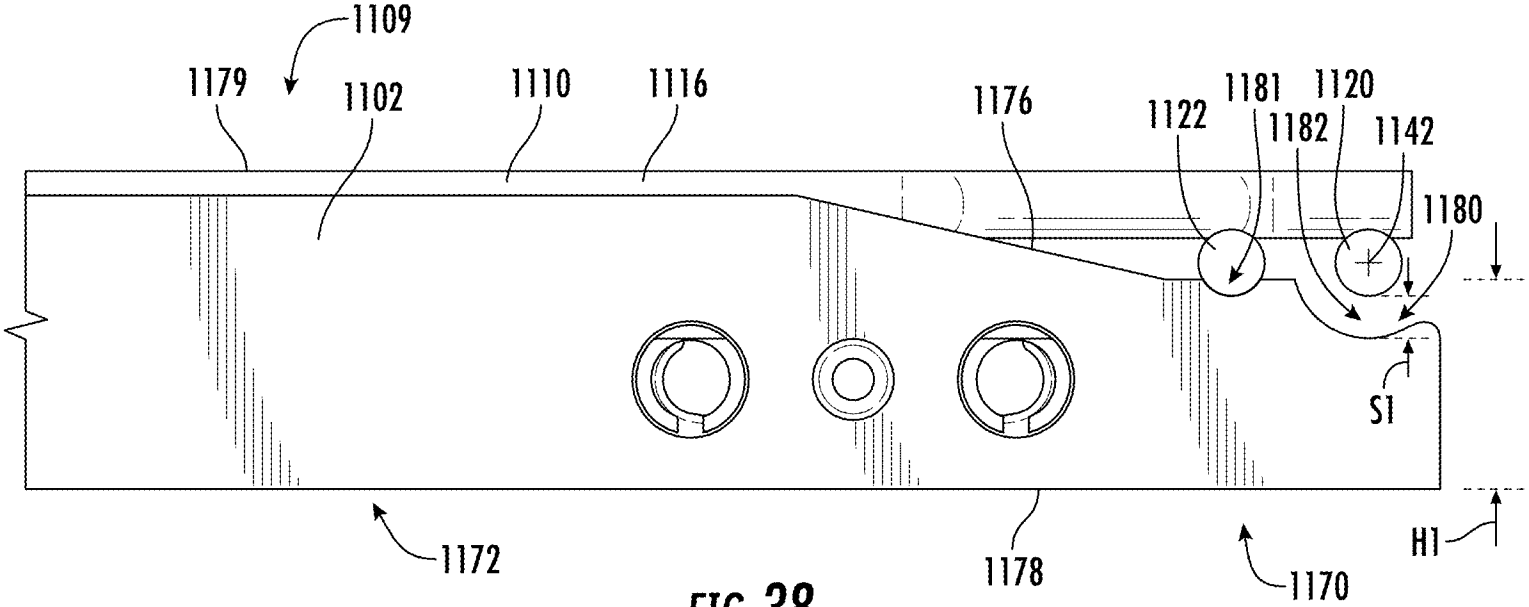
FIG. 38 is a side view of the frame of FIG. 36 with a front stop mounting hinge removed from the frame.

In this example, the first portion 1172 has a height H5 defined between a top 1176 and a bottom 1178. The height H5 is measured generally orthogonal to the product support surface 1179 defined by the frame 1109. With reference to FIG. 38 which is an enlarged portion of the frame 1109, the top 1176 is positioned closer to or more proximate to the product support surface 1179 (e.g. the top of the wire support structure 1110 in this example) than the bottom 1178. Further, in this example, the top 1176 is spaced away from the product support surface 1179.

In this example, the height H6 of the intermediate portion 1172 is greater than the height H5 of the first end portion 1170. The height H6 is measured between a top of the intermediate portion and a bottom of the intermediate portion 1172. In this example the bottom of the intermediate portion 1172 is aligned with the bottom of the first end portion 1170. In this arrangement, the top 1185 of the intermediate portion 1172 is closer to the product support surface 1179 than the top 1176 of the first end portion 1170.

In this example, the top 1176 of the first portion 1170 of the load bearing member 1102 is contoured. The contour includes a tapered region that increases in height when moving from the first end 1114 towards the second end 1118.

The contour also includes a pair of arcuate regions 1180, 1181. The first arcuate region 1180 is aligned with the first lateral member 1120. The first arcuate region 1180 is offset from the product support surface 1179.

A gap 1182 is formed between the top 1176 and the lateral member 1120 and particularly between the first arcuate region 1180 of top 1176 and the first lateral member 1120. In particular, the lateral member 1120 is offset from the top 1120 toward the product support surface 1179 with the lateral member being positioned between the top 1176 of the first end portion 1170 and the product support surface.

The gap 1182, in this example, has a spacing Si. This gap 1182 allows front stop hinge 1140 to mounted and removed from the first lateral member 1120, when the front stop hinge 1140 is properly oriented. The front stop hinge 1140 passes through the gap when the front stop hinge 1140 is removed and mounted to the first lateral member 1120.

In particular, in one example, the front stop hinge 1140 can axially slide (see e.g. arrow 1183 in FIG. 36) along the lateral member 1120 and parallel to axis 1142 to remove and to mount the front stop hinge 1140 relative to the lateral member 1120, again, when the stop hinge 1140 is properly oriented.

Figure 39:
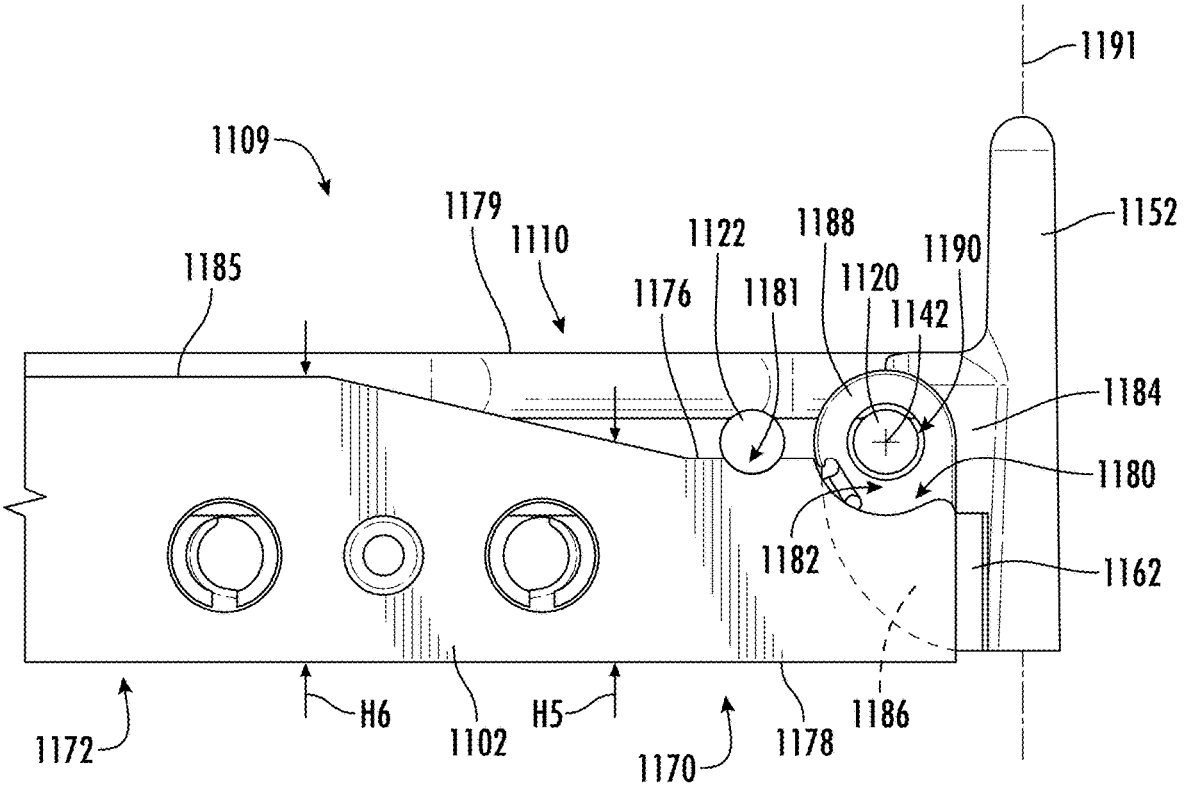
FIG. 39 is an enlarged illustration of a portion of the frame of FIG. 36 showing the front stop hinge in a first angular position.

FIG. 39 illustrates the front stop hinge 1140 in the first angular position. In this position, the load bearing member 1102 prevents the front stop hinge 1140 from sliding off of the end of the lateral member 1120.

Figure 40:
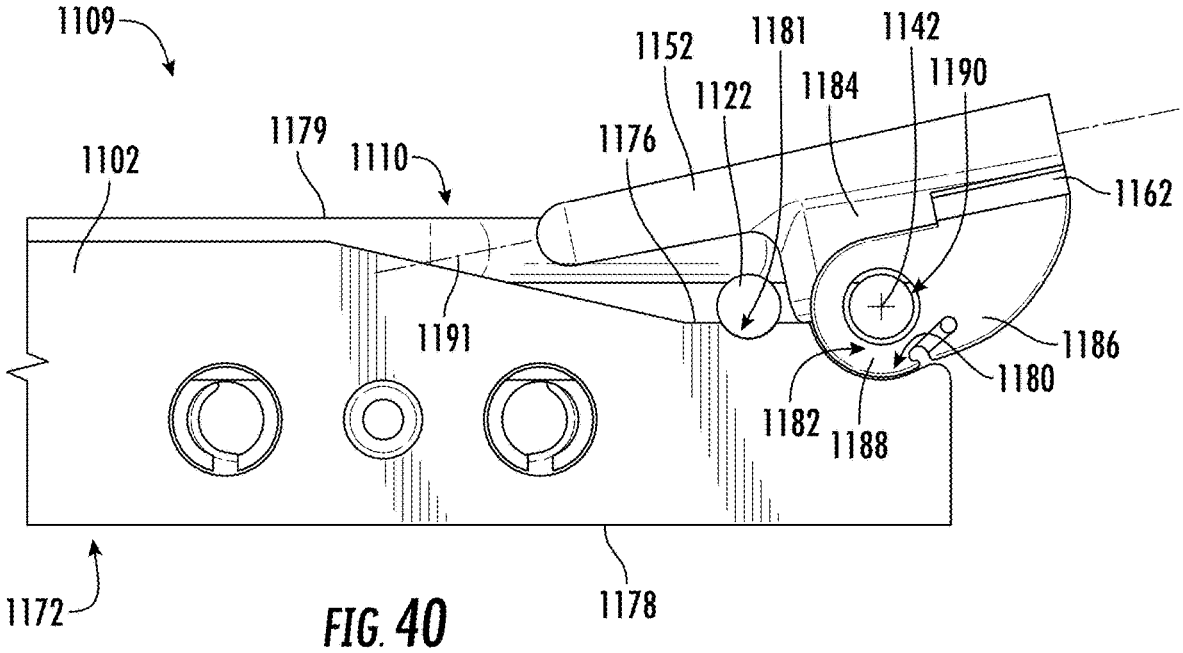
FIG. 40 is an enlarged illustration of a portion of the frame of FIG. 36 showing the front stop hinge in a second angular position.

FIG. 40 illustrates the front stop hinge 1140 in the second angular position. In this position, the front stop hinge 1140 is oriented such that it does not interfere with the load bearing member 1102 and can slide off lateral member 1120.

More particularly, the body 1184 of the front stop hinge 1140 includes a blocking portion 1186. The blocking portion 1186 is aligns with a portion of the first end portion 1170 of the load bearing member 1102 such that when the front stop hinge is in the orientation shown in FIG. 39 the blocking portion 1186 prevents axially sliding the front stop hinge 1140 off the lateral member 1120. In FIG. 39, the blocking portion 1186 is illustrated in dashed lines.

In the second angular position illustrated in FIG. 40, the front stop hinge 1140 has been rotated about axis 1142 and lateral member 1120. In this orientation, the blocking portion 1186 of body 1184 is rotated out of alignment with first end portion 1170 such that when the hinge portion is slid axially along the lateral member 1120 and axis 1142, the blocking portion 1186 will slide past the load bearing member 1102.

The body 1184 of front stop hinge 1140 includes a collar portion 1188 that defines a mounting aperture 1190 that receives the lateral member 1120. The portion of collar portion 1188 that aligns with the gap 1182 (see FIG. 38) between the lateral member 1120 and the arcuate region 1180 when the front stop hinge 1140 is in the second angular position is sized to pass through gap 1182. For example, the radial thickness of that portion of the collar portion 1188 is typically less than the spacing Si of gap 1182.

In a preferred embodiment, and as illustrated in FIG. 40, the front stop hinge 1140 must be rotated away from the first angular position a sufficient degree such that mounting pin axis 1191 of the front stop mounting pin 1152 transitions past being parallel to the product support surface. In this example, the front stop hinge 1140 must rotate more than 90 degrees from vertical (e.g. from the orientation in FIG. 39 to the orientation in FIG. 40).

In the second angular position, in this example, the mounting pin 1152 extends in a non-orthogonal orientation relative to product support surface 1179 and extends towards the second end 1118.

In one example, the tip of the mounting pin 1152 must pass below the product support surface 1179 in the second angular position in which the front stop hinge 1140 can be removed from the lateral member 1120.

Figure 41:
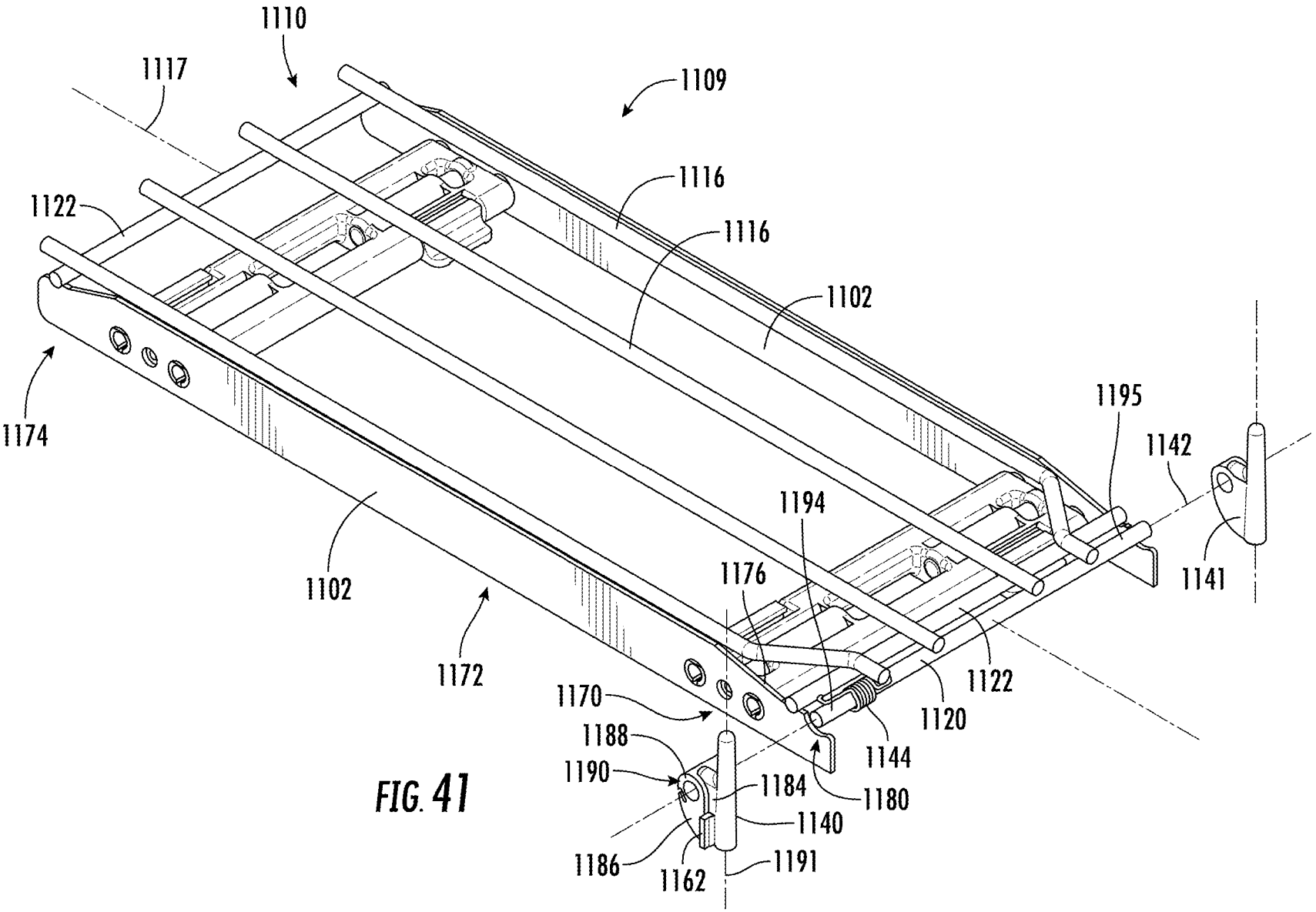
FIG. 41 is a partial exploded illustration of the frame of FIG. 36 showing the front stop hinges removed and in a first angular position.
Figure 42:
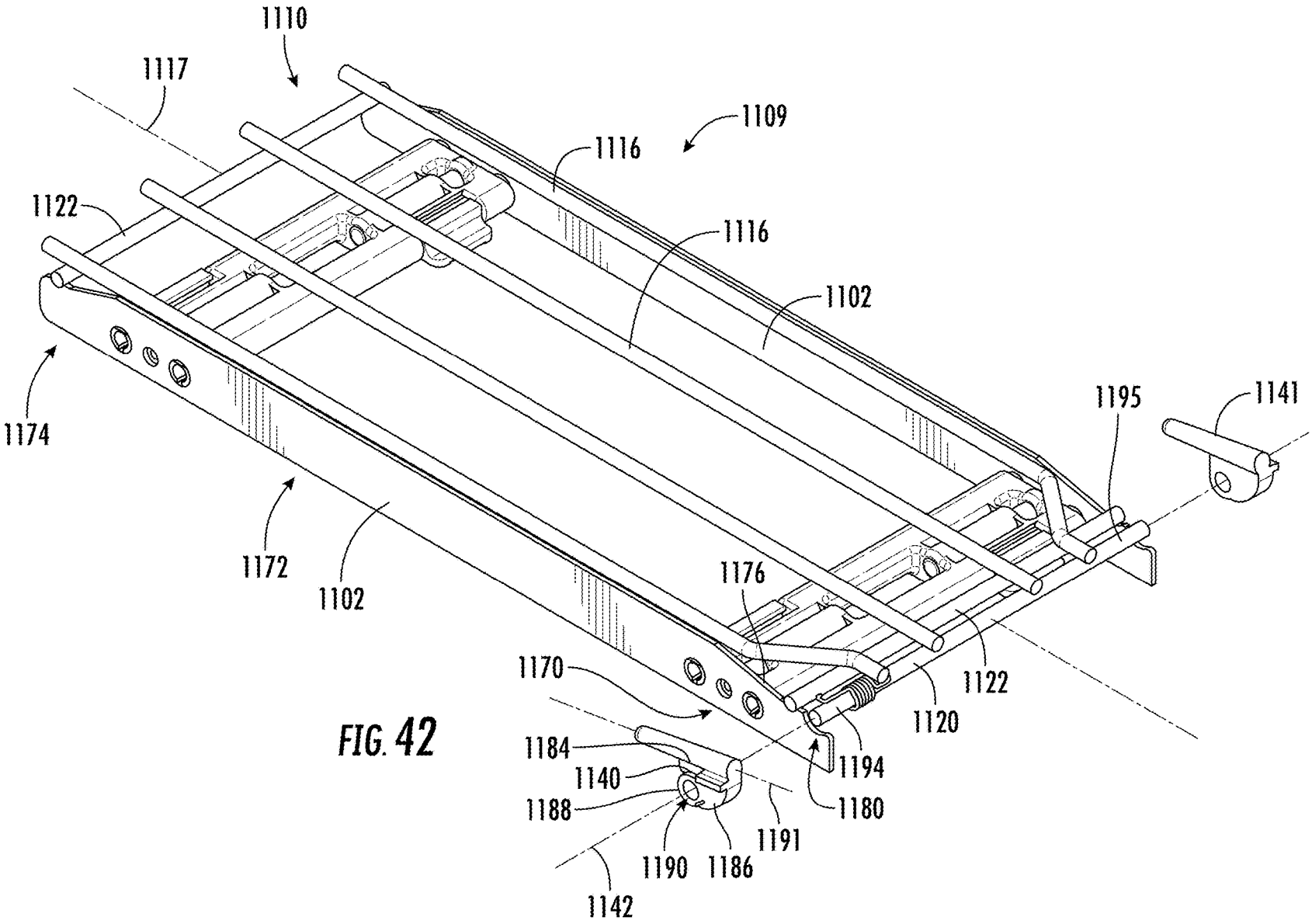
FIG. 42 is a partial exploded illustration of the frame of FIG. 36 showing the front stop hinges removed and in the second angular position.

FIGS. 41 and 42 illustrate the front stop hinges 1140, 1141 removed from the frame 1109 but in the first and second angular positions illustrated in FIGS. 39 and 40.

Further, in one example, when the front stop 1104 is mounted to the front stop hinge 1140, the front stop 1104 will abut the frame 1109, such as wire support structure 1110, prior to the front stop hinge 1140 rotating to this orientation. As such, once the front stop 1104 is mounted to the front stop hinge 1140, the front stop hinge 1140 cannot be removed from the lateral member 1120. This is due to the front stop 1104 limiting the angular rotation of the front stop hinge 1140 from reaching the orientation in FIG. 40.

The construction of the wire support structure 1110 divides the lateral member 1120 into multiple portions include a first end portion 1194 and a second end portion 1195. The front stop hinges 1140, 1141 are mounted on the first and second end portions 1194, 1195, respectively.

To accommodate the front stop hinges 1140, 1141, several longitudinal members 1116 are not perfectly straight. Instead, the two outer most longitudinal members 1116, in the illustrated example, include an end portion 1196 proximate first end 1114, an intermediate portion 1197 closer to the second end 1118, and a transition portion 1198 that connects the end portion 1196 to the intermediate portion 1197.

When assembled, the longitudinal members 1116, at least some, are connected to the lateral member 1120. Thus, the ends of the longitudinal members are positioned between the front stop hinges 1140, 1141. The longitudinal members 1116 thus prevent front stop hinge 1140 from being removed from the lateral member 1120 at second end portion 1195. Similarly, the longitudinal members 1116 prevent front stop hinge 1141 from being removed from the lateral member 1120 at first end portion 1194.

In this example, the end portion 1196 is attached to lateral members 1120 and 1122.

For these longitudinal members 1116, the end portion 1196 is laterally offset from the intermediate portion 1197 parallel to axis 1142 (e.g. perpendicular to axis 1117).

Figure 43:
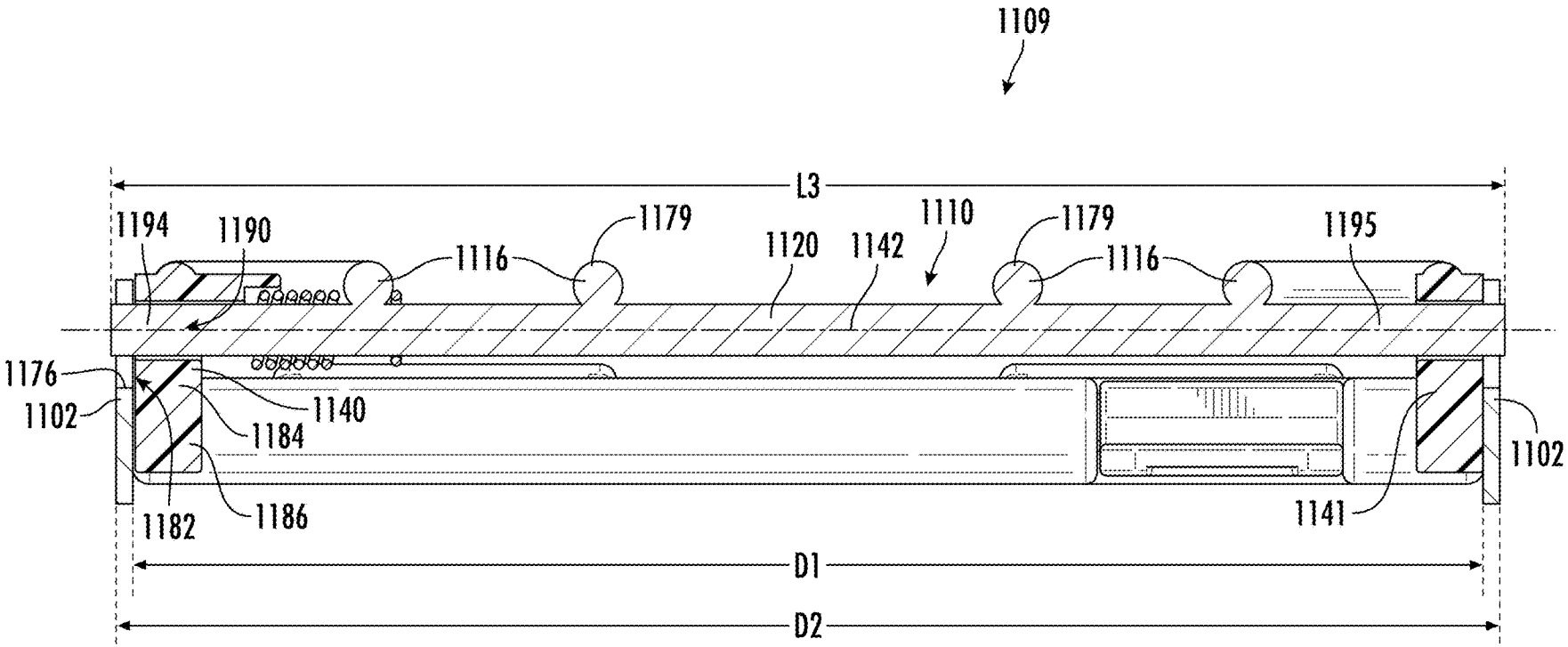
FIG. 43 is a cross-sectional illustration of the frame of FIG. 36 extending through a lateral member to which the front stop hinges are mounted.

With reference to FIG. 43, the inner faces of the load bearing members 1102 is spaced a distance D1. The length L3 of the lateral member 1120 is greater than distance D1. Further, length L3 is greater than the distance D2 defined by the outer faces of the load bearing members 1102.

In this example, the first and second end portions 1194, 1195 of lateral member 1120 extend axially beyond the inner faces and axially beyond the outer faces of load bearing members 1102. Notably, however, the lateral member 1120 does not extend into or through apertures formed through the load bearing members 1102.

In some embodiments, the ends of the lateral member 1120 may be spaced inward of the adjacent load bearing members 1102 but be spaced less than a width of the body 1184 that defines the mounting aperture 1190 such that the load bearing member 1102 still interferes with blocking portion 1186 to prevent removal when in the first rotational position.

Similar to prior embodiments, the front stop hinge 1140 includes a rotation limiting abutment 1162 that axially abuts the end of the adjacent load bearing member when the front stop hinge 1140 is in the first angular orientation (see e.g. FIG. 39).

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail merchandise tray assembly comprising:

a product support frame defining a product support surface, the product support frame including:

a first load bearing member extending longitudinally between a first end and a second end parallel to a first longitudinal axis, the first load bearing member having a first end portion, a top of the first end portion being more proximate the product support surface than a bottom of the first end portion;

a first lateral member extending perpendicular to the first longitudinal axis along a second longitudinal axis, the first lateral member being proximate the first frame end and positioned offset from the top of the first end portion to form a gap between the top of the first end portion of the first load bearing member and a bottom of the first lateral member; and a first front stop hinge mountable on the first lateral member for rotation about the first lateral member between a first angular position and a second angular position, the first front stop hinge configured to abut the first load bearing member when in the first angular position preventing removal of the first front stop hinge from the first lateral member and to slide through the gap when in the second angular position such that the first front stop hinge is axially slidable along the first lateral member parallel to the second axis to remove and to mount the first front stop hinge relative to the first lateral member when in the second angular position.

2. The retail merchandise tray of claim 1, wherein the first lateral member is a first wire of a wire support structure, the wire support structure further including a first longitudinal member in the form of a second wire extending from a first end attached to the first lateral member and a second end proximate the second frame end.

3. The retail merchandise tray of claim 1, wherein the first lateral member is operably attached to the load bearing member in a fixed position.

4. The retail merchandise tray of claim 1, wherein the first front stop hinge is removable from and mountable to the first lateral member when the first lateral member is in an operational position relative to the load bearing member, the operational position being when product may be supported on the product support surface.

5. The retail merchandise tray of claim 1, further comprising a front stop mounted to the first front stop hinge for rotation with the first front stop hinge about the first lateral member between the first and second angular positions, in the first angular position, the front stop is in an upright orientation relative to the product support surface, and in the second angular position, the front stop is in a reclined orientation relative to the product support surface.

6. The retail merchandise tray of claim 1, wherein:

the first load bearing member has a first height being orthogonal to the product support surface and measured between the top of the first end portion and the bottom of the first end portion;

the first load bearing member includes an intermediate portion having a second height being orthogonal to the product support surface and measured between a top of the intermediate portion and a bottom of the intermediate portion, the top of the intermediate portion being more proximate the product support surface than the bottom of the intermediate portion;

the top of the first end portion is spaced farther away from the product support surface than the top of the intermediate portion; and wherein the first height is less than the second height.

7. The retail merchandise tray of claim 1, wherein a portion of the top of the first end portion is tapered such that a height of the first end portion increases when moving from the first end towards the second end.

8. The retail merchandise tray of claim 1, wherein the top of the first end portion includes an arcuate region providing a relief through which the first front stop hinge passes when the first front stop hinge is mounted to or removed from the first lateral member.

9. The retail merchandise tray of claim 1, wherein the first front stop hinge has a mounting collar and a mounting pin, the mounting collar defines a mounting aperture receiving the lateral member when the first front stop hinge is mounted, and the mounting pin extends axially from the mounting collar.

10. The retail merchandise tray of claim 1, wherein the first front stop hinge includes an axially extending mounting pin defining a mounting pin axis, in the first angular position the mounting pin axis is generally orthogonal to the product support surface and in the second angular position the mounting pin axis is closer to parallel to the product support surface than in the first angular position.

11. The retail merchandise tray of claim 1, wherein rotation of the first front stop hinge from the first angular position to the second angular position is greater than 90 degrees.

12. The retail merchandise tray of claim 1, wherein:

the first front stop hinge includes an axially extending mounting pin having a tip;

in the first angular position, the tip of the first front stop hinge is on a first side of the product support surface;

in the second angular position, the tip of the first front stop hinge is on a second side of the product support surface, opposite the first side; and the first lateral member is on the second side of the product support surface.

13. The retail merchandise tray of claim 1, further comprising:

a second front stop hinge laterally spaced apart from the first front stop hinge, the second front stop hinge having a mounting aperture rotatably mounting the second front stop hinge on the first lateral member for rotation about the first lateral member between a first angular position and a second angular position, the first and second angular positions of the second front stop hinge corresponding to the first and second angular positions of the first front stop hinge; and a front stop attached to the first and second front stop hinges.

14. The retail merchandise tray of claim 1, further comprising:

a second front stop hinge laterally spaced apart from the first front stop hinge, the second front stop hinge having a mounting aperture rotatably mounting the second front stop hinge on the first lateral member for rotation about the first lateral member between a first angular position and a second angular position, the first and second angular positions of the second front stop hinge corresponding to the first and second angular positions of the first front stop hinge; and a front stop attached to the first and second front stop hinges;

at least one first longitudinal member extending from a first end attached to the first lateral member and a second end proximate the second frame end;

wherein:

the first end of the at least one first longitudinal member is positioned between the first and second front stop hinges;

the first lateral member extending between first and second ends along the second longitudinal axis, the at least one first longitudinal member being attached between the first and second ends separating the first lateral member into a first portion between the first end and the at least one first longitudinal member and a second portion between the second end of the lateral member and the at least one first longitudinal member;

the first front stop hinge mounted to the first portion;

the second front stop hinge mounted to the second portion;

the at least one first longitudinal member preventing the first front stop hinge from being removed from the first lateral member at the second portion; and the at least one first longitudinal member preventing the second front stop hinge from being removed from the first lateral member at the first portion.

15. The retail merchandise tray of claim 1, further comprising a second load bearing member laterally spaced from the first load bearing member a first distance measured parallel to the second longitudinal axis;

wherein:

the first lateral member extends between first and second ends a first length parallel to the second longitudinal axis, the first length being greater than the first distance;

the first lateral end being positioned proximate the first end portion of the first load bearing member and extending laterally outward beyond an inner surface of the first load bearing member; and the second lateral end being positioned proximate a first end portion of the second load bearing member and extending laterally outward beyond an inner surface of the second load bearing member; and the first lateral member does not extend through either the first or second load bearing member.

16. The retail merchandise tray of claim 1, wherein:

the first front stop hinge has a main body defining the mounting aperture, the main body having a first portion sized to abut the first load bearing member when the first front stop hinge is in the first angular position such that the first portion of the main body prevents removal of the first front stop hinge from the first lateral member; and the main body has a second portion sized to pass through the gap when the first front stop hinge is in the second angular position permitting removal of the first front stop hinge from the first lateral member.

17. A method comprising:

assembling a retail merchandise tray of claim 1 including:

with the first lateral member in an operational position relative to the load bearing member, installing the first front stop hinge on the first lateral member.

18. The method of claim 17, wherein, during the step of installing the front stop hinge, the first lateral member is operably attached to the load bearing member in a fixed position.

19. The method of claim 17, wherein:

the first front stop hinge has a main body defining a mounting aperture, the main body having a first portion sized to abut the first lateral member when the first front stop hinge is in the first angular position preventing removal of the first front stop hinge from the first lateral member; and the main body has a second portion sized to pass through the gap when the first front stop hinge is in the second angular position permitting removal of the first front stop hinge from the first lateral member; and the step of installing includes orienting the second portion with the gap and then sliding the first front stop hinge onto the first lateral member.

20. A retail merchandise tray assembly comprising:

a product support frame defining a product support surface, the product support frame including:

a first load bearing member extending longitudinally between a first end and a second end parallel to a first longitudinal axis, the first load bearing member having a first end portion having a top;

a first lateral member operably attached to the load bearing member, the first lateral member extending perpendicular to the first longitudinal axis along a second longitudinal axis, the first lateral member being offset from the top of the first end portion; and a first front stop hinge mountable on the first lateral member for rotation about the first lateral member between a first angular position and a second angular position, the first front stop hinge being axially slidable along the first lateral member parallel to the second axis to remove and to mount the first front stop hinge relative to the first lateral member;

wherein:

the first front stop hinge is removable from and mountable to the first lateral member when the first front stop hinge is in the second angular position; and the first front stop hinge is not removable from or mountable to the first lateral member when the first front stop hinge is in the first angular position.

21. The retail merchandise tray of claim 20, wherein the first load bearing member interferes with the first front stop hinge when the first front stop hinge is in the first angular position to prevent removal from or mounting to the first lateral member by the first front stop hinge.

* * * * *